US009896164B2

(12) United States Patent
Torii et al.

(10) Patent No.: US 9,896,164 B2
(45) Date of Patent: Feb. 20, 2018

(54) FLOAT MOORING METHOD, MOORING MEMBER, AND METHOD OF RECOVERING SAME

(71) Applicant: NIPPON STEEL & SUMIKIN ENGINEERING CO., LTD., Tokyo (JP)

(72) Inventors: Tadashi Torii, Tokyo (JP); Kohichi Fujiwara, Tokyo (JP); Hiroshi Ookubo, Tokyo (JP); Chikara Iwamoto, Tokyo (JP); Atsushi Yamashita, Tokyo (JP)

(73) Assignee: NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 15/324,112

(22) PCT Filed: Jul. 10, 2015

(86) PCT No.: PCT/JP2015/069835
§ 371 (c)(1),
(2) Date: Jan. 5, 2017

(87) PCT Pub. No.: WO2016/006675
PCT Pub. Date: Jan. 14, 2016

(65) Prior Publication Data

US 2017/0190388 A1 Jul. 6, 2017

(30) Foreign Application Priority Data

Jul. 10, 2014 (JP) ..... 2014-142212

(51) Int. Cl.
*B63B 21/00* (2006.01)
*B63B 21/29* (2006.01)
(Continued)

(52) U.S. Cl.
CPC ..... *B63B 21/29* (2013.01); *B63B 21/20* (2013.01); *B63B 21/22* (2013.01); *B63B 22/02* (2013.01); *B63B 2035/446* (2013.01)

(58) Field of Classification Search
CPC ..... B63B 21/29; B63B 21/20; B63B 21/22; B63B 21/02
See application file for complete search history.

(56) References Cited

U.S. PATENT DOCUMENTS 4,347,012 A * 8/1982 Glidden ..... B63B 21/50 114/230.2
5,265,553 A * 11/1993 Brydges ..... B63B 21/00 114/230.22

FOREIGN PATENT DOCUMENTS

JP 56-112382 A 9/1981
JP 62-275888 A 11/1987
(Continued)

OTHER PUBLICATIONS

International Search Report, issued in PCT/JP2015/069835, dated Sep. 15, 2015.
(Continued)

*Primary Examiner* — Stephen P Avila
(74) *Attorney, Agent, or Firm* — Birch, Stewart, Kolasch & Birch, LLP

(57) ABSTRACT

A mooring method includes the steps of: transporting a mooring member having a mooring cable which can be connected to a float at one end and an accommodation member installed at the other end of the mooring cable and has an accommodation space therein to a mooring position of the float; accommodating a first heavy weight in at least a part of the accommodation space of the accommodation member at the mooring position; connecting the one end of the mooring cable to the float at the mooring position after the accommodation step; and accommodating a second
(Continued)

heavy weight in the accommodation space of the accommodation member by adding the second heavy weight to the first heavy weight or exchanging at least part of the first heavy weight with the second heavy weight at the mooring position after the connection step.

11 Claims, 43 Drawing Sheets

(51) Int. Cl.

| | |
|---|---|
| ***B63B 21/20*** | (2006.01) |
| ***B63B 21/22*** | (2006.01) |
| ***B63B 22/02*** | (2006.01) |
| *B63B 35/44* | (2006.01) |

(56) References Cited

FOREIGN PATENT DOCUMENTS

| | | | |
|---|---|---|---|
| JP | 63-197712 | A | 8/1988 |
| JP | 2-125012 | A | 5/1990 |
| JP | 9-58575 | A | 3/1997 |
| JP | 2004-42810 | A | 2/2004 |
| JP | 2012-201191 | A | 10/2012 |

OTHER PUBLICATIONS

Japanese Office Action and English translation for Priority Application No. 2014-142212, dated Mar. 15, 2016.
Written Opinion of the International Searching Authority, issued in PCT/JP2015/069835, dated Sep. 15, 2015.

* cited by examiner

FLOAT MOORING METHOD, MOORING MEMBER, AND METHOD OF RECOVERING SAME

TECHNICAL FIELD

The present invention relates to a float mooring method, a mooring member, and a method of recovering the same.

Priority is claimed on Japanese Patent Application No. 2014-142212, filed Jul. 10, 2014, the content of which is incorporated herein by reference.

BACKGROUND ART

In the related art, as a mooring method for tying articles floating (hereinafter, referred to as "floats") in water areas such as sea areas to the bottom using a cable or a chain, for example, there is a method disclosed by Patent document 1. This is a method for tying the upper parts of marine structures to anchors installed on the seabed via cables.

CITATION LIST

Patent Document

Patent document 1: Japanese Unexamined Patent Application, First Publication No. S63-197712

DISCLOSURE OF THE INVENTION

Technical Problem

However, in Patent document 1, there is room for improvement in facilitating a float mooring operation.

The present invention has been made in consideration of the above-described circumstance, and an object of the present invention is to facilitate float mooring operation.

Solution to Problem

According to a first aspect of the present invention, a float mooring method includes: a transportation step of transporting a mooring member having a mooring cable which can be connected to a float at one end thereof and an accommodation member which is installed at the other end of the mooring cable or between the one end and the other end of the mooring cable and has an accommodation space therein to a mooring position of the float in a working water area; a first accommodation step of accommodating a first heavy weight in at least a part of the accommodation space of the accommodation member at the mooring position; a connection step of connecting the one end of the mooring cable to the float at the mooring position after the first accommodation step; and a second accommodation step of accommodating a second heavy weight in the accommodation space of the accommodation member by adding the second heavy weight to the first heavy weight or exchanging at least part of the first heavy weight with the second heavy weight at the mooring position after the connection step.

In this case, in the second accommodation step after the connection step, the second heavy weight is accommodated in the accommodation space of the accommodation member by being added to the first heavy weight or being exchanged with at least part of the first heavy weight at the mooring position. Therefore, it is possible to easily connect the mooring cable to the float before the second accommodation step and increase the specific weight of the accommodation member in the same manner as that of a weight member during the second accommodation step.

In the transportation step, the mooring member may be transported in a state in which the accommodation space is filled with air.

According to the above-described mooring method, compared with a case in which the heavy weight is included in the accommodation space of the accommodation member, the weight of the accommodation member is decreased, and thus it is possible to easily transport the mooring member. In addition, when the accommodation space of the accommodation member is filled with air, a buoyant force is generated in the accommodation member, and thus it is possible to easily float and tow the mooring member.

In a case in which a float is moored in a water area, it can be also considered that a heavy weight is accommodated in advance in an accommodation space of a mooring member which has been manufactured onshore and the mooring member is transported to a mooring position. However, in this case, the heavy weight is accommodated in the accommodation space of the mooring member, and thus the floating and towing of the accommodation member becomes difficult. In contrast, according to this mooring method, since the accommodation space of the accommodation member is filled with air, the floating and towing of the accommodation member become easy.

At least one of the first heavy weight and the second heavy weight may have flowability.

According to the above-described mooring method, it is possible to easily accommodate heavy weights in the accommodation space of a tube member in at least one of the first accommodation step and the second accommodation step.

As the first heavy weight and the second heavy weight, use of solid substances such as broken stones can be considered. However, in this case, for the transportation of broken stones, an equipment such as a grab bucket excavator is required, and there is a possibility of a long time being taken to transport the broken stones. In contrast, according to the mooring method of the present invention, at least one of the first heavy weight and the second heavy weight has flowability, and thus the equipment such as the grab bucket excavator is not required, and it does not take a long time to transport the heavy weights.

In the second accommodation step, the same substance as the first heavy weight in the first accommodation step may be used as the second heavy weight.

According to the above-described mooring method, compared with a case in which different heavy weights are used in the respective steps, it is possible to easily accommodate the second heavy weight in the second accommodation step.

As the first heavy weight and the second heavy weight, water in the water area may be used.

According to the above-described mooring method, compared with a case in which water which is different from water in the water area is prepared, it is possible to easily accommodate the heavy weights in the first accommodation step and the second accommodation step.

As the mooring member, a weight member which is attached to the other end of the mooring cable or in the accommodation member, is placed at the bottom of the water area, and has a filling space therein may also be used.

According to the above-described mooring method, it is possible to easily fill the weight member with the heavy weight.

Before the connection step, a buoy-joining step of joining a buoy with the one end of the mooring cable and floating the buoy on a water surface in the water area may be provided.

According to the above-described mooring method, it is possible to suppress the one end of the mooring cable sinking into the water and easily connect the mooring cable to the float.

As the accommodation member, a tube member which is attached to the other end of the mooring cable may be used.

According to the above-described mooring method, it is possible to easily moor the float using a simple constitution. Also, it is possible to easily adjust the weight of the accommodation member and the tensile force of the mooring cable by adjusting the kind, specific weight, and weight of the heavy weight that is accommodated in the tube member, the volume ratio between the heavy weight and air, and the like.

As the accommodation member, a variant member which is attached between the one end and the other end of the mooring cable may be used.

According to the above-described mooring method, it is possible to easily moor the float using a simple constitution.

Multiple variant members may be placed at predetermined intervals between the one end and the other end of the mooring cable.

According to the above-described mooring method, it is possible to accommodate the first heavy weight and the second heavy weight in each of the multiple variant members and easily adjust the weight of the accommodation member and the tensile force of the mooring cable.

As the mooring member, a first mooring member which is connected to a first connection portion of the float and a second mooring member which is connected to a second connection portion that is placed at a position different from that of the first connection portion in the float may be used.

According to the above-described mooring method, since it is possible to cause tensile forces suitable for the respective mooring members to be exerted, compared with a case in which the tensile force is adjusted by varying the length of the mooring cable, it is possible to easily adjust the tensile force of the mooring cable. Also, when only the kinds (specific weights) and amounts of the heavy weights are changed in the respective mooring members, it is possible to individually impart a variety of characteristics to the respective mooring members even when the mooring cables and the accommodation members are the same as each other in the respective mooring members. Also, in a case in which multiple (for example, three) mooring members are placed, when one of the three mooring members is replaced in the recovering step or the like, it is possible to make the remaining two mooring members appropriately heavy, and the recovering work becomes easy.

According to another aspect of the present invention, a float mooring member is provided, including: a mooring cable which can be connected to a float at one end thereof; and an accommodation member which is installed at the other end of the mooring cable or between the one end and the other end of the mooring cable and has an accommodation space therein, in which a heavy weight having flowability is accommodated in the accommodation space of the accommodation member.

According to the above-described mooring member, since the heavy weight has flowability, an equipment such as a grab bucket excavator is not required, and it does not take a long time to transport the heavy weights, and thus it is possible to easily accommodate and recover the heavy weights. Also, since the weight of the accommodation member is decreased by removing the heavy weight from the accommodation member, that is, filling the accommodation space of the accommodation member with air, it is possible to easily transport the mooring member. In addition, when the accommodation space of the accommodation member is filled with air, a buoyant force is generated in the accommodation member, and thus it is possible to easily float and tow the mooring member.

As the heavy weight, use of solid substances such as broken stones or solidified materials such as concrete can be considered. However, in a case in which broken stones are used, the equipment such as the grab bucket excavator is required to transport broken stones, and there is a possibility of a long time being taken to transport the broken stones. In a case in which concrete is used, since concrete is solidified after being accommodated, although maintaining flowability while being accommodated, there is a possibility of a long time being taken to recover the solidified concrete. In contrast, according to this constitution, the heavy weights have flowability, and thus the equipment such as the grab bucket excavator is not required, and it does not take a long time to transport the heavy weights.

Also, when the heavy weight is removed from the accommodation member, that is, the accommodation space of the accommodation member is filled with air, the weight of the accommodation member is decreased.

Also, when the accommodation space of the accommodation member is filled with air, the floating and towing of the accommodation member becomes easy.

Furthermore, the accommodation space can be filled with air by (1) feeding compressed air into the accommodation space so as to discharge the heavy weight, (2) suctioning the heavy weight so as to let air naturally enter the accommodation space, or (3) performing both (1) and (2).

According to still another aspect of the present invention, a method of recovering the mooring member is provided, including: a first step of removing the heavy weight from the accommodation space of the accommodation member; and a second step of recovering the accommodation member from a working water area after the first step.

According to the above-described recovering method, after the heavy weight is removed from the accommodation member in the first step, the accommodation member is recovered from a working water area in the second step, and thus the accommodation member can be easily recovered, and it becomes possible to reuse the accommodation member.

Advantageous Effects of Invention

According to the present invention, before the second accommodation step, the mooring cable can be easily connected to the float, and the specific weight of the accommodation member can be increased in the same manner as that of the weight member during the second accommodation step, and thus it is possible to easily moor the float.

BEST MODE FOR CARRYING OUT THE INVENTION

First Embodiment

Hereinafter, a first embodiment of the present invention will be described with reference to the accompanying drawings.

Figure 1:
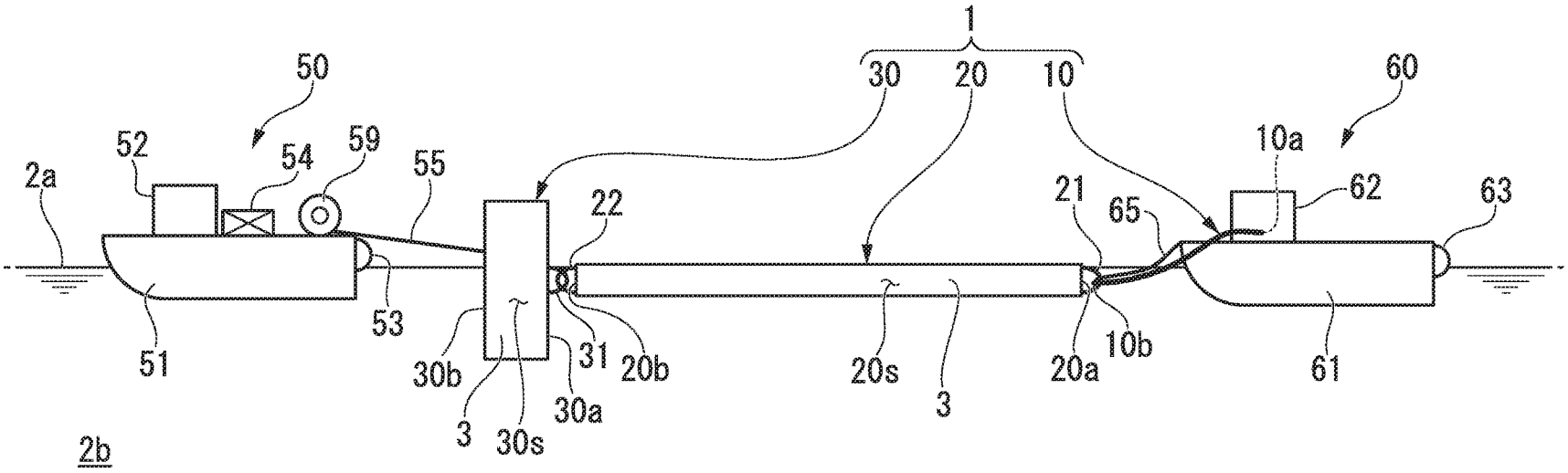
FIG. 1 is an explanatory view of a transportation step of a mooring member according to a first embodiment of the present invention.

FIG. 1 is an explanatory view of a transportation step of a mooring member 1 according to the first embodiment of the present invention.

As illustrated in FIG. 1, the mooring member 1 includes a mooring cable 10, a tube member 20 (accommodation member), and a weight member 30. The mooring member 1 moors a float 80 (refer to FIG. 9) such as a floating wind power generation device at a previously-specified mooring position P (refer to FIG. 2) offshore.

Furthermore, in the present embodiment, the float 80 is installed in a sea area, but may be installed in other water areas such as lakes or rivers. That is, the mooring position P may be set to other water areas such as lakes or rivers depending on the installation place of the float 80.

The mooring cable 10 is formed of a linear member such as a rope or a chain which can be smoothly bent. One end

Figure 9:
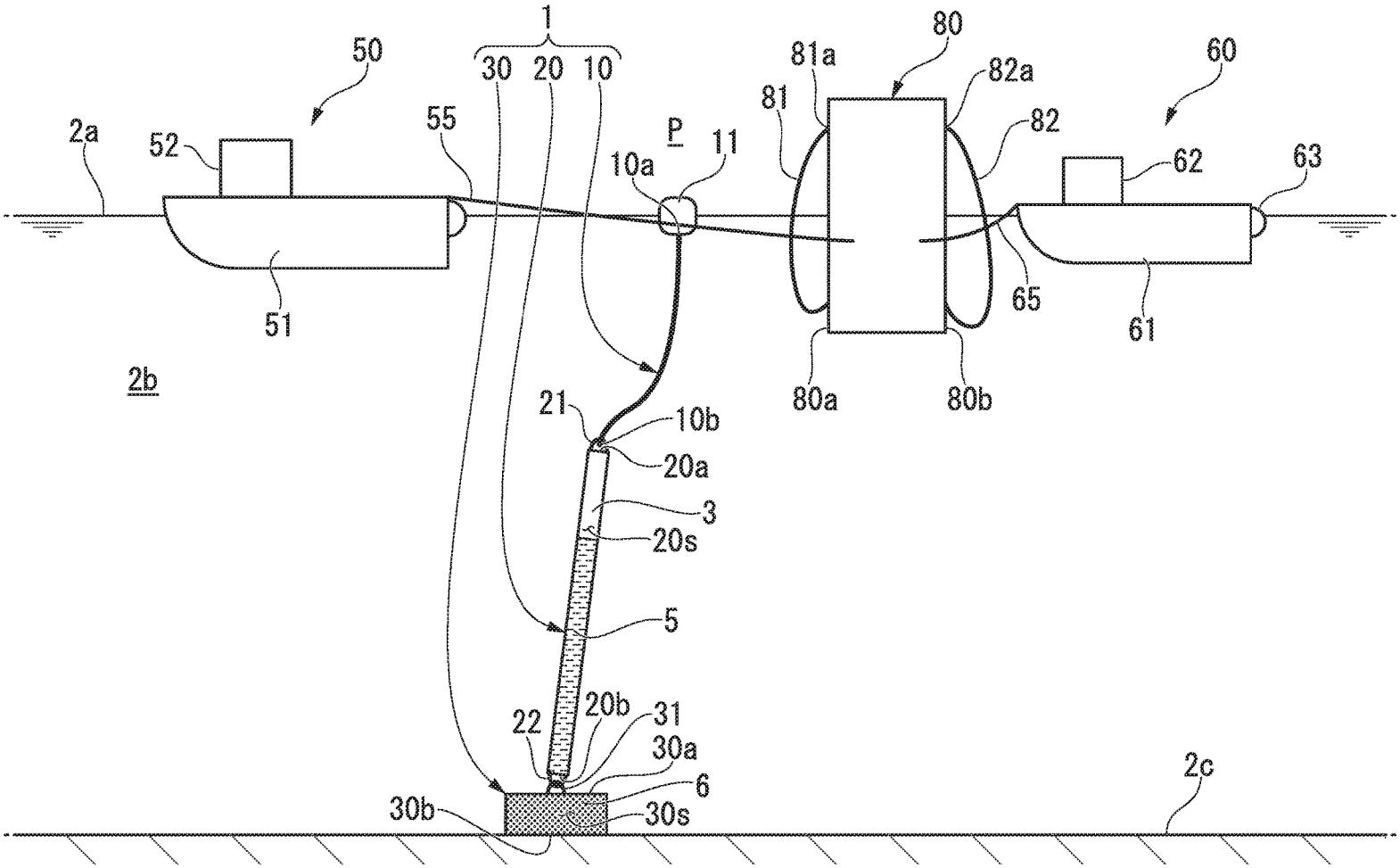
FIG. 9 is, subsequent to FIG. 8, an explanatory view of an arrival state of the float.

10*a* of the mooring cable 10 can be connected to the float 80 (refer to FIG. 9). The other end 10*b* of the mooring cable 10 is joined with the tube member 20.

The tube member 20 is a cylindrical member having an accommodation space 20*s* therein. For example, the tube member 20 is formed of a rigid member such as a steel member. At one end 20*a* of the tube member 20, a first joining portion 21 with which the other end 10*b* of the mooring cable 10 is joined is provided. At the other end 20*b* of the tube member 20, a second joining portion 22 with which the weight member 30 is joined is provided. Although not illustrated in the drawings, in the tube member 20, a hole allowing water or the like to be introduced to or discharged from the accommodation space 20*s* is formed, and closing means such as a valve for closing this hole is provided.

The weight member 30 is a rectangular member having a filling space 30*s* therein. For example, the weight member 30 is formed of a rigid member such as a steel member. On a first side surface 30*a* of the weight member 30, a hinge portion 31 with which the second joining portion 22 of the tube member 20 is joined is provided. Although not illustrated in the drawings, in the weight member 30, a hole allowing water or the like to be introduced to or discharged from the filling space 30*s* is formed, and closing means such as a valve for closing this hole is provided.

Furthermore, the shape of the weight member 30 is not limited to a rectangular shape, and a variety of shapes can be employed.

Furthermore, the second joining portion 22 can be fixed to the hinge portion 31 in a state of being joined with the hinge portion 31 and can be turned around the hinge portion 31 when released from the fixing. Therefore, it is possible to adjust the position of the tube member 20 (the slope of the tube member 20 with respect to the weight member 30) in a state in which the second joining portion 22 is joined with the hinge portion 31.

The weight member 30 is placed on a seabed 2*c* (refer to FIG. 5) so as to confine the float 80 to a mooring position P (refer to FIG. 9). The weight member 30 functions as a "sinker" which generates a resistance force using its own weight. Furthermore, instead of the weight member 30, an "anchor" which generates a resistance force (holding force) by digging claws or the like into the seabed 2*c* may be used. For example, there are pile anchors, suction anchors, and the like.

Hereinafter, a mooring method according to the present embodiment will be described with reference to FIGS. 1 to 15.

The mooring method according to the present embodiment includes a transportation step of transporting the mooring member 1 to the mooring position P (refer to FIG. 2) of the float 80, a first accommodation step of accommodating low-specific weight liquid (seawater 5, refer to FIG. 3) as a first heavy weight in a part of the accommodation space 20*s* of the tube member 20 at the mooring position P, a connection step of connecting the one end 10*a* of the mooring cable 10 to the float 80, and a second accommodation step of accommodating high-specific gravity liquid 6 (refer to FIG. 14) as a second heavy weight together with the seawater 5 in the accommodation space 20*s* of the tube member 20 filled with the seawater 5.

Furthermore, the high-specific gravity liquid 6 is liquid ballast having a higher specific weight than the seawater 5 as the low-specific weight liquid. For example, as the high-specific gravity liquid 6, drilling mud (specific weight of approximately two) may be used or a mixture of powder having a high specific weight and water or the like may be used. The value of the specific weight of the high-specific gravity liquid 6 can be appropriately set, for example, in a range higher than the specific weight of the seawater 5.

As illustrated in FIG. 1, in the transportation step of the mooring member 1, the mooring member 1 is transported in a state in which the accommodation space 20*s* of the tube member 20 and the filling space 30*s* of the weight member 30 are filled with air 3. That is, in the accommodation space 20*s* of the tube member 20 and the filling space 30*s* of the weight member 30, any heavy weights such as seawater are not accommodated.

In the transportation step, the mooring member 1 is transported by, for example, two tugboats (a main tugboat 50 and a subsidiary tugboat 60).

A boat body 51 of the main tugboat 50 is provided with a winch 59, a guide roller 53, a pump 54, and a steering portion 52.

The winch 59, the pump 54 and the steering portion 52 are sequentially placed on the boat body 51 from stern to bow thereof. The winch 59 is a facility capable of winding or paying out a rope 55. The guide roller 53 is placed at the stern of the boat body 51. The guide roller 53 guides the rope 55 being wound up or paid out using the winch 59.

One end of the rope 55 is joined with the winch 59 of the main tugboat 50, and the other end of the rope 55 is joined with the weight member 30. A predetermined amount of the rope 55 is wound around a drum of the winch 59. The main tugboat 50 tugs the rope 55 and tows the mooring member 1 with the weight member 30 in the front. In the mooring member 1, since the accommodation space 20*s* of the tube member 20 and the filling space 30*s* of the weight member 30 are filled with the air 3, the towing of the mooring member 1 is the floating and towing of the mooring member using a buoyancy force.

A boat body 61 of the subsidiary tugboat 60 is provided with a steering portion 62, an unillustrated winch, and a guide roller 63.

The guide roller 63 is placed at the stern of the boat body 61. The guide roller 63 guides the mooring cable 10 being wound up or paid out using the unillustrated winch or guides a rope 65.

The one end 10*a* of the mooring cable 10 and one end of the rope 65 are joined with the unillustrated winch of the subsidiary tugboat 60, and the other end 10*b* of the mooring cable 10 and the other end of the rope 65 are joined with the first joining portion 21 of the tube member 20. Around the drum of the winch of the subsidiary tugboat 60, a predetermined amount of the mooring cable 10 is wound, and also a predetermined amount of the rope 65 is wound. The subsidiary tugboat 60 tows the mooring member 1 behind the main tugboat 50 and helps the main tugboat 50 tow the mooring member.

The mooring member 1 is placed at the mooring position P (refer to FIG. 2) by means of towing by the main tugboat 50 and the subsidiary tugboat 60.

Figure 2:
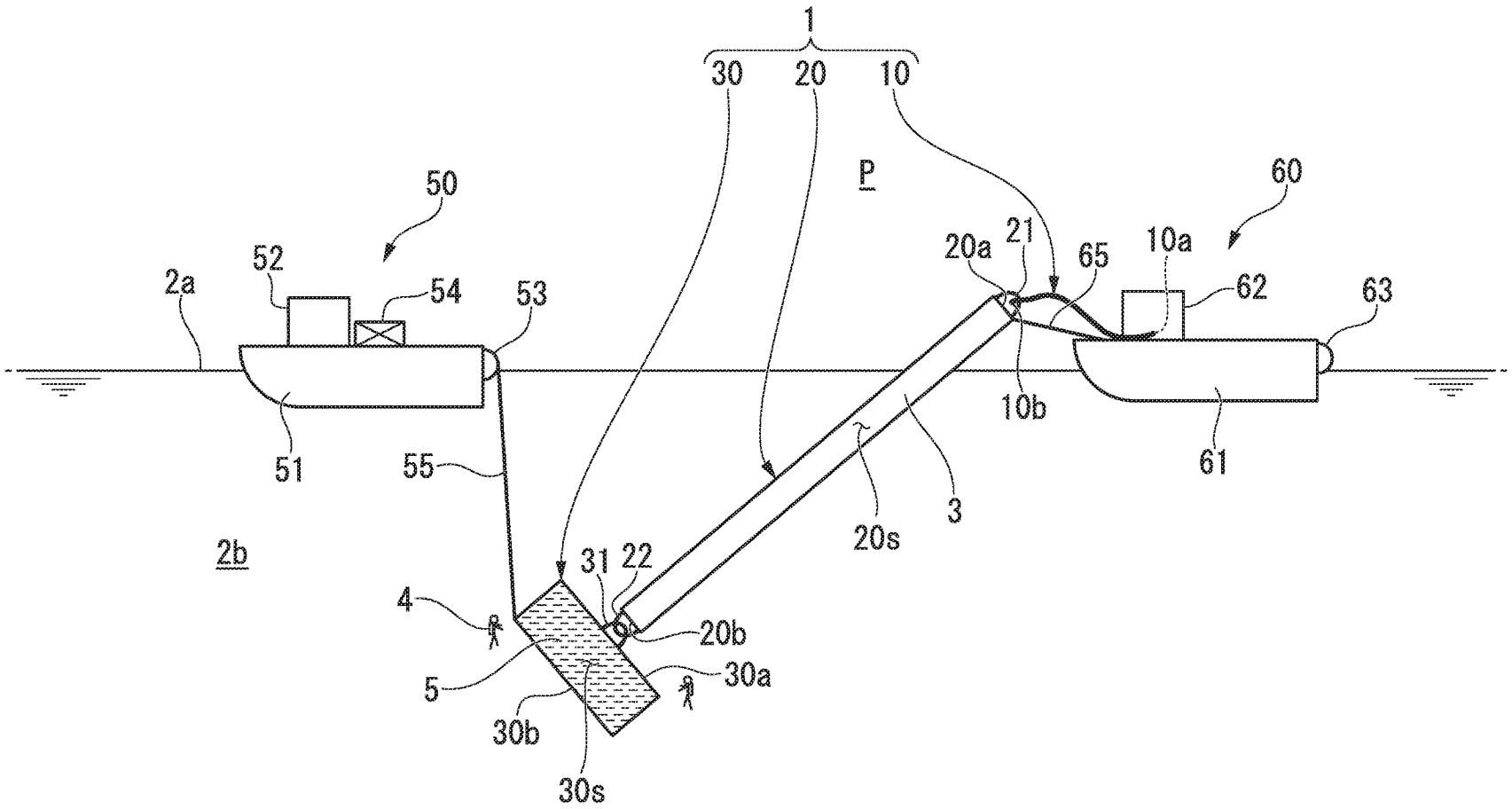
FIG. 2 is, subsequent to FIG. 1, an explanatory view of a water-introduction step to the sinker.

FIG. 2 is, subsequent to FIG. 1, an explanatory view of a water-introduction step to the sinker. In the following drawings including FIG. 2, the winch 59 will not be illustrated for convenience.

As illustrated in FIG. 2, in the water-introduction step to the sinker, the seawater 5 is introduced to the filling space 30*s* of the weight member 30 at the mooring position P. Specifically, in the water-introduction step to the sinker, at the mooring position P, a diver 4 opens an unillustrated valve of the weight member 30 and introduces the seawater 5 into the filling space 30*s* through an unillustrated hole. When the filling space 30*s* is filled with the seawater 5, and the rope 55 is paid out from the unillustrated winch, the weight member 30 gradually sinks into the sea 2*b*.

Furthermore, the unillustrated valve of the weight member 30 may be opened and closed by means of remote control using an ROV 56 (refer to FIG. 4) described below.

In FIG. 2, the tube member 20 is positioned to be inclined with respect to a sea surface 2*a* so that the first joining portion 21 is placed higher than the second joining portion 22.

Figure 3:
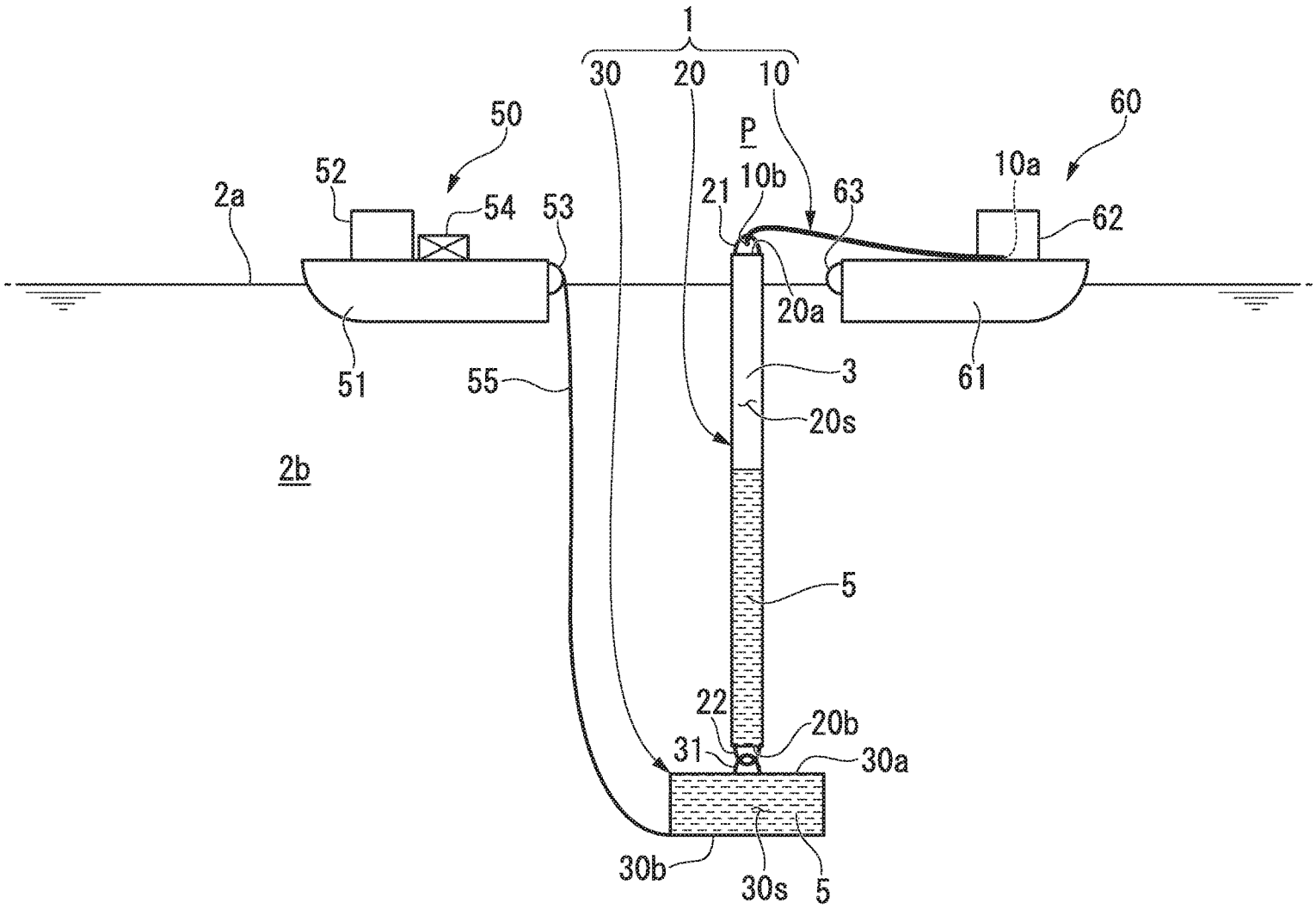
FIG. 3 is, subsequent to FIG. 2, an explanatory view of a step in which water is introduced to a tube member (that is a first accommodation step).

FIG. 3 is, subsequent to FIG. 2, an explanatory view of a water-introduction step to the tube member (first accommodation step).

As illustrated in FIG. 3, in the water-introduction step to the tube member, the seawater 5 is partially introduced as the first heavy weight to the accommodation space 20*s* of the tube member 20 at the mooring position P. Specifically, in the water-introduction step to the tube member, at the mooring position P, the diver 4 opens an unillustrated valve of the tube member 20 and introduces the seawater 5 into a part of the accommodation space 20*s* through the unillustrated hole. When the seawater 5 is accommodated in the part of the accommodation space 20*s*, and the rope 55 is paid out from the unillustrated winch, the weight member 30 sinks deeper than in the water-introduction step to the sinker.

Furthermore, in the water-introduction step to the tube member, instead of the seawater 5, a heavy weight which maintains flowability even after the water-introduction step may be used.

In FIG. 3, the tube member 20 is positioned to be substantially perpendicular to the first side surface 30*a* of the weight member 30 and be substantially perpendicular to the sea surface 2*a*.

Furthermore, in the water-introduction step to the tube member, the bow of the subsidiary tugboat 60 faces opposite to the main tugboat 50, and the stern of the subsidiary tugboat 60 faces the main tugboat 50. Also, the rope 65 is removed from the first joining portion 21 and is wound around the drum of the unillustrated winch. That is, only the mooring cable 10 is joined with the first joining portion 21.

Figure 4:
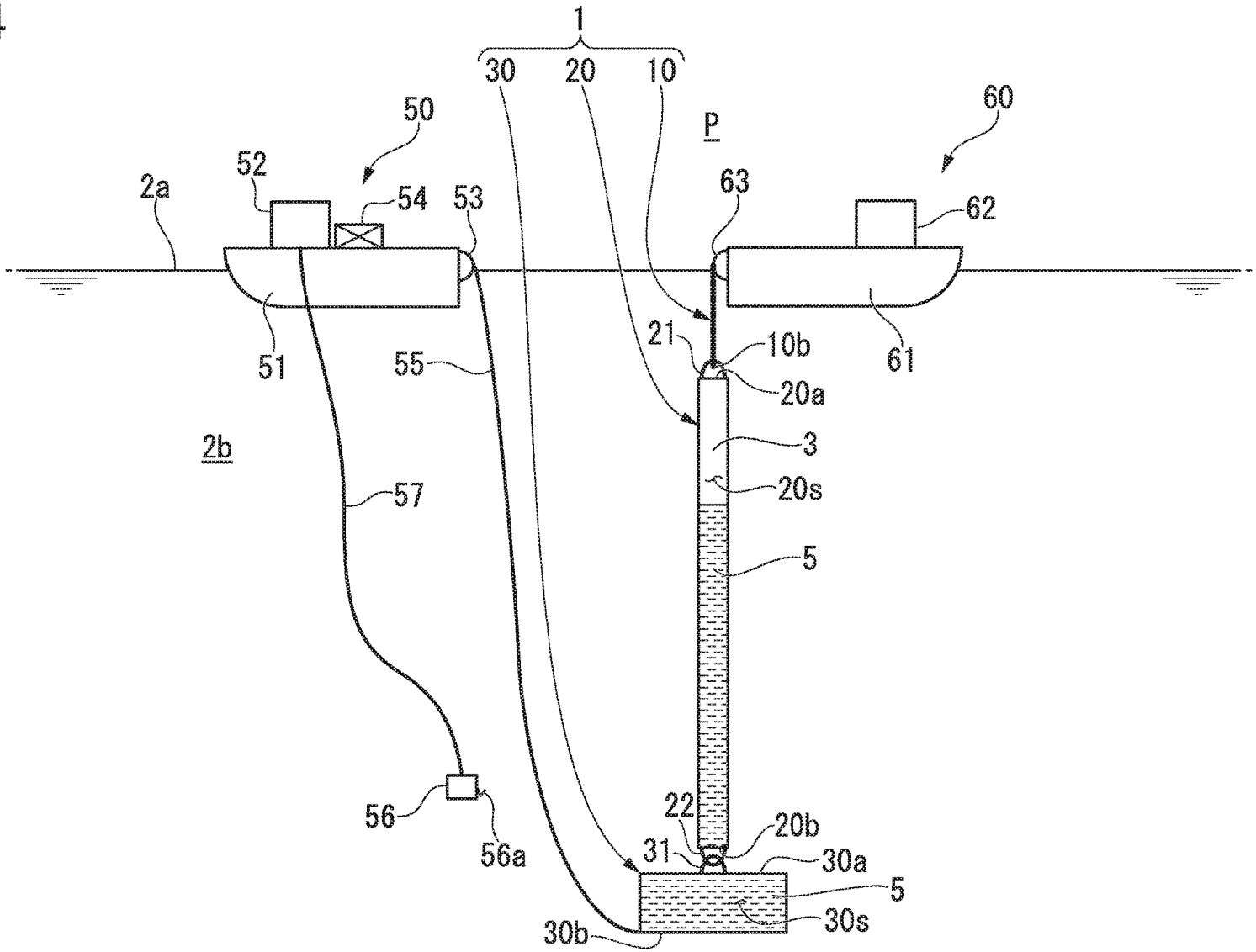
FIG. 4 is, subsequent to FIG. 3, an explanatory view of a lowering step of the mooring member.

FIG. 4 is, subsequent to FIG. 3, an explanatory view of a lowering step of the mooring member 1.

As illustrated in FIG. 4, in the lowering step, the mooring member 1 is lowered using the mooring cable 10 at the mooring position P. Specifically, in the lowering step, at the mooring position P, the mooring cable 10 is guided and paid out from the unillustrated winch of the subsidiary tugboat 60 using the guide roller 63, and the rope 65 is also paid out from the unillustrated winch at the same time as the paying out of the mooring cable 10 from the unillustrated winch. In the lowering step, the seawater 5 is continuously introduced to the part of the accommodation space 20*s*. Therefore, the weight member 30 keeps sinking deeper than in the water-introduction step to the tube member.

In FIG. 4, the tube member 20 sinks into the sea 2*b* and is positioned to be substantially perpendicular to the first side surface 30*a* of the weight member 30 and be substantially perpendicular to the sea surface 2*a*.

In the lowering step, the remotely operated vehicle (ROV) 56 is sent into the sea 2*b* from the main tugboat 50 via a cable 57. The ROV 56 is an underwater explorer operated by means of remote control. The ROV 56 includes a manipulator 56*a* and the like.

The manipulator 56*a* performs predetermined works using an operation device such as a robot arm. The ROV 56 sends image data regarding the appearance of the sinking mooring member 1 to the main tugboat 50. Furthermore, in the lowering step, after a predetermined amount of the seawater 5 is introduced to the accommodation space 20*s*, the unillustrated valve of the tube member 20 is closed using the manipulator 56*a*.

Figure 5:
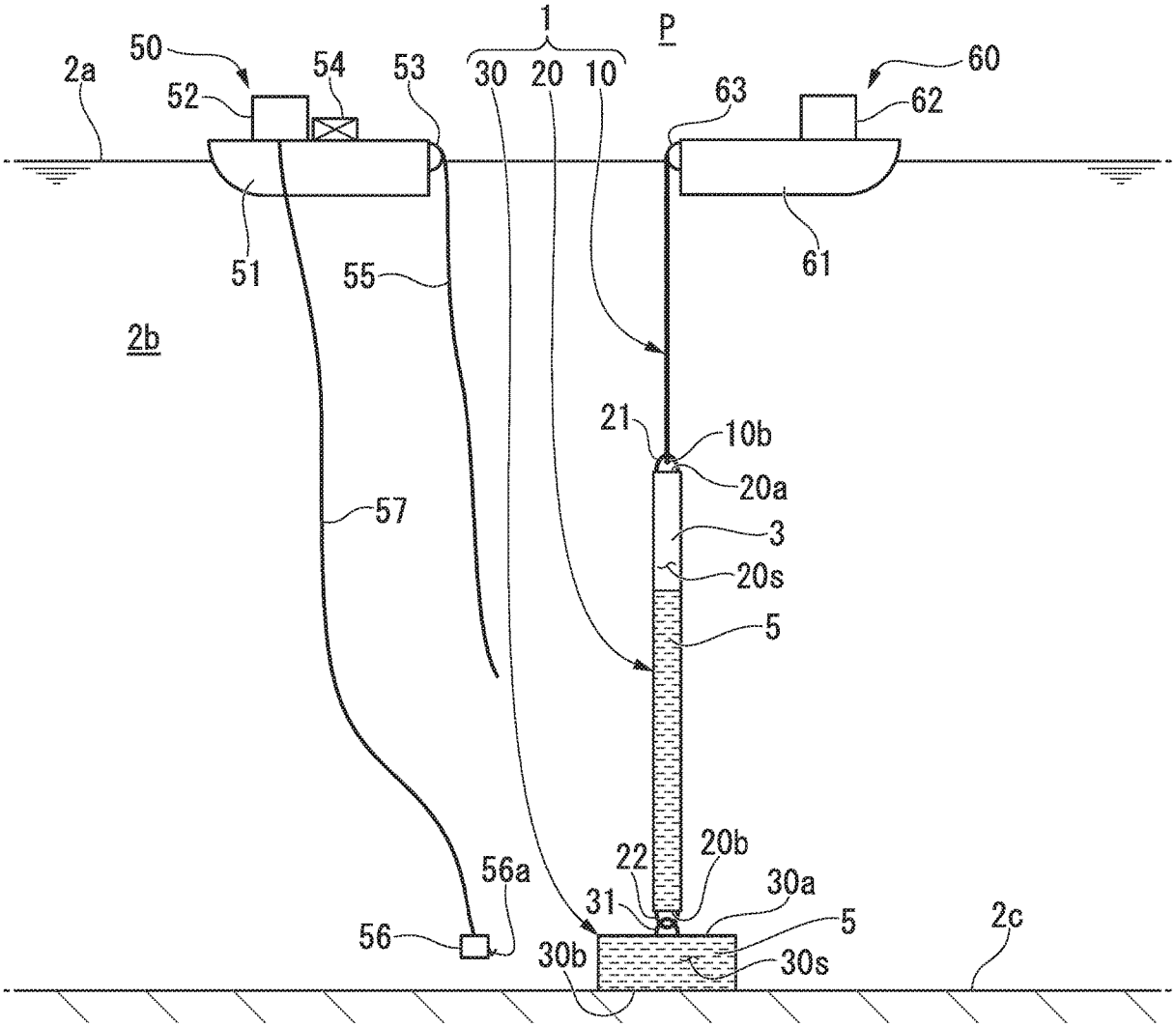
FIG. 5 is, subsequent to FIG. 4, an explanatory view of a state in which the weight member arrives on the seabed, that is, a sinker-on-the-seabed state.

FIG. 5 is, subsequent to FIG. 4, an explanatory view of a state in which the weight member 30 arrives on the seabed 2*c*, that is, a sinker-on-the-seabed state.

When the weight member 30 keeps sinking at the mooring position P due to the lowering step, as illustrated in FIG. 5, the weight member 30 arrives at the seabed 2*c*, and the sinker-on-the-seabed state is formed. In the sinker-on-the-seabed state, a second side surface 30*b* of the weight member 30 is in contact with the seabed 2*c*.

In the sinker-on-the-seabed state, the ROV 56 is placed in the vicinity of the weight member 30. The rope 55 is removed from the weight member 30 using the manipulator 56*a* and is wound up using the unillustrated winch of the main tugboat 50. Furthermore, in FIG. 5, the tube member 20 is positioned to be substantially perpendicular to the first side surface 30*a* of the weight member 30 and be substantially perpendicular to the seabed 2*c*.

Figure 6:
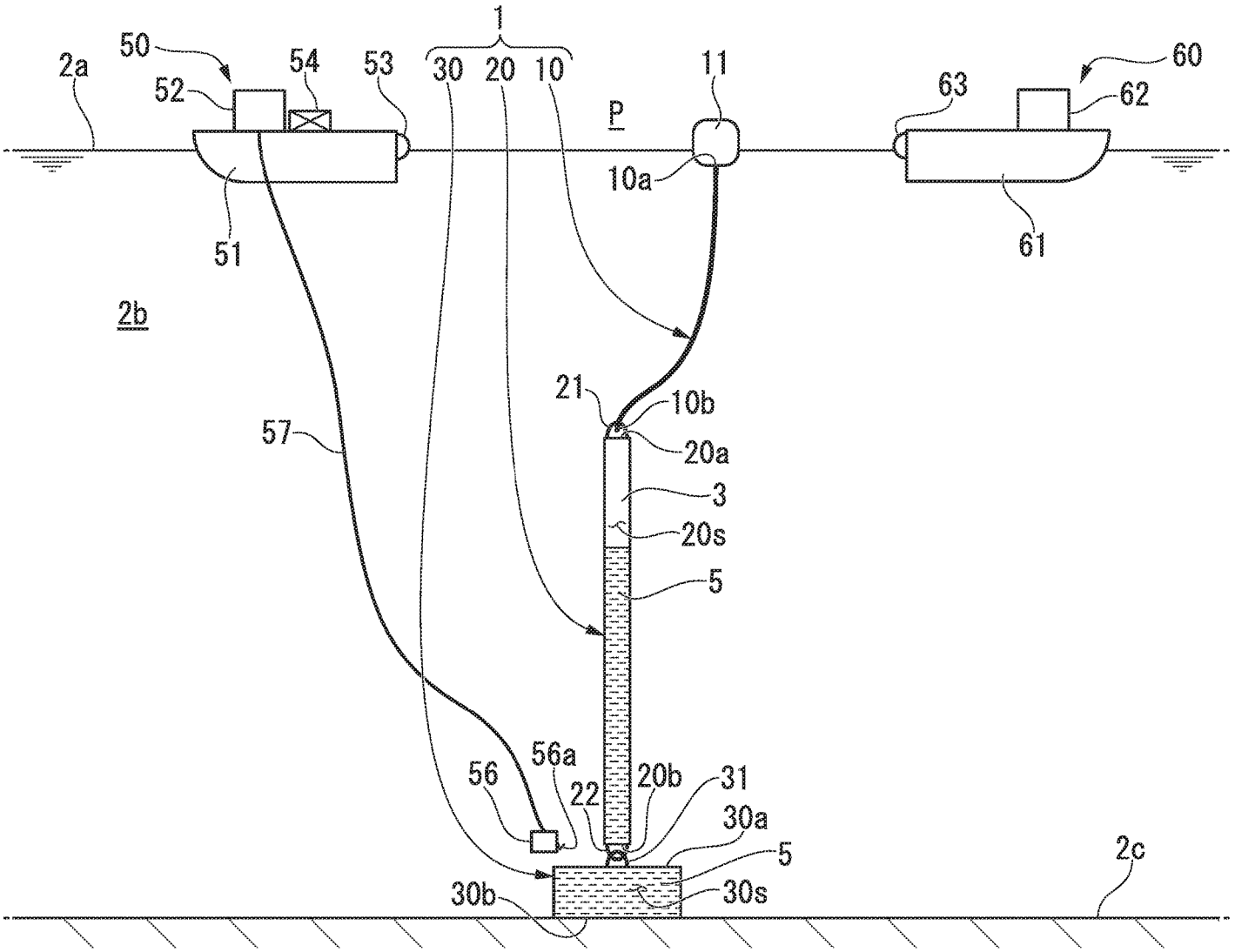
FIG. 6 is, subsequent to FIG. 5, an explanatory view of a buoy-joining step of joining a buoy with one end of the mooring cable in the mooring member.

FIG. 6 is, subsequent to FIG. 5, an explanatory view of a buoy-joining step of joining a buoy with the one end 10*a* of the mooring cable 10 in the mooring member 1. As illustrated in FIG. 6, in the buoy-joining step, a buoy 11 is detachably joined with in the one end 10*a* of the mooring cable 10, and the buoy 11 is floated on the sea surface 2*a*. When the buoy-joining step is completed, the subsidiary tugboat 60 leaves the mooring position P.

Figure 7:
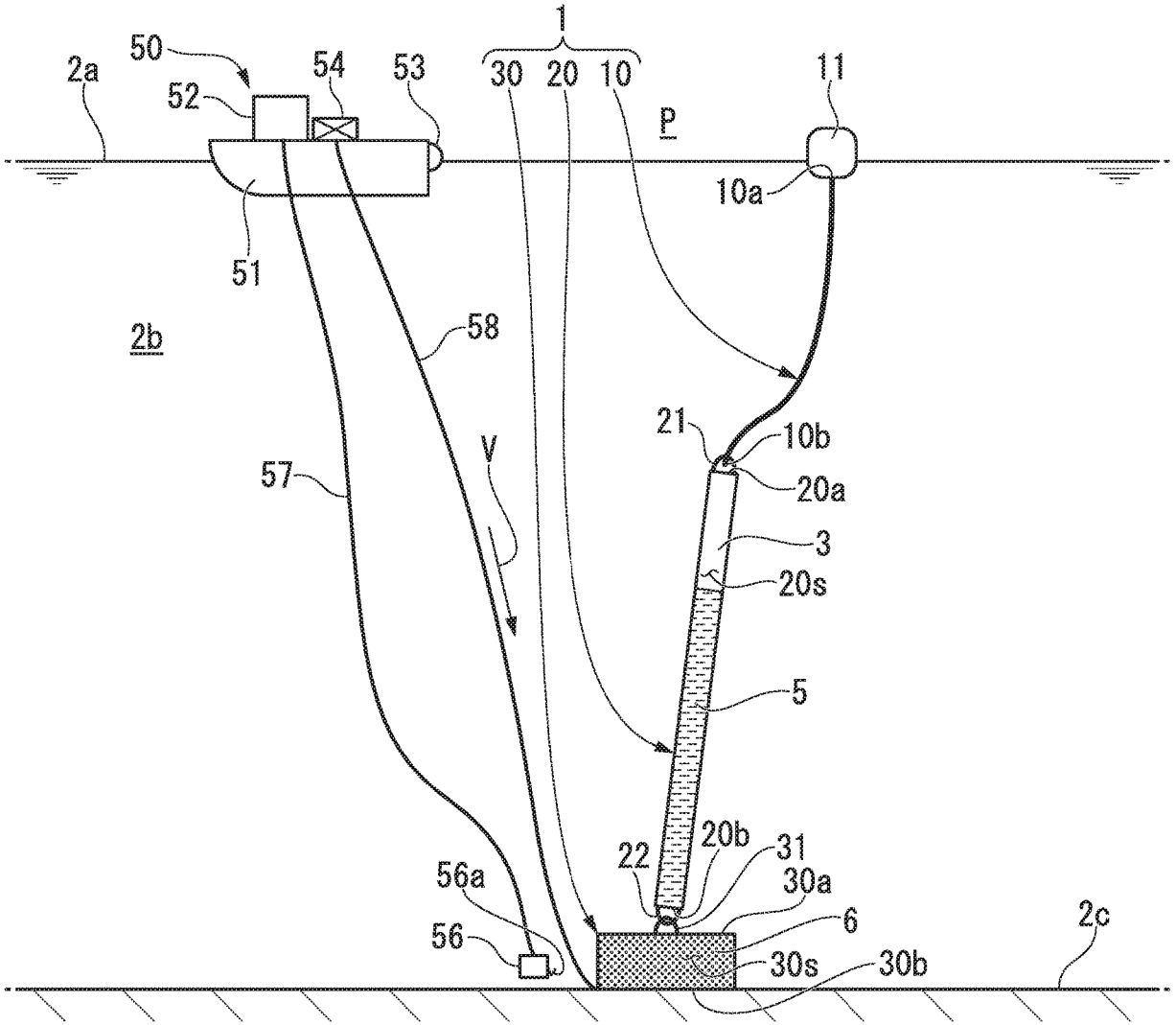
FIG. 7 is, subsequent to FIG. 6, an explanatory view of a high-specific gravity liquid introduction step into the weight member.

FIG. 7 is, subsequent to FIG. 6, an explanatory view of a high-specific gravity liquid introduction step of introducing high-specific gravity liquid to the weight member 30. In FIG. 7, the reference sign V indicates the introduction direction of high-specific gravity liquid 6.

As illustrated in FIG. 7, in the high-specific gravity liquid introduction step, the high-specific gravity liquid 6 is introduced to the filling space 30*s* of the weight member 30 at the mooring position P. Specifically, in the high-specific gravity liquid introduction step, a hose 58 is coupled to the unillustrated hole of the weight member 30, and the high-specific gravity liquid 6 is introduced to the filling space 30*s* of the weight member 30 via the hose 58 using the pump 54. When the high-specific gravity liquid 6 is introduced to the filling space 30*s*, the seawater 5 in the filling space 30*s* is appropriately discharged through the hole.

Furthermore, in the high-specific gravity liquid introduction step, as the high-specific gravity liquid 6, a heavy weight which maintains flowability even after the high-specific gravity liquid introduction step is preferably used.

In the high-specific gravity liquid introduction step, when the high-specific gravity liquid 6 is introduced to the filling space 30*s* of the weight member 30, the total weight of the weight member 30 and the substance accommodated in the weight member becomes heavier than that before the high-specific gravity liquid introduction step.

Furthermore, in FIG. 7, the tube member 20 is caused to substantially stand due to the seawater 5 accommodated in the part of the accommodation space 20*s* and the air 3 accommodated in the remaining part of the accommodation space 20*s*.

After the high-specific gravity liquid introduction step, the ROV 56 is placed in the vicinity of the weight member 30, and the hose 58 is removed from the weight member 30 using the manipulator 56*a* and is wound up using the unillustrated winch (hose-winding step). After that, the cable 57 is wound, and the ROV 56 is recovered (ROV-recovering step). When the ROV-recovering step is completed, the main tugboat 50 leaves the mooring position P.

Figure 8:
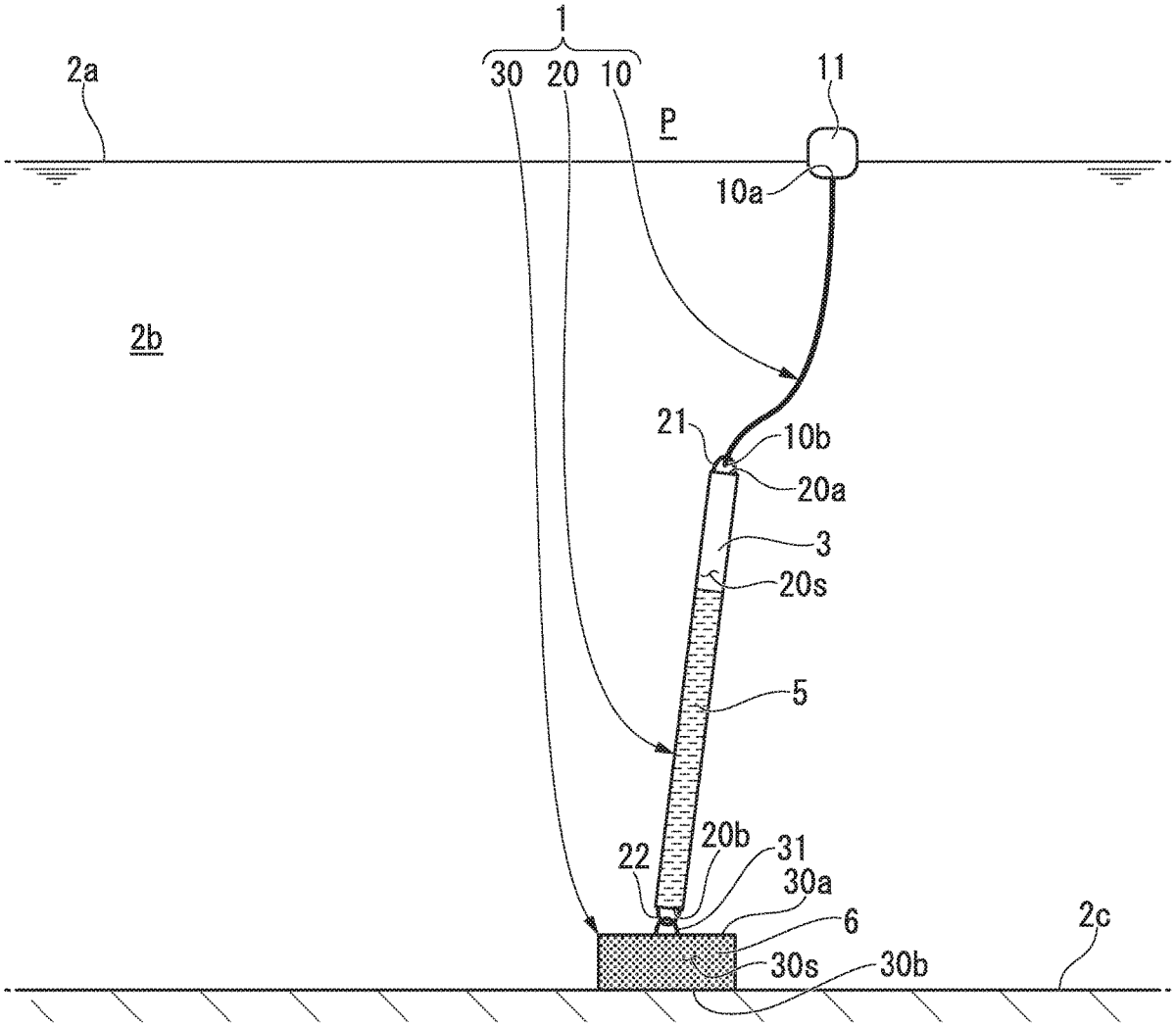
FIG. 8 is, subsequent to FIG. 7, an explanatory view of a temporary placement state of the mooring member.

FIG. 8 is, subsequent to FIG. 7, an explanatory view of a temporary placement state of the mooring member 1.

When the ROV 56 is recovered into the main tugboat 50 by means of the ROV-recovering step, as illustrated in FIG. 8, a temporary placement state in which the mooring member 1 which is to moor the float 80 (refer to FIG. 9) is temporarily placed is formed.

FIG. 9 is, subsequent to FIG. 8, an explanatory view of an arrival state of the float 80. In FIG. 9, the float 80 has a rectangular outline for convenience, but a variety of shapes can be employed as the outline of the float 80.

In the temporary placement state, for example, when the float 80 is transported to the mooring position P by two tugboats (the main tugboat 50 and the subsidiary tugboat 60), the arrival state in which the float 80 which is a mooring subject of the mooring member 1 has arrived at the mooring position P as illustrated in FIG. 9 is formed.

Furthermore, in a float transportation step of towing the float 80, one end of the rope 55 is joined with the unillustrated winch of the main tugboat 50, and the other end of the rope 55 is joined with a first side surface 80*a* of the float 80. A predetermined amount of the rope 55 from one end side of the rope 55 is wound around the drum of the unillustrated winch. The main tugboat 50 tugs the rope 55 and tows the float 80.

One end of the rope 65 is joined with the unillustrated winch of the subsidiary tugboat 60, and the other end of the rope 65 is joined with a second side surface 80*b* of the float 80. A predetermined amount of the rope 65 is wound around the drum of the winch of the subsidiary tugboat 60. The subsidiary tugboat 60 tows the float 80 behind the main tugboat 50 and helps the main tugboat 50 tow the float.

The float 80 is placed at the mooring position P by means of towing by the main tugboat 50 and the subsidiary tugboat 60.

In the arrival state, the float 80 is positioned so that the first side surface 80*a* and the second side surface 80*b* become perpendicular with respect to the sea surface 2*a*. In the arrival state, the main tugboat 50 and the subsidiary tugboat 60 stay at the mooring position P.

Tug ropes 81 and 82 of the mooring member 10 are placed in the float 80. In the float 80, an unillustrated winch capable of winding or paying out the ropes 81 and 82 is placed. One end of each of the ropes 81 and 82 is joined with the winch. One end 81*a* (first connection portion) of the rope 81 is detachably joined with the first side surface 80*a* of the float 80 in the upper portion. The other end 82*a* (second connection portion) of the rope 82 is detachably joined with the second side surface 80*b* of the float 80 in the upper portion. A predetermined amount of each of the ropes 81 and 82 is wound around the drum of the winch.

Furthermore, the intended use of the ropes 81 and 82 is not limited to the drawing of the mooring member 10. For example, the ropes 81 and 82 may be used to adjust the length of the mooring member 10 by constituting a part of the mooring member 10 with the ropes.

Figure 10:
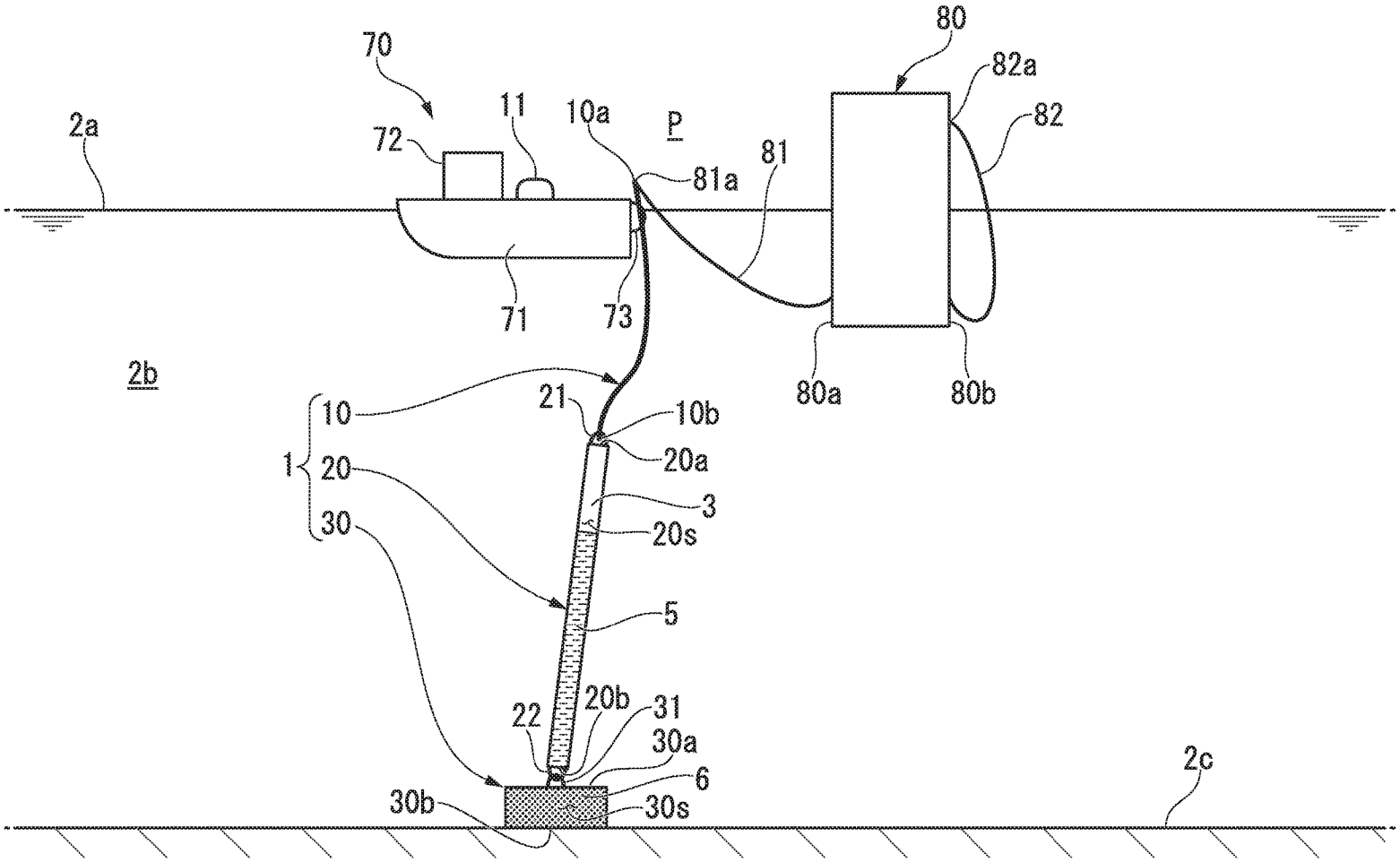
FIG. 10 is, subsequent to FIG. 9, an explanatory view of a mooring cable connection step.

FIG. 10 is, subsequent to FIG. 9, an explanatory view of a mooring cable connection step. In FIG. 10, the main tugboat 50 and the subsidiary tugboat 60 are not illustrated for convenience (also in FIGS. 11 to 14).

As illustrated in FIG. 10, in the mooring cable connection step, the one end 10*a* of the mooring cable 10 is connected to the other end 81*a* of the rope 81 which is placed in the float 80. Specifically, in the mooring cable connection step, a workboat 70 is placed at the mooring position P, and the mooring cable is connected to the rope using the workboat 70. A boat body 71 of the workboat 70 is provided with a steering portion 72, an unillustrated winch, and a guide roller 73.

In this mooring cable connection step, first, the buoy 11 is pulled up on the boat body 71 of the workboat 70. Next, the buoy 11 is removed from the one end 10*a* of the mooring cable 10. Also, the other end 81*a* of the rope 81 is detached from the float 80. In addition, the detached other end 81*a* of the rope 81 is connected to the one end 10*a* of the mooring cable 10.

Figure 11:
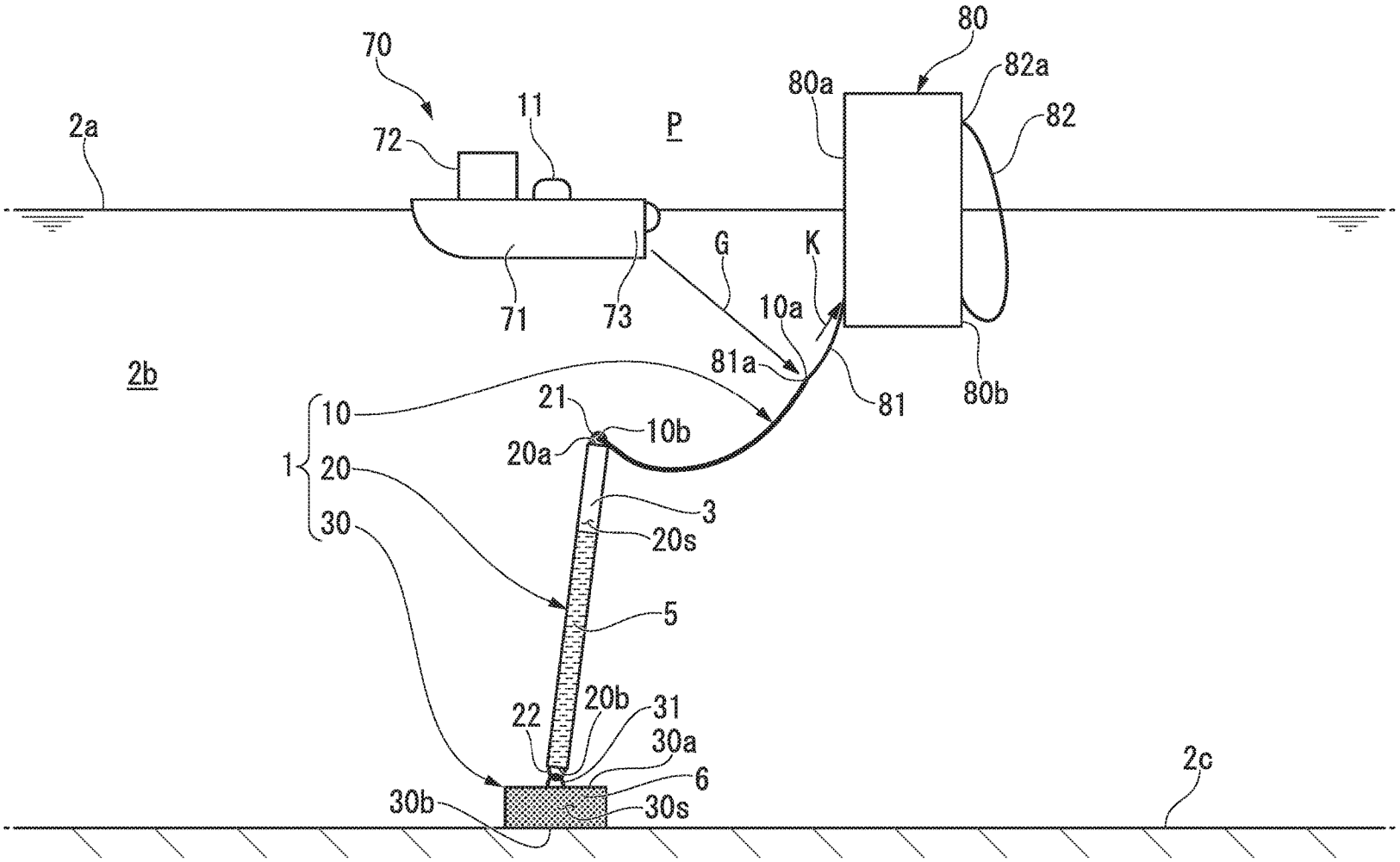
FIG. 11 is, subsequent to FIG. 10, an explanatory view of a mooring cable deployment step.

FIG. 11 is, subsequent to FIG. 10, an explanatory view of a mooring cable deployment step. In FIG. 11, the reference sign G indicates the throwing direction of the mooring cable 10, and the reference sign K indicates the winding direction of the rope 81.

As illustrated in FIG. 11, in the mooring cable deployment step, the mooring cable 10 connected to the other end 81*a* of the rope 81 is lowered into the sea 2*b* from the workboat 70 while winding the rope 81 using the unillustrated winch of the float 80. Therefore, the mooring cable 10 sinks into the sea 2*b* together with the rope 81 and is bent so as to be curved downwards between the first joining portion 21 and the lower portion of the float 80.

Figure 12:
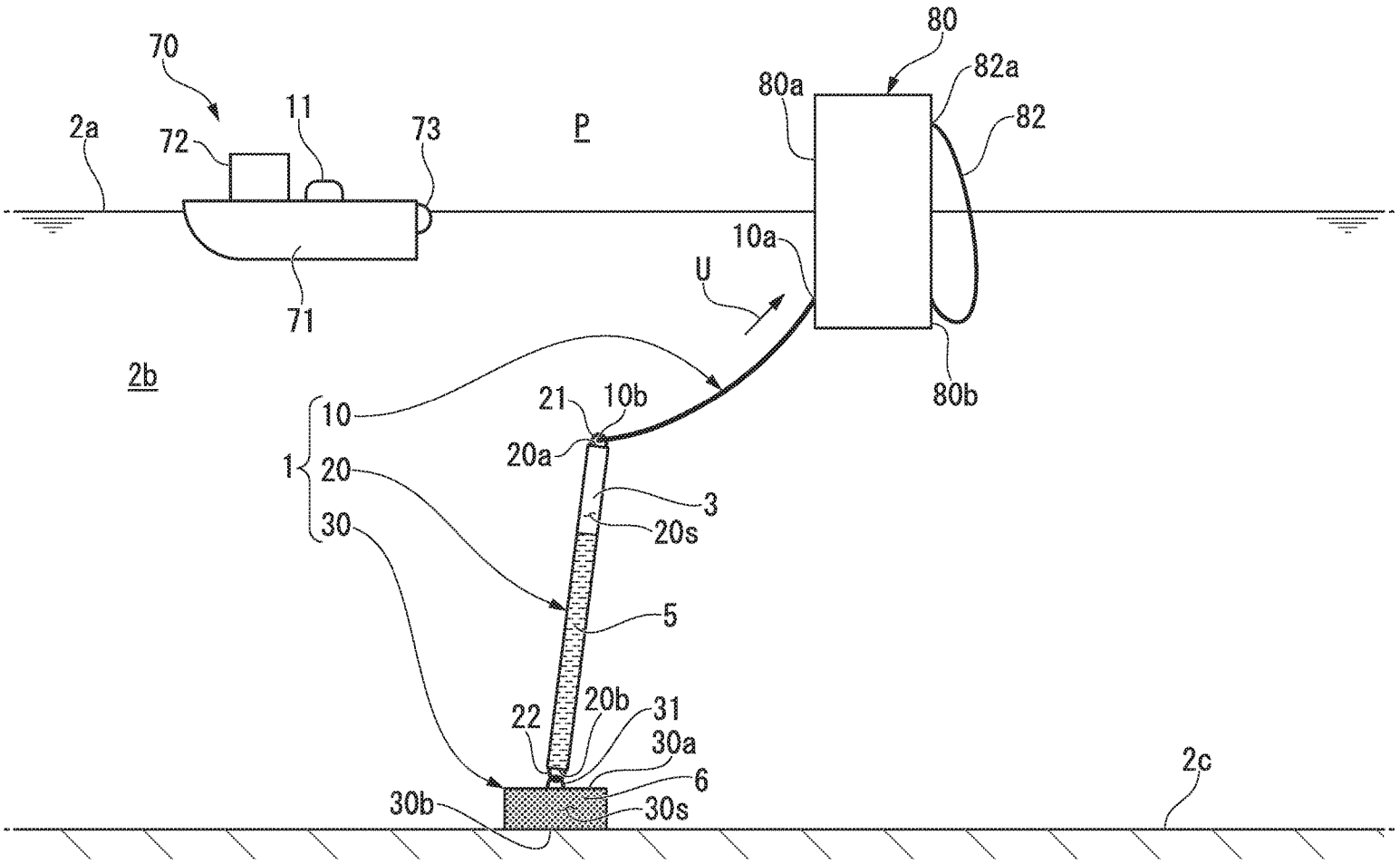
FIG. 12 is, subsequent to FIG. 11, an explanatory view of a mooring cable-lifting step.

FIG. 12 is, subsequent to FIG. 11, an explanatory view of a mooring cable-lifting step. In FIG. 12, the reference sign U indicates the lifting direction of the mooring cable 10.

As illustrated in FIG. 12, in the mooring cable-lifting step, the rope 81 connected to the one end 10*a* of the mooring cable 10 is wound. Specifically, in the mooring cable-lifting step, the rope 81 is wound up using the unillustrated winch provided in the float 80 in a state in which the other end 81*a* of the rope 81 is connected to the one end 10*a* of the mooring cable 10, and the mooring cable 10 is lifted. Therefore, the mooring cable 10 is bent so as to be slightly curved upwards toward the float 80 from the first joining portion 21 as the starting point.

Figure 13:
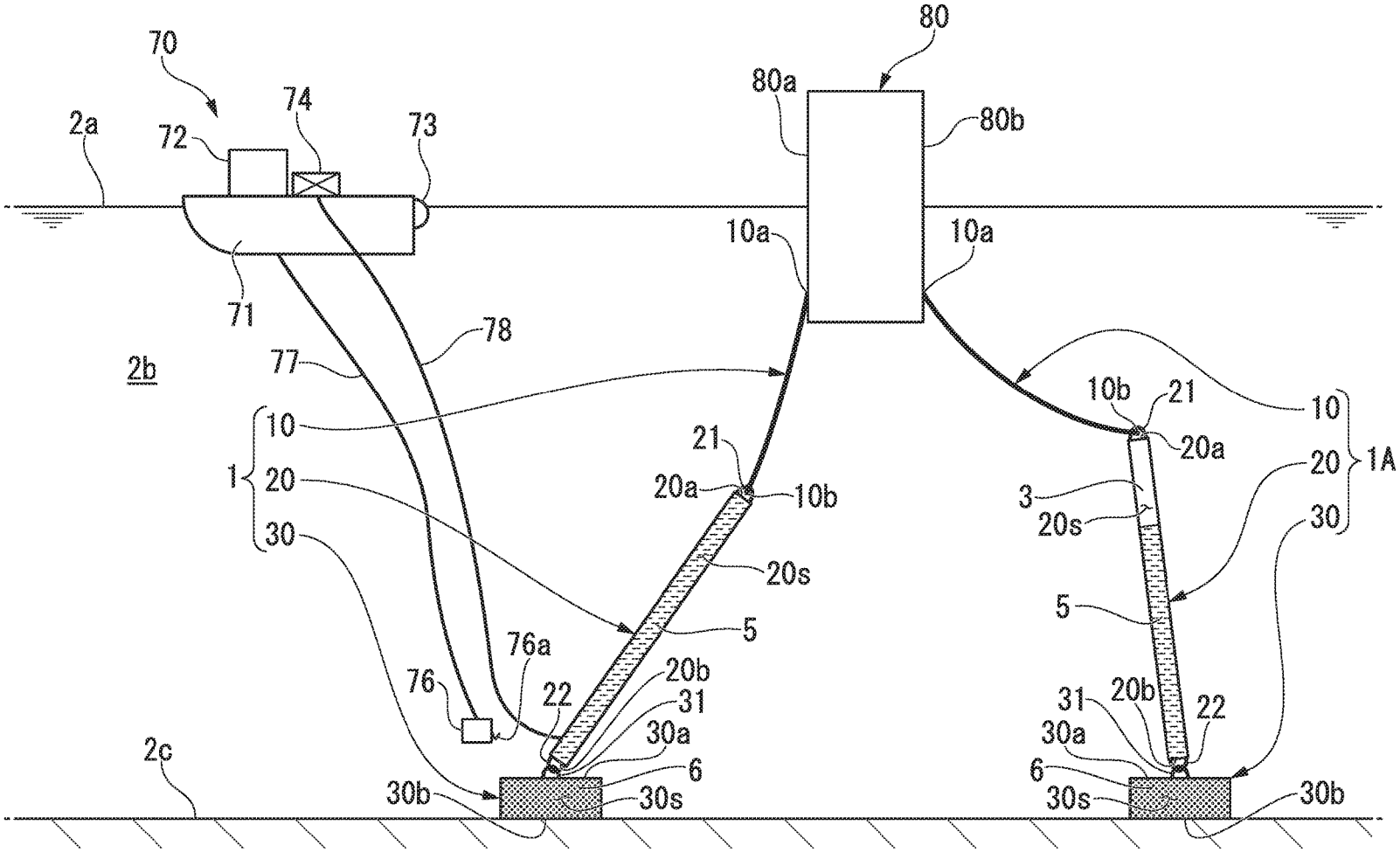
FIG. 13 is, subsequent to FIG. 12, an explanatory view of a water-introduction step and a high-specific gravity liquid introduction step (second accommodation step) of introducing the high-specific gravity liquid to the tube member.

FIG. 13 is, subsequent to FIG. 12, an explanatory view of a water-introduction step and a high-specific gravity liquid introduction step (second accommodation step) of introducing the high-specific gravity liquid to the tube member 20.

As illustrated in FIG. 13, in the water-introduction step to the tube member, the remaining part of the accommodation space 20*s* of the tube member 20 is filled with the seawater 5. Specifically, in the water-introduction step to the tube member, an ROV 76 is sent into the sea 2*b* from the workboat 70 via a cable 77, and the ROV 76 is placed in the vicinity of an unillustrated valve of the tube member 20. Next, the unillustrated valve of the tube member 20 is opened using a manipulator 76*a*, the seawater 5 is introduced to the remaining part of the accommodation space 20*s* through the unillustrated hole, and the accommodation space 20*s* is filled with the seawater 5.

In the high-specific gravity liquid introduction step, the high-specific gravity liquid 6 (refer to FIG. 14) is introduced as the second heavy weight to the accommodation space 20*s* of the tube member 20 which is filled with the seawater 5 together with the seawater 5. Specifically, in the high-specific gravity liquid introduction step, a hose 78 is coupled to the unillustrated hole of the tube member 20, and the high-specific gravity liquid 6 (refer to FIG. 14) is introduced to the accommodation space 20*s* of the tube member 20 via the hose 78 using a pump 74. When the high-specific gravity liquid 6 is introduced to the accommodation space 20*s*, the seawater 5 in the accommodation space 20*s* is appropriately discharged through the hole. That is, in the high-specific gravity liquid introduction step, the high-specific gravity liquid 6 (the second heavy weight) is accommodated in the accommodation space 20*s* of the tube member 20 by being added to the seawater 5 or being exchanged with at least part of the seawater 5.

Furthermore, an unillustrated introduction hole for the high-specific gravity liquid 6 and the like is placed on the lower side of the tube member 20, and a discharge hole (not illustrated) for the seawater 5 and the like is placed on the upper side of the tube member 20.

Also, in the high-specific gravity liquid introduction step, as the high-specific gravity liquid 6, a heavy weight which maintains flowability even after the high-specific gravity liquid introduction step is preferably used.

In the high-specific gravity liquid introduction step, when the high-specific gravity liquid 6 is introduced to the accommodation space 20*s* of the tube member 20, the total weight of the tube member 20 and the substance accommodated in the tube member becomes heavier than that before the high-specific gravity liquid introduction step.

Furthermore, in FIG. 13, the tube member 20 is positioned to be inclined so that the tube member collapses toward the first side surface 30*a* of the weight member 30 more than before the high-specific gravity liquid introduction step and thus the first joining portion 21 is closer to the float 80 than the second joining portion 22 (rightwards in FIG. 13). Therefore, the mooring cable 10 is imparted with a predetermined tensile force.

A mooring member 1A (second mooring member) is connected to the second side surface 80*b* of the float 80. The mooring member 1A is connected to the second side surface in the same manner as in the mooring cable connection step of the mooring member 1 (first mooring member). A mooring cable 10 in the mooring member 1A is bent so as to be slightly curved upwards toward the float 80 from the first joining portion 21 as the starting point.

Furthermore, the mooring cable deployment step, the mooring cable-lifting step, the water-introduction step, and the high-specific gravity liquid introduction step are performed on the mooring member 1A in the same manner as on the mooring member 1. A tube member 20 in the mooring member 1A is positioned to be inclined with respect to a first side surface 30*a* of a weight member 30 so that the first joining portion 21 is closer to the float 80 than the second joining portion 22 (leftwards in FIG. 14).

Furthermore, in FIG. 13, two mooring members 1 and 1A are illustrated, but the number of mooring members installed is not limited to two and may be three or more (multiple).

Figure 14:
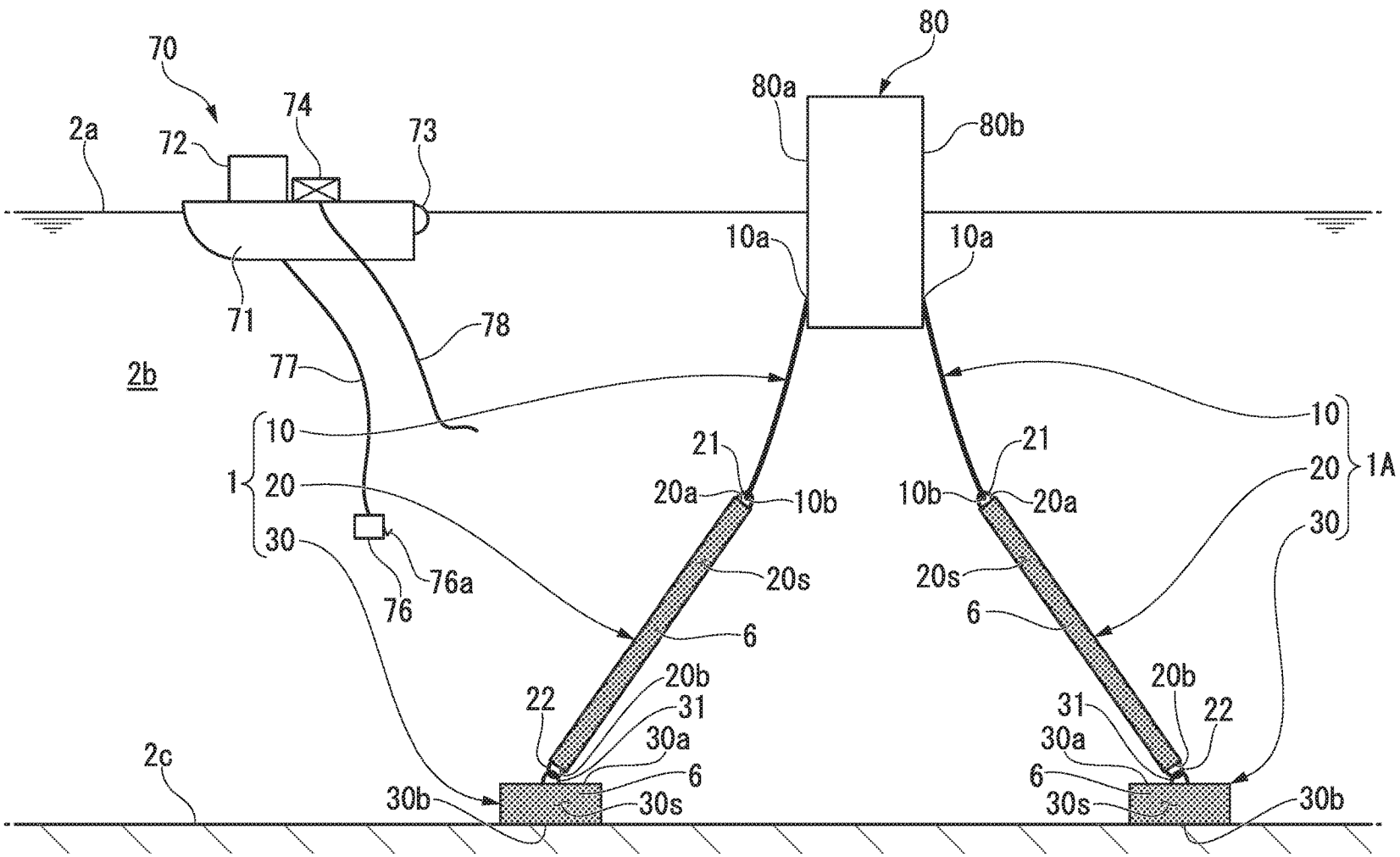
FIG. 14 is, subsequent to FIG. 13, an explanatory view of a hose-winding step and an ROV-recovering step.

FIG. 14 is, subsequent to FIG. 13, an explanatory view of a hose-winding step and an ROV-recovering step.

As illustrated in FIG. 14, in the hose-winding step, the ROV 76 is placed in the vicinity of the tube member 20, the hose 78 is removed from the tube member 20 using the manipulator 76*a* and is wound up using the unillustrated winch of the workboat 70. In the ROV-recovering step, after the hose-winding step, the cable 77 is wound up using the winch of the workboat 70, and the ROV 76 is recovered. When the ROV-recovering step is completed, the workboat 70 leaves the mooring position P. Also, although not illustrated, the main tugboat 50 and the subsidiary tugboat 60 also leave the mooring position P.

Figure 15:
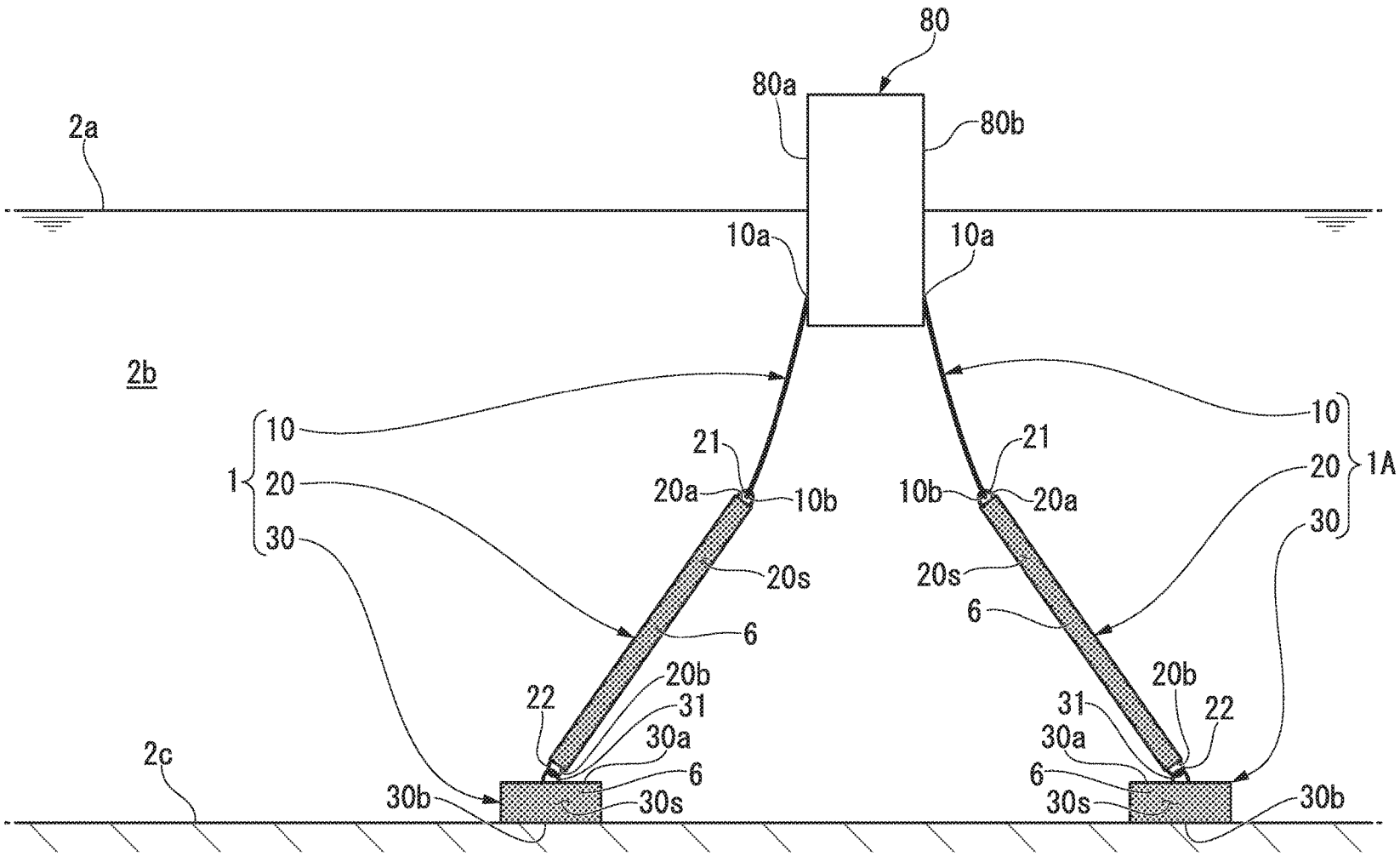
FIG. 15 is, subsequent to FIG. 14, an explanatory view of a mooring state of the float.

FIG. 15 is, subsequent to FIG. 14, an explanatory view of a mooring state of the float 80.

When the above-described steps are performed, a mooring state in which the float 80 is moored using the mooring members 1 and 1A as illustrated in FIG. 15 is formed. In the mooring state, since a certain tensile force acts on the mooring cables 10 in the respective mooring members 1 and 1A, the float 80 is stably placed at the mooring position P.

As described above, the embodiment shows a mooring method for mooring the float 80 offshore through the mooring member 1, the method includes a transportation step of transporting the mooring member 1 having the mooring cable 10 which can be connected to the float 80 at the one end 10*a* and the tube member 20 which is joined with the other end 10*b* of the mooring cable 10 and has the accommodation space 20*s* therein to the mooring position P of the float 80, a water-introduction step to the tube member (first accommodation step) of introducing the seawater 5 (first heavy weight) to a part of the accommodation space 20*s* of the tube member 20 at the mooring position P, a connection step of connecting the one end 10*a* of the mooring cable 10 to the float 80 at the mooring position P after the water-introduction step to the tube member, and a high-specific gravity liquid introduction step (second accommodation step) of accommodating the high-specific gravity liquid 6 (second heavy weight) in the accommodation space 20*s* of the tube member 20 by adding the high-specific gravity liquid to the seawater 5 or exchanging at least part of the seawater 5 with the high-specific gravity liquid at the mooring position P after the connection step.

According to this method, since the high-specific gravity liquid 6 is accommodated in the accommodation space 20*s* of the tube member 20 by adding the high-specific gravity liquid to the seawater 5 or exchanging at least part of the seawater 5 with the high-specific gravity liquid at the mooring position P in the high-specific gravity liquid introduction step after the connection step, before the high-specific gravity liquid introduction step, the mooring cable 10 can be easily connected to the float 80, and, after the high-specific gravity liquid introduction step, the specific weight of the tube member 20 can also be increased in the same manner as that of the weight member 30. Therefore, it is possible to easily moor the float 80.

Also, in the embodiment, since the mooring member 1 is transported in a state in which the accommodation space 20*s* of the tube member 20 is filled with the air 3 in the transportation step, compared with a case in which a heavy weight is included in the accommodation space 20*s* of the tube member 20, the weight of the tube member 20 is decreased. Therefore, it is possible to easily transport the mooring member 1.

In a case in which a float is moored in a water area, it can be also considered that a heavy weight is accommodated in advance in an accommodation space of a mooring member which has been manufactured onshore and the mooring member is transported to a mooring position. However, in this case, the heavy weight is accommodated in the accommodation space of the mooring member, and thus the floating and towing of the accommodation member becomes difficult. In contrast, according to this method, since the accommodation space 20*s* of the tube member 20 is filled with the air 3, the floating and towing of the tube member 20 becomes easy. Therefore, it is possible to easily perform the floating and towing of the mooring member 1.

As the first heavy weight and the second heavy weight, use of solid substances such as broken stones can be considered. However, in this case, for the transportation of broken stones, an equipment such as a grab bucket excavator is required, and there is a possibility of a long time being taken to transport the broken stones. In contrast, in the embodiment, the first heavy weight and the second heavy weight are the seawater 5 having flowability, and thus the equipment such as the grab bucket excavator is not required, and it does not take a long time to transport the heavy weights. Therefore, it is possible to easily accommodate heavy weights in the accommodation space 20*s* of the tube member 20 in the water-introduction step and the high-specific gravity liquid introduction step.

Also, in the embodiment, when the weight member 30 which is joined with the other end 10*b* of the mooring cable 10, is placed on the seabed 2*c*, and has the filling space 30*s* therein is used as the mooring member 1, it is possible to easily fill the weight member 30 with the heavy weight.

Also, since the mooring member 1 is transported in a state in which the filling space 30*s* of the weight member 30 is filled with the air 3 in the transportation step, compared with a case in which a heavy weight is included in the filling space 30*s* of the weight member 30, the weight of the weight member 30 is decreased. Therefore, it is possible to easily transport the mooring member 1. Also, since the filling space 30*s* of the weight member 30 is filled with the air 3, the floating and towing of the weight member 30 becomes easy. Therefore, it is possible to easily perform the floating and towing of the mooring member 1.

Also, in the embodiment, since the buoy-joining step of joining the buoy 11 with the one end 10*a* of the mooring cable 10 and floating the buoy on the sea surface 2*a* is provided before the connection step, it is possible to suppress the one end 10*a* of the mooring cable 10 sinking into the sea 2*b* and easily connect the one end 10*a* of the mooring cable 10 to the float 80.

Furthermore, in the present embodiment, since the seawater 5 is accommodated in a part of the accommodation space 20*s* of the tube member 20, it is possible to reduce the size of the buoy 11 while suppressing the one end 10*a* of the mooring cable 10 sinking into the sea 2*b*.

If a sufficient buoyant force is imparted by increasing the size of the buoy 11, it is possible to suppress the one end 10*a* of the mooring cable 10 sinking into the sea 2*b* even when the accommodation space 20*s* of the tube member 20 is fully filled with the seawater 5.

Also, in the embodiment, since the tube member 20 which is joined with the other end 10*b* of the mooring cable 10 is used as the accommodation member, it is possible to easily moor the float 80 using a simple constitution.

Also, it is possible to easily adjust the weight of the accommodation member and the tensile force of the mooring cable by adjusting the kind, specific weight, and weight of the heavy weight that is accommodated in the tube member 20, the volume ratio between the heavy weight and air, and the like.

Also, in the embodiment, since the mooring member 1 which is connected to the rope 81 of the float 80 and the mooring member 1A which is connected to the rope 82 that is placed at a different location from the rope 81 in the float 80 are used as the mooring members, it is possible to individually adjust the weights of the heavy weights for the respective mooring members 1 and 1A and cause tensile forces suitable for the respective mooring members 1 and 1A to be exerted without varying the mooring cables 10 and the tube members 20. Therefore, compared with a case in which the tensile force is adjusted by varying the length of the mooring cable 10, it is possible to easily adjust the tensile force of the mooring cable 10.

Also, when only the kinds (specific weights) and amounts of the heavy weights are changed in the respective mooring members 1 and 1A, it is possible to individually impart a variety of characteristics to the respective mooring members 1 and 1A even when the mooring cables 10 and the tube members 20 are the same as each other in the respective mooring members 1 and 1A.

Also, in a case in which multiple (for example, three) mooring members 1 are placed, when one of the three mooring members is replaced in the recovering step or the like, it is possible to make the remaining two mooring members appropriately heavy, and the recovering work becomes easy.

Also, the embodiment is the mooring member 1 that moors the float 80 offshore, including the mooring cable 10 which can be connected to the float 80 at the one end 10*a* and the tube member 20 which is joined with the other end 10*b* of the mooring cable 10 and has the accommodation space 20*s* therein, in which a heavy weight having flowability (at least one of the seawater 5 and the high-specific gravity liquid 6) is accommodated in the accommodation space 20*s* of the tube member 20.

As the heavy weight, use of solid substances such as broken stones or solidified materials such as concrete can be also considered. However, in a case in which broken stones are used, the equipment such as the grab bucket excavator are required to remove broken stones from the accommodation space 20*s*, and there is a possibility of a long time being taken to remove the broken stones. In a case in which concrete is used, since concrete is solidified after being accommodated, although maintaining flowability while being accommodated, there is a possibility of a long time being taken to remove the solidified concrete from the accommodation space 20*s*. In contrast, according to this constitution, the heavy weights (at least one of the seawater 5 and the high-specific gravity liquid 6) have flowability, and thus the equipment such as the grab bucket excavator is not required, and it does not take a long time to remove the heavy weights. Therefore, it is possible to easily accommodate and recover the heavy weights.

Also, when the heavy weight is removed from the tube member 20, that is, the accommodation space 20*s* of the tube member 20 is filled with air, the weight of the tube member 20 is decreased. Therefore, it is possible to easily transport the mooring member 1.

Also, when the accommodation space 20*s* of the tube member 20 is filled with the air 3, the floating and towing of the tube member 20 becomes easy. Therefore, it is possible to easily perform the floating and towing of the mooring member 1.

Furthermore, the accommodation space 20*s* can be filled with the air 3 by (1) feeding compressed air into the accommodation space 20*s* so as to discharge the heavy weight, (2) suctioning the heavy weight so as to let the air naturally enter the accommodation space, or (3) performing both (1) and (2).

Furthermore, in the embodiment, the recovering step of recovering the tube member 20 from a working water area by discharging the seawater 5 from the accommodation space 20*s* of the tube member 20 at the mooring position P may be further provided after the water-introduction step to the tube member. In this recovering step, opposite to the water-introduction step, the seawater 5 is discharged from the accommodation space 20*s* of the tube member 20, the tube member 20 is floated due to the decreased weight of the tube member, and the tube member 20 is recovered from the working water area by the workboat 70 or the like.

According to this method, since it is possible to easily decrease the weight of the tube member 20, it is possible to easily recover the mooring member 1.

Also, in the embodiment, in the high-specific gravity liquid introduction step as the second accommodation step, an example of the high-specific gravity liquid 6 being used as the second heavy weight has been described, but the second heavy weight is not limited thereto.

For example, in the water-introduction step as the second accommodation step, as the second heavy weight, the seawater 5 which is the same as the first heavy weight in the water-introduction step to the tube member may also be used.

Therefore, compared with a case in which different heavy weights are used in the respective steps, it is possible to easily recover the second heavy weight in the water-introduction step as the second accommodation step.

Furthermore, in this case, when the seawater 5 offshore is used as the first heavy weight and the second heavy weight, compared with a case in which water which is different from the seawater 5 offshore is prepared as a heavy weight, it is possible to easily recover the heavy weights in the water-introduction step and the water-introduction step. Also, since it is not necessary to separately prepare water as the heavy weight, no costs are required for the transportation of the heavy weight.

Also, in the embodiment, an example in which the seawater is used as the first heavy weight in the first accommodation step and the high-specific gravity liquid is used as the second heavy weight in the second accommodation step has been described, but the heavy weights are not limited thereto. For example, it is possible to use high-specific gravity liquid as the first heavy weight in the first accommodation step and use the same high-specific gravity liquid as the first heavy weight as the second heavy weight in the second accommodation step. In this case, it is possible to perform no work or management for substituting the first heavy weight and the second heavy weight by simply adding the same heavy weight as in the first accommodation step in the second accommodation step, and, compared with a case in which different heavy weights are used in the respective steps, it is possible to easily accommodate the second heavy weight in the second accommodation step.

Also, in the embodiment, the installation order of the mooring member has been described, however it becomes possible to recover the mooring member by discharging the heavy weights in an order approximately opposite to the installation order of the mooring member. That is, in the embodiment, the mooring method for the mooring member 1 has been described, but the recovering method according to the present invention may be applied after the installation of the mooring member 1.

A method of recovering the mooring member 1 according to the first embodiment of the present invention includes a first step of removing the heavy weight from the accommodation space 20*s* of the tube member 20 and a second step of recovering the tube member 20 from a working water area after the first step.

According to this method, since the tube member 20 is recovered from the working water area in the second step after the heavy weight is removed from the tube member 20 in the first step, it is possible to easily recover the tube member 20, and it becomes possible to reuse the tube member 20.

Specifically, the recovering method can be performed in the following order.

First, the mooring cable 10 is detached from the float 80 (detachment step). Next, an unillustrated hole at the lower end of the tube member 20 and the pump 74 on the workboat 70 are connected to each other using the hose 78, and the other unillustrated hole at the upper end of the tube member 20 and an unillustrated compressor on the workboat 70 are connected to each other using another unillustrated hose (accommodation member and hose connection step). Next, the heavy weight (not illustrated, at least one of the seawater 5 and the high-specific gravity liquid 6) is discharged from the accommodation space 20*s* using the pump 74 while sending compressed air to the accommodation space 20*s* of the tube member 20 from the compressor and is recovered into an unillustrated tank on the workboat 70. Therefore, the heavy weight in the accommodation space 20*s* of the tube member 20 is substituted with air, and the weight of the tube member 20 in the water is decreased.

Similarly, an unillustrated hole at the lower end of the weight member 30 and the pump 74 on the workboat 70 are connected to each other using the hose 78, and the other unillustrated hole at the upper end of the weight member 30 and the unillustrated compressor on the workboat 70 are connected to each other using another unillustrated hose (weight member and hose connection step). Next, the heavy weight (at least one of the seawater 5 and the high-specific gravity liquid 6) is recovered into the unillustrated tank on the workboat 70 using the pump 74 while sending compressed air to the filling space 30*s* of the weight member 30 from the compressor. Therefore, the heavy weight in the filling space 30*s* of the weight member 30 is substituted with air, and the weight of the weight member 30 in the water is decreased.

Therefore, the tube member 20 and the weight member 30 can be raised using the unillustrated winch or the like. When a sufficient amount of air is sent to the accommodation space 20*s* of the tube member 20 and the filling space 30*s* of the weight member 30, it is possible to sufficiently decrease the amounts of the tube member 20 and the weight member 30 in the water and float the tube member 20 and the weight member 30 onto the sea surface. After the tube member 20 and the weight member 30 are floated near the sea surface or on the sea surface, the mooring member 1 is towed by tugboats and is transported to harbors.

Furthermore, when the heavy weight is removed from the accommodation space 20*s* of the tube member 20 and the filling space 30*s* of the weight member 30, it is also possible to remove the heavy weight while letting nearby seawater instead of compressed air naturally enter the spaces. In this case, it is not possible to float the tube member 20 and the weight member 30 as in a case in which air is supplied; however, compared with a case in which the tube member and the weight member are filled with heavy weights, it is possible to decrease the weights of the tube member 20 and the weight member 30 in the water and easily raise the tube member 20 and the weight member 30.

Also, even accommodation members having a different shape from that of the tube member such as variant members and the like in the following embodiments can be recovered in the same order as that in the above-described recovering method.

Second Embodiment

Next, a second embodiment of the present invention will be described with reference to FIGS. 16 to 31. Furthermore, in the second embodiment, the same portions as the constitutional elements in the first embodiment will be given the same reference sign and will not be described.

Figure 16:
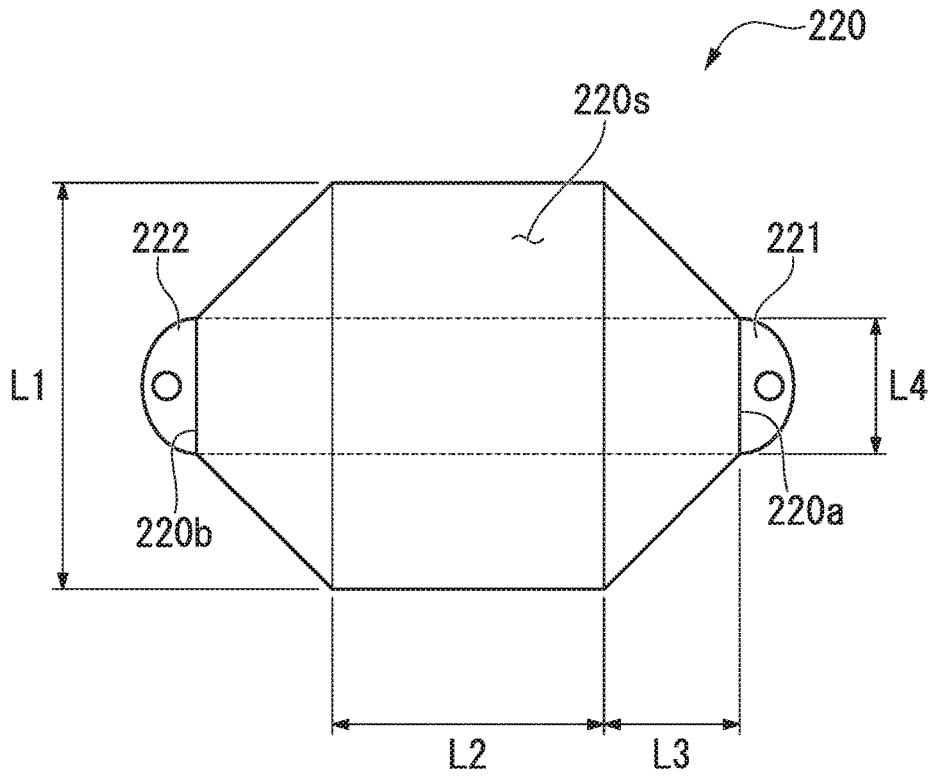
FIG. 16 is a view of a variant member in a mooring member according to the second embodiment of the present invention.

FIG. 16 is a view of a variant member 220 in a mooring member according to the second embodiment of the present invention.

As illustrated in FIG. 16, the mooring member according to the present embodiment includes the variant member 220 instead of the tube member 20. The variant member 220 is installed between the one end 10*a* (refer to FIG. 22) and the other end 10*b* (refer to FIG. 18) of the mooring cable 10. The second embodiment is different from the first embodiment in terms of what has been described above.

The variant member 220 is a tubular member having an accommodation space 220*s* therein. For example, the variant member 220 is formed of a rigid member such as a steel member. At one end 220*a* of the variant member 220, a first joining portion 221 with which the mooring cable 10 is joined is provided. On the other end 220*b* of the variant member 220, a second joining portion 222 with which the mooring cable 10 is joined is provided. Although not illustrated, in the variant member 220, a hole allowing water or the like to be introduced to or discharged from the accommodation space 220*s* is formed, and closing means such as a valve for closing this hole is provided.

For example, regarding the dimensions of the variant member 220, in FIG. 16, the length L1 is approximately 3 m, the length L2 is approximately 2 m, the length L3 is approximately 1 m, and the length L4 is approximately 1 m.

Hereinafter, a mooring method according to the present embodiment will be described with reference to FIGS. 17 and 31.

The mooring method according to the present embodiment includes a transportation step of transporting a mooring member 201 to a mooring position P (refer to FIG. 18) of the float 80, a first accommodation step of accommodating the seawater 5 (refer to FIG. 21) as a first heavy weight in the accommodation space 220*s* of the variant member 220 at the mooring position P, a connection step of connecting the one end 10*a* of the mooring cable 10 to the float 80, and a second accommodation step of accommodating the high-specific gravity liquid 6 (refer to FIG. 29) as a second heavy weight together with the seawater 5 in the accommodation space 220*s* of the variant member 220 filled with the seawater 5.

Figure 17:
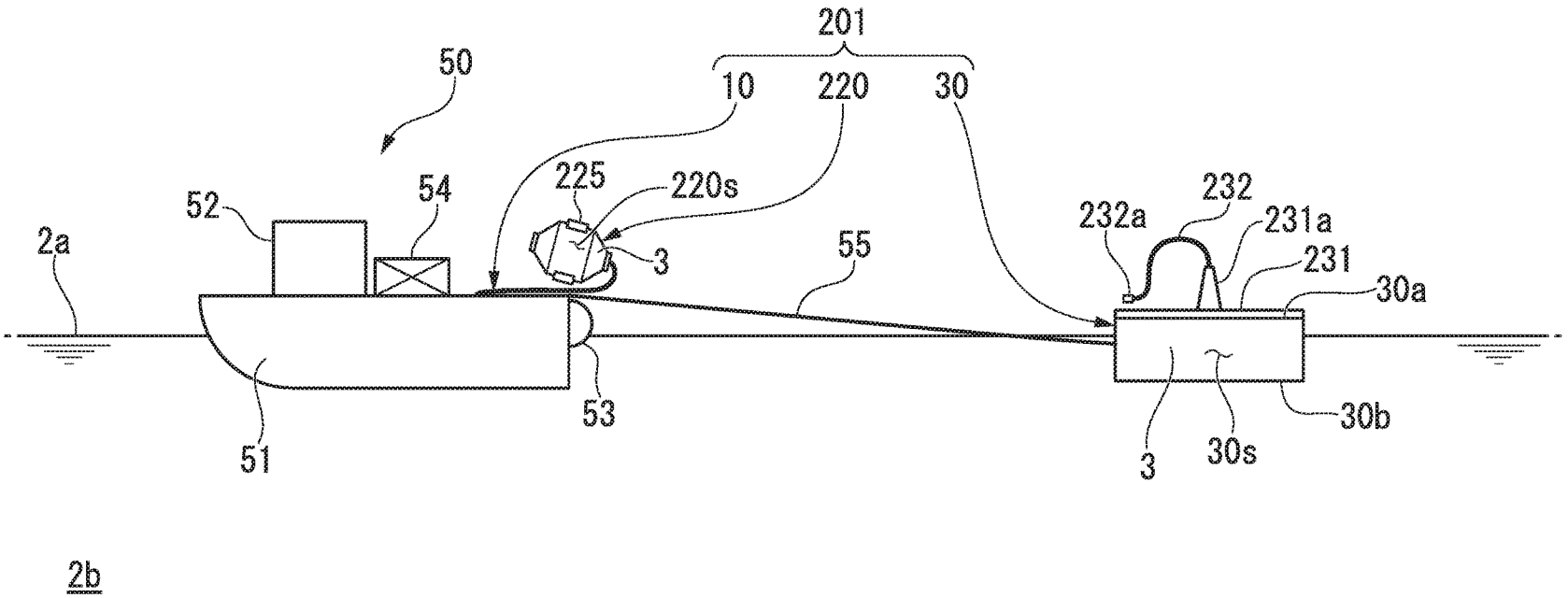
FIG. 17 is an explanatory view of the transportation step of the mooring member according to the second embodiment of the present invention.

FIG. 17 is an explanatory view of the transportation step of the mooring member 201 according to the second embodiment of the present invention.

As illustrated in FIG. 17, in the transportation step of the mooring member 201, the mooring member 201 is transported in a state in which the accommodation space 220*s* of the variant member 220 and the filling space 30*s* of the weight member 30 are filled with the air 3. In the transportation step, the mooring member 201 is transported by, for example, one tugboat (only the main tugboat 50).

The main tugboat 50 has the mooring cable 10 and the variant member 220 on the boat body 51 and transports the mooring member 201 by tugging the rope 55 and towing the weight member 30. Since the filling space 30*s* of the weight member 30 in the mooring member 201 is filled with air, the weight member 30 is towed by means of floating and towing in which a buoyant force is used.

Figure 18:
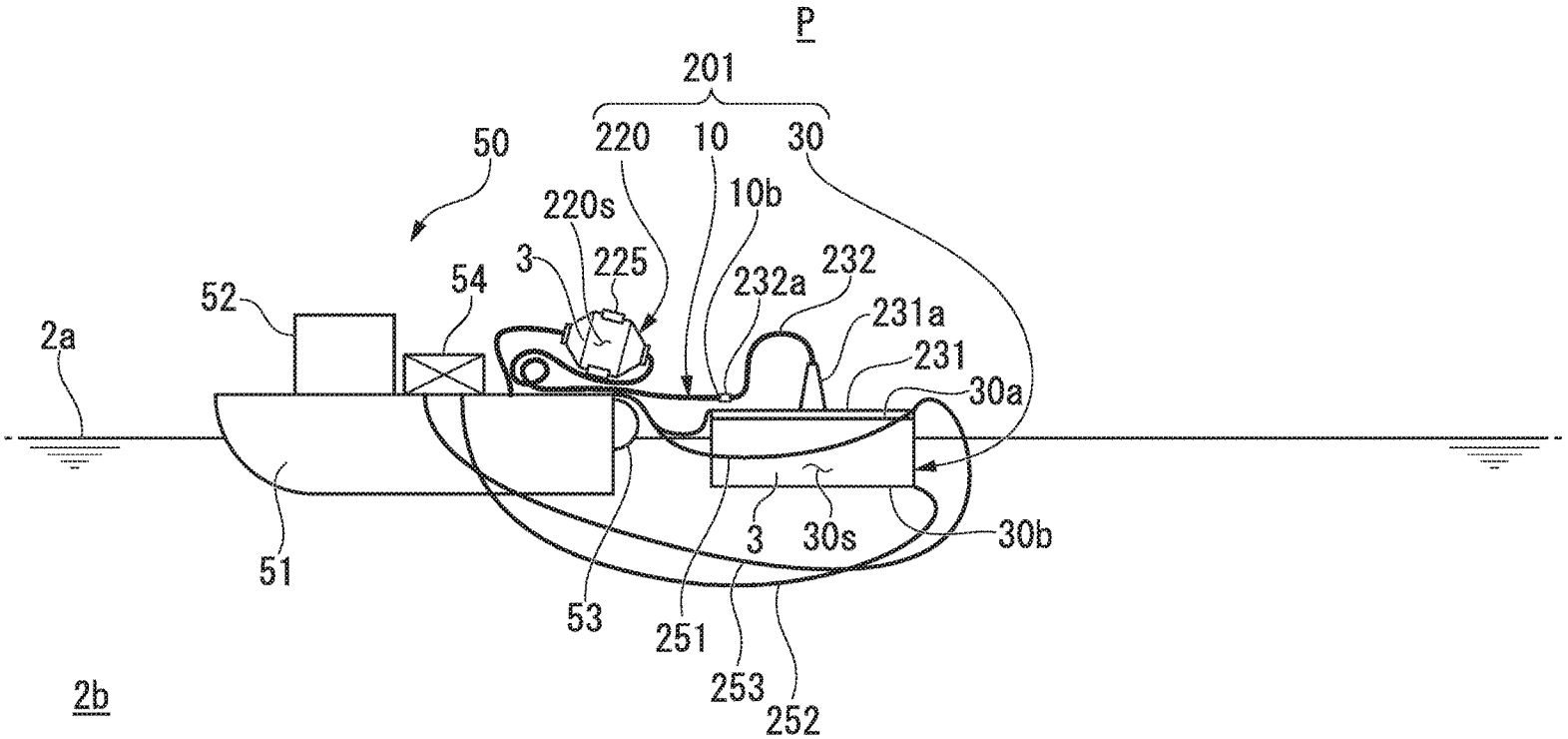
FIG. 18 is, subsequent to FIG. 17, an explanatory view of a connector terminal connection step, a wire connection step of connecting the weight member of the mooring member to the lid portion, and a hose-coupling step of coupling a hose to the weight member.

The mooring member 201 is transported by the main tugboat 50 and is placed at the mooring position P (refer to FIG. 18).

Furthermore, a lid portion 231 having a joining portion 231*a* which protrudes upwards is joined with the first side surface 30*a* of the weight member 30. A connection cable 232 which can be flexibly bent is joined with the joining portion 231*a*. A connector terminal 232*a* which can be connected to the other end 10*b* (refer to FIG. 18) of the mooring cable 10 is provided on one end portion (an end portion opposite to the joining portion 231*a*) of the connection cable 232. Therefore, it is possible to rapidly and reliably connect the connection cable 232 and the mooring cable 10 or detach the mooring cable from the connection cable.

Also, to the variant member 220, multiple (for example, two in the present embodiment) buoyant bodies 225 which generate a buoyant force in the variant member 220 are detachably attached. Furthermore, the buoyant force of the variant member 220 may be adjusted by adjusting the water amount and the like of the accommodation space 220*s* of the variant member 220. Also, the buoyant force may be adjusted by removing the buoyant bodies 225.

FIG. 18 is, subsequent to FIG. 17, an explanatory view of a connector terminal connection step, a wire connection step of connecting the weight member 30 of the mooring member 201 to the lid portion 231, and a hose-coupling step of coupling a hose to the weight member 30.

As illustrated in FIG. 18, in the connector terminal connection step, an operator (not illustrated) connects the other end 10*b* of the mooring cable 10 to the connector terminal 232*a* at the mooring position P.

In the wire connection step, the operator connects bifurcated ends of a wire 251 to one end and the other end of the lid portion 231 at the mooring position P.

In the hose-coupling step, the operator releases an introduction hose 252 from the main tugboat 50 and couples the introduction hose 252 to an introduction opening (not illustrated) of the weight member 30 at the mooring position P.

Also, similarly, the operator releases a discharge hose 253 from the main tugboat 50 and couples the discharge hose 253 to a discharge opening (not illustrated) of the weight member 30.

Furthermore, the wire 251 and the mooring cable 10 are wound around the drum of the unillustrated winch of the main tugboat 50 so as to be capable of being wound up and paid out.

Figure 19:
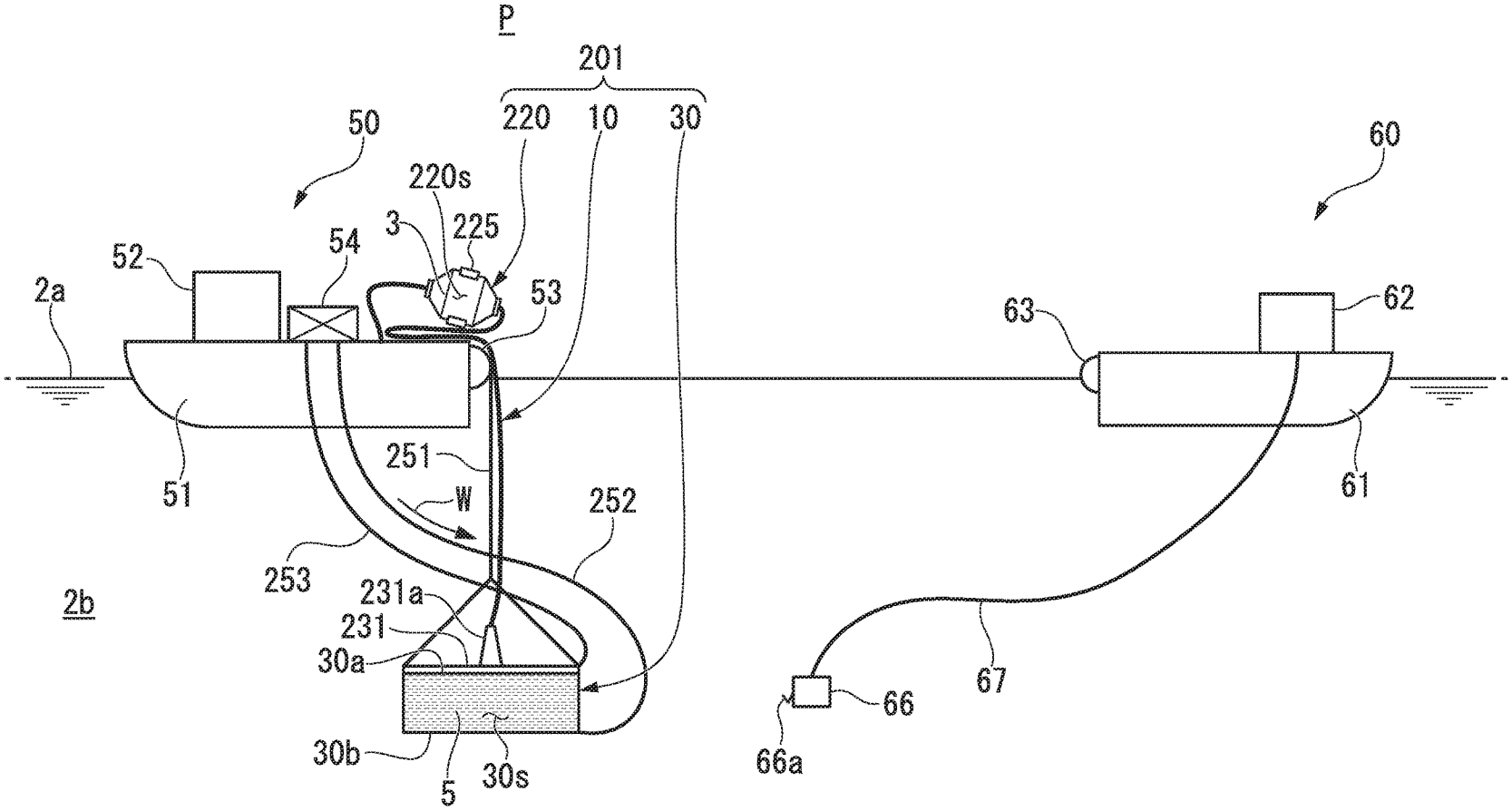
FIG. 19 is, subsequent to FIG. 18, an explanatory view of a water-introduction step to the sinker and a lowering step of the weight member.

FIG. 19 is, subsequent to FIG. 18, an explanatory view of a water-introduction step to the sinker and a lowering step of the weight member 30. In FIG. 19, the reference sign W indicates the introduction direction of seawater.

As illustrated in FIG. 19, in the water-introduction step to the sinker, the seawater 5 is introduced to the filling space 30*s* of the weight member 30 at the mooring position P. Specifically, in the water-introduction step to the sinker, the filling space 30*s* is filled with the seawater 5 via the introduction hose 252 and an introduction hole (not illustrated) of the weight member 30 using the pump 54 at the mooring position P. Furthermore, the seawater may be naturally introduced with the force of gravity.

In the lowering step, the weight member 30 is lowered using the wire 251 while extending the mooring cable 10 at the mooring position P. Specifically, in the lowering step, the mooring cable 10 and the wire 251 are guided using the guide roller 53 and are paid out from the unillustrated winch of the main tugboat 50 at the mooring position P. When the filling space 30*s* is filled with the seawater 5, and the mooring cable 10 and the wire 251 are paid out from the unillustrated winch, the weight member 30 gradually sinks into the sea 2*b*.

In the lowering step, an ROV 66 is sent into the sea 2*b* from the subsidiary tugboat 60 via a cable 67. The ROV 66 includes a manipulator 66*a* and the like. In the lowering step, the ROV 66 is placed in the vicinity of the weight member 30.

Figure 20:
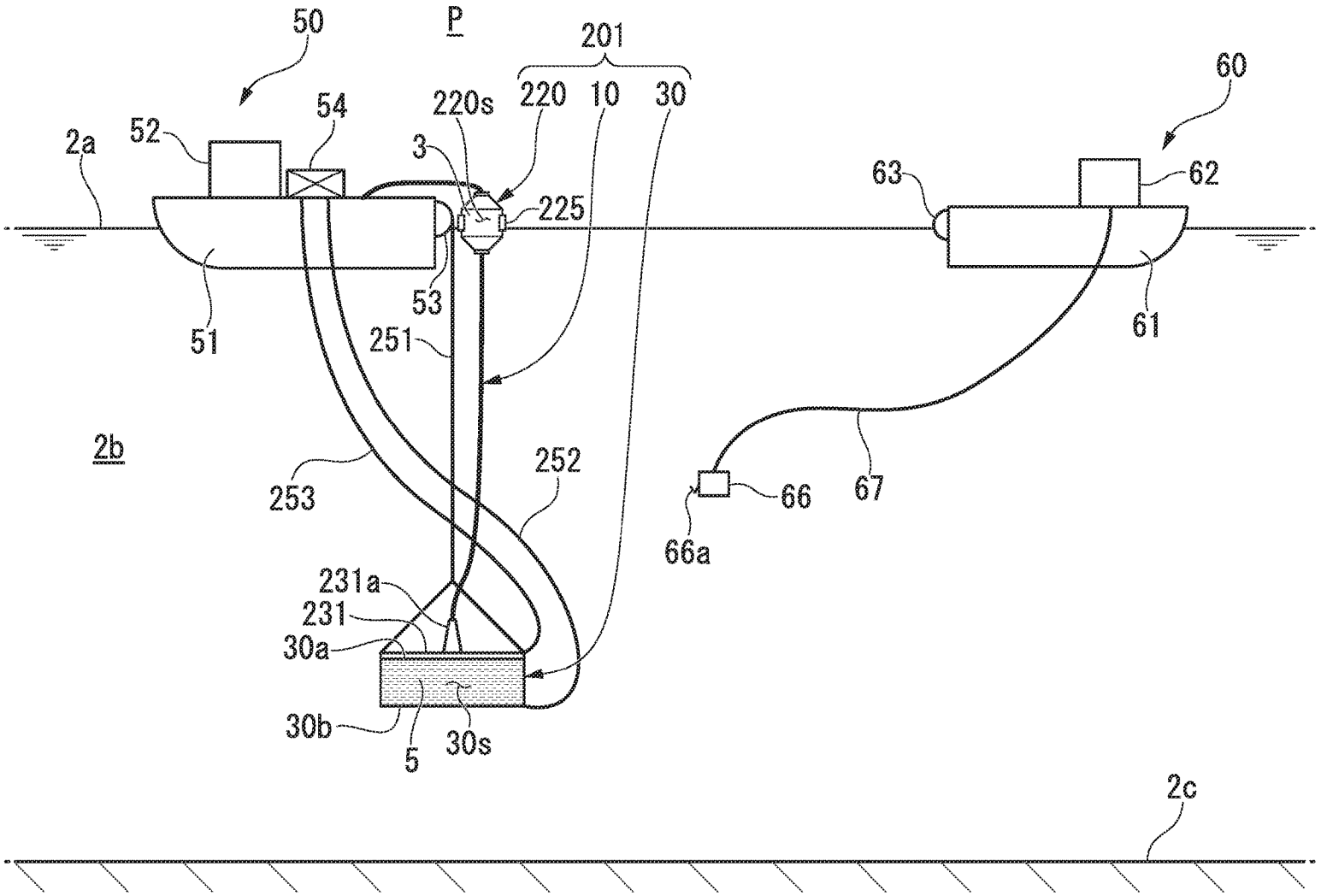
FIG. 20 is, subsequent to FIG. 19, an explanatory view of a dropping step of the variant member.

FIG. 20 is, subsequent to FIG. 19, an explanatory view of a dropping step of the variant member 220.

As illustrated in FIG. 20, in the dropping step, the variant member 220 is dropped toward the sea surface 2*a* at the mooring position P. Since the accommodation space 220*s* of the variant member 220 in the mooring member 201 is filled with the air 3, the variant member 220 floats on the sea surface 2*a*.

In the dropping step, the mooring cable 10 and the wire 251 are continuously paid out from the unillustrated winch. Therefore, the weight member 30 keeps sinking deeper than in the lowering step.

Figure 21:
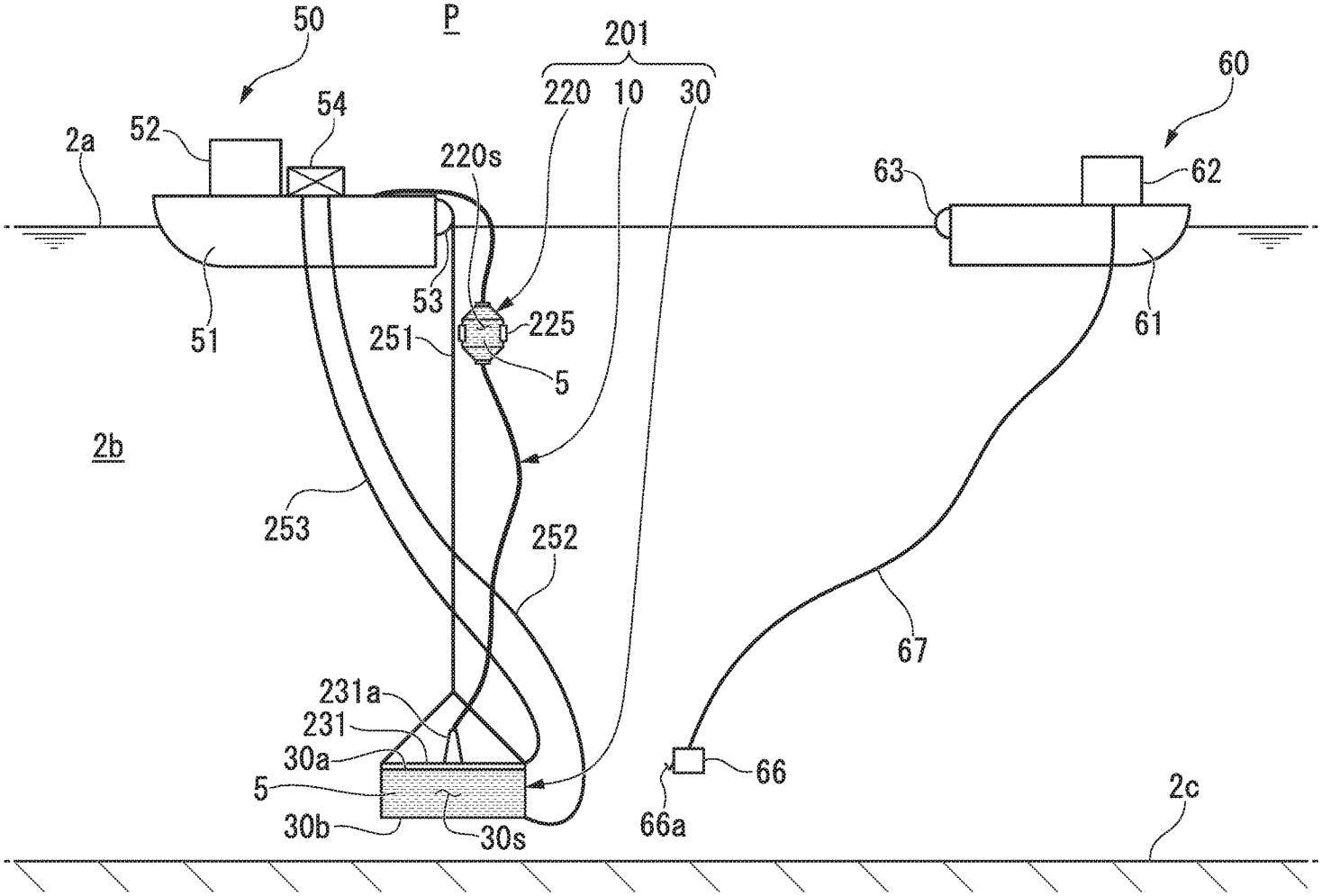
FIG. 21 is, subsequent to FIG. 20, an explanatory view of a water-introduction step to the variant member (first accommodation step).

FIG. 21 is, subsequent to FIG. 20, an explanatory view of a water-introduction step to the variant member (first accommodation step).

As illustrated in FIG. 21, in the water-introduction step to the variant member, the seawater 5 is introduced as a first heavy weight to the accommodation space 220*s* of the variant member 220 at the mooring position P. Specifically, in the water-introduction step to the variant member, at the mooring position P, an unillustrated valve of the variant member 220 is left open in advance, and the seawater 5 is introduced to the accommodation space 220*s* through the unillustrated hole. When the seawater 5 is accommodated in the accommodation space 220*s*, and the mooring cable 10 and the wire 251 are paid out from the unillustrated winch, the variant member 220 keeps sinking together with the weight member 30.

Figure 22:
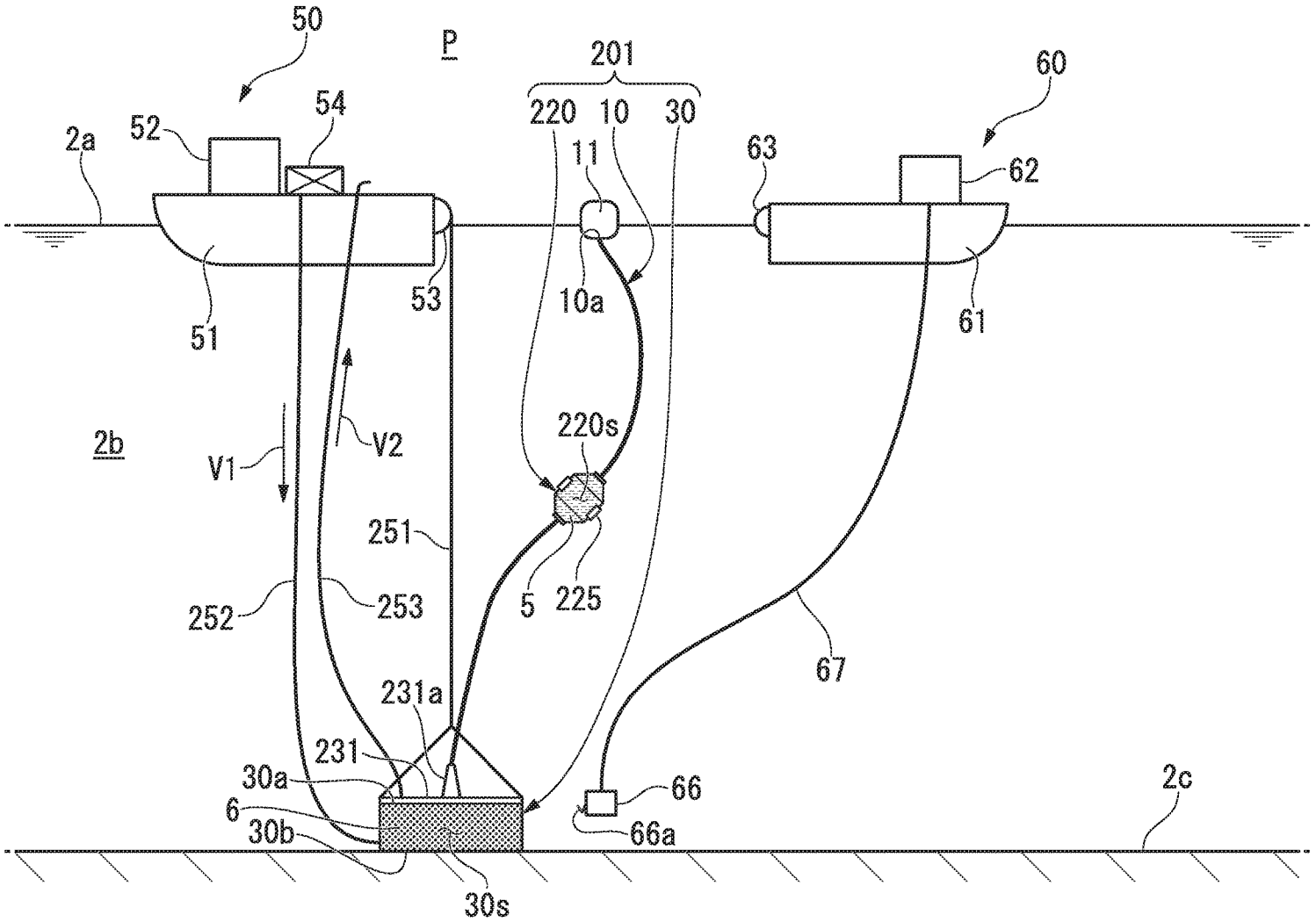
FIG. 22 is, subsequent to FIG. 21, an explanatory view of a sinker-on-the-seabed state, a buoy-joining step of joining a buoy with the one end of the mooring cable in the mooring member, and a high-specific gravity liquid introduction step of introducing high-specific gravity liquid to the weight member.

FIG. 22 is, subsequent to FIG. 21, an explanatory view of a sinker-on-the-seabed state, a buoy-joining step of joining a buoy with the one end 10*a* of the mooring cable 10 in the mooring member 201, and a high-specific gravity liquid introduction step of introducing high-specific gravity liquid to the weight member 30. In FIG. 22, the reference sign V1 indicates the introduction direction of the high-specific gravity liquid 6, and the reference sign V2 indicates the discharge direction of the seawater 5.

When the weight member 30 continues to sink at the mooring position P due to the lowering step, as illustrated in FIG. 22, the weight member 30 arrives at the seabed 2*c*, and the sinker-on-the-seabed state is formed.

In the buoy-joining step, the buoy 11 is detachably joined with the one end 10*a* of the mooring cable 10, and the buoy 11 is floated on the sea surface 2*a*.

In the high-specific gravity liquid introduction step, the high-specific gravity liquid 6 is introduced to the filling space 30*s* of the weight member 30 at the mooring position P. Specifically, in the high-specific gravity liquid introduction step, the high-specific gravity liquid 6 is introduced to the filling space 30*s* via the introduction hose 252 and the introduction hole of the weight member 30 using the pump 54. Furthermore, when the high-specific gravity liquid 6 is introduced to the filling space 30*s*, the seawater 5 in the filling space 30*s* is discharged through the discharge hole and the discharge hose 253.

Figure 23:
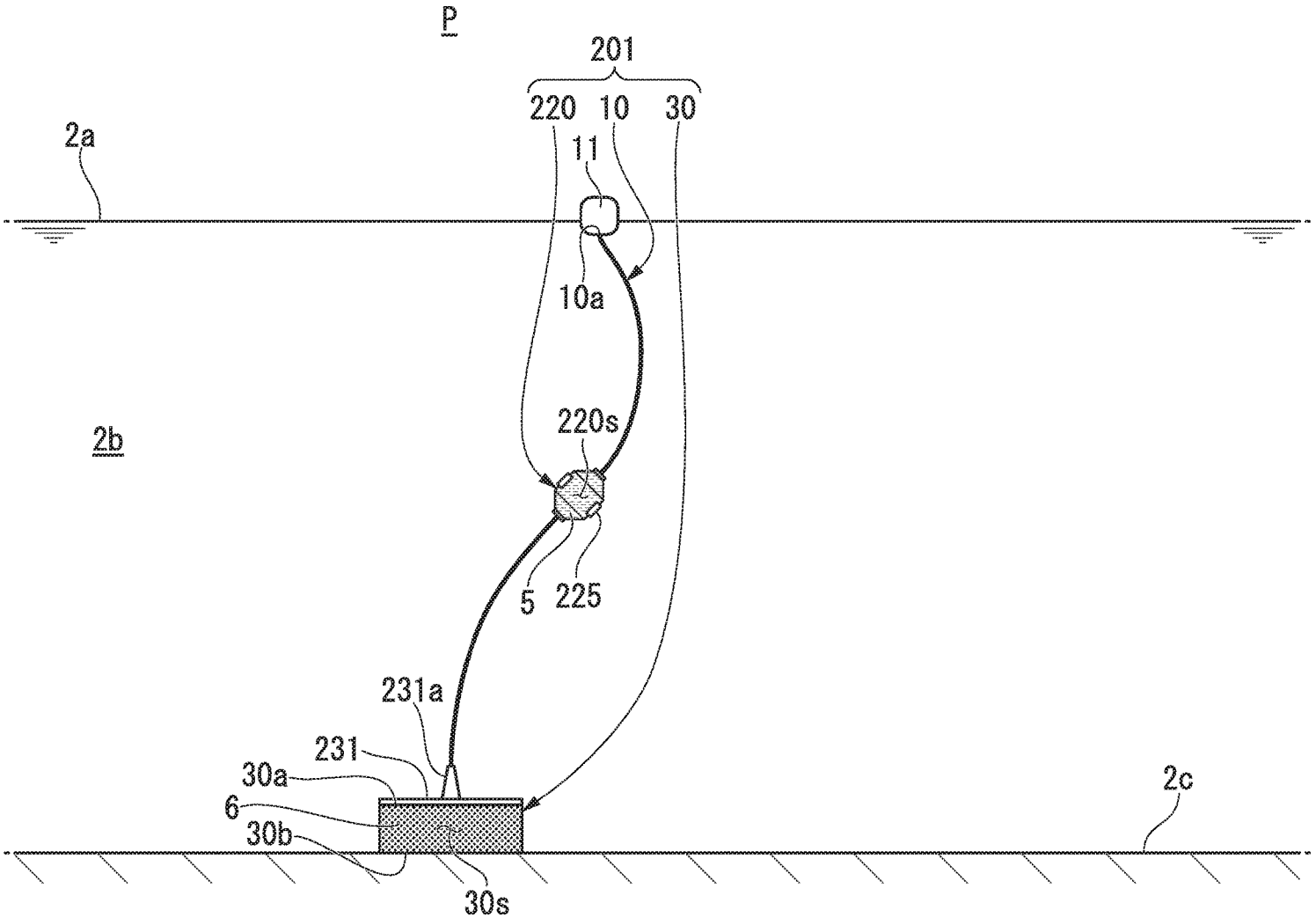
FIG. 23 is, subsequent to FIG. 22, an explanatory view of a temporary placement state of the mooring member.

FIG. 23 is, subsequent to FIG. 22, an explanatory view of a temporary placement state of the mooring member 201.

When the ROV 66 is recovered into the subsidiary tugboat 60 by means of the ROV-recovering step after the high-specific gravity liquid introduction step and the hose-winding step, as illustrated in FIG. 23, a state in which the mooring member 201 is temporarily placed before the float 80 is moored using the mooring member 201 is formed.

Figure 24:
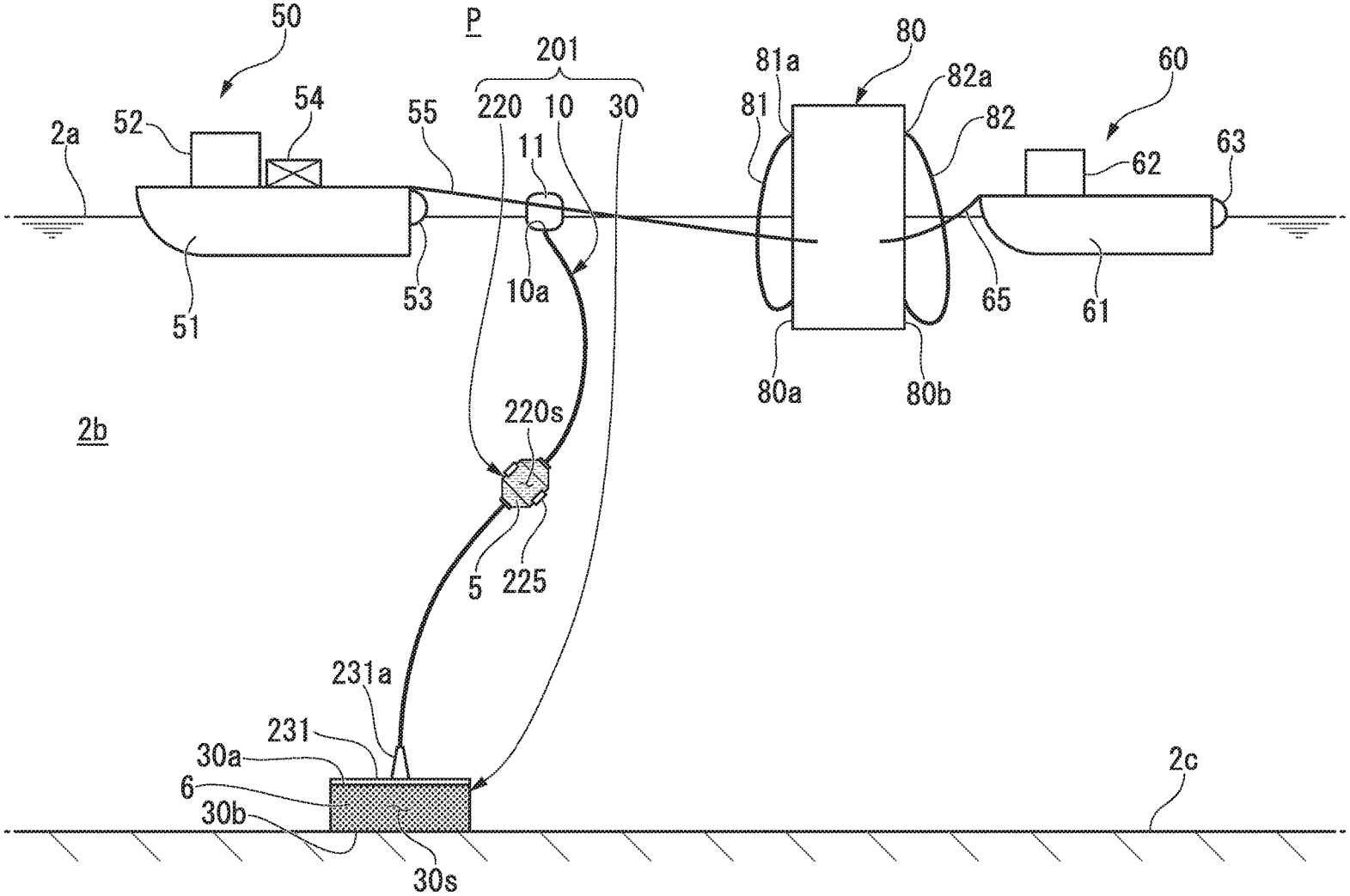
FIG. 24 is, subsequent to FIG. 23, an explanatory view of an arrival state of the float.

FIG. 24 is, subsequent to FIG. 23, an explanatory view of an arrival state of the float 80.

In the temporary placement state of the mooring member 201, when the float 80 is transported to the mooring position P by, for example, two tugboats (the main tugboat 50 and the subsidiary tugboat 60), the arrival state in which the float 80 which is a mooring subject of the mooring member 201 has arrived at the mooring position P as illustrated in FIG. 24 is formed. In the arrival state, the main tugboat 50 and the subsidiary tugboat 60 stay at the mooring position P.

Figure 25:
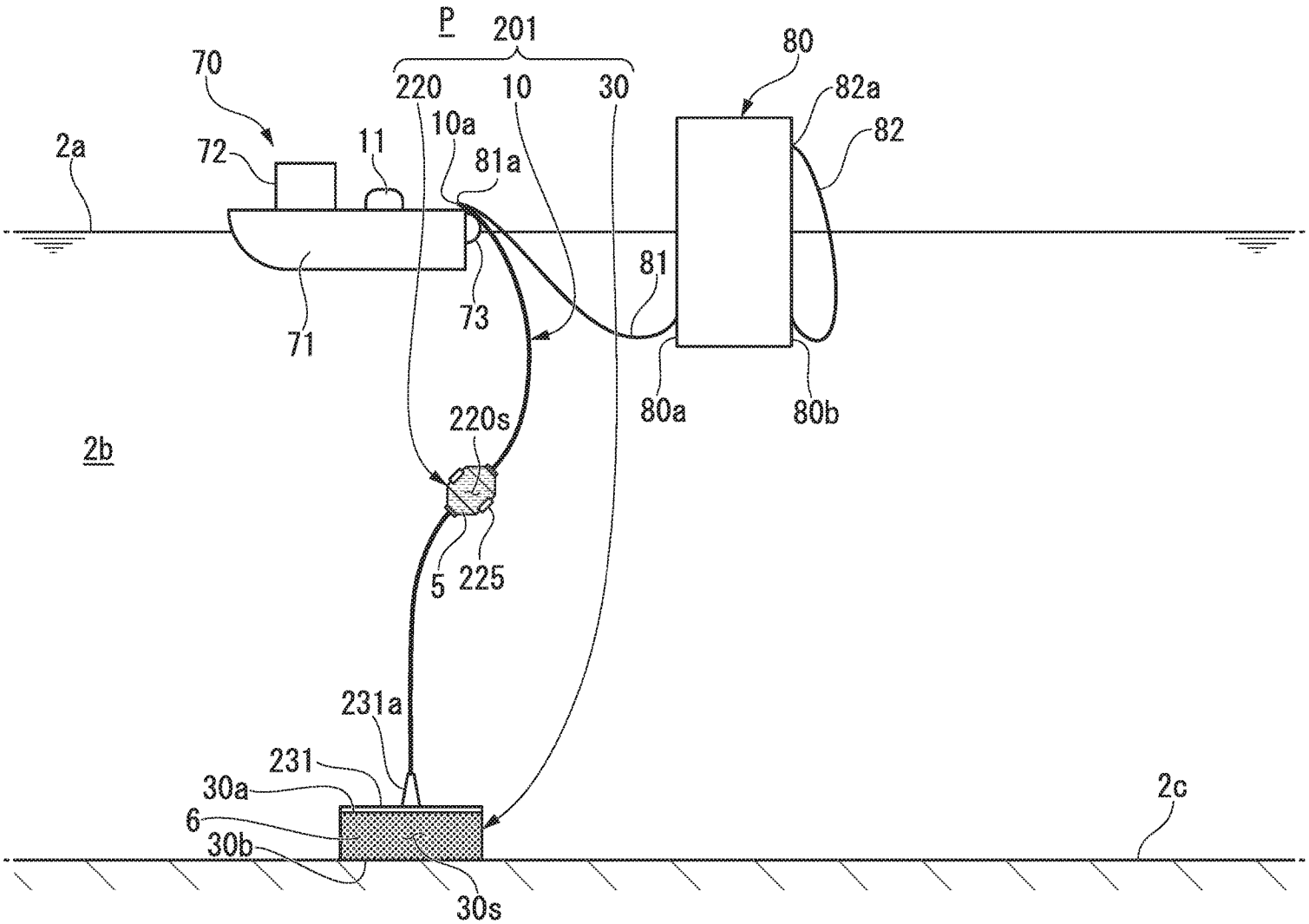
FIG. 25 is, subsequent to FIG. 24, an explanatory view of a mooring cable connection step.

FIG. 25 is, subsequent to FIG. 24, an explanatory view of a mooring cable connection step. In FIG. 25, the main tugboat 50 and the subsidiary tugboat 60 are not illustrated for convenience (also in FIGS. 26 to 30).

As illustrated in FIG. 25, in the mooring cable connection step, the one end 10*a* of the mooring cable 10 is connected to the other end 81*a* of the rope 81 which is placed in the float 80.

Figure 26:
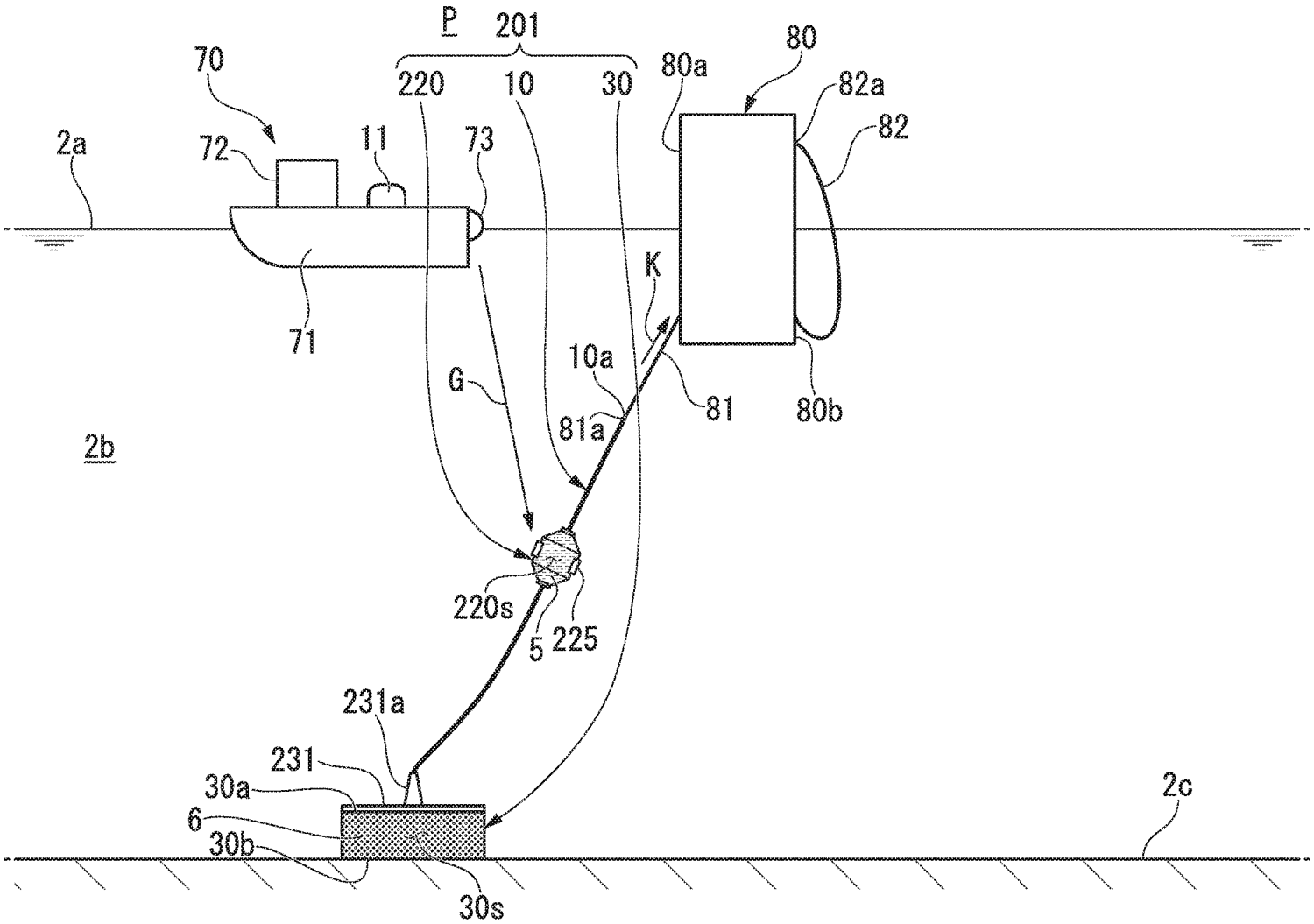
FIG. 26 is, subsequent to FIG. 25, an explanatory view of a mooring cable deployment step.

FIG. 26 is, subsequent to FIG. 25, an explanatory view of a mooring cable deployment step.

As illustrated in FIG. 26, in the mooring cable deployment step, the mooring cable 10 connected to the other end 81*a* of the rope 81 is lowered into the sea 2*b* from the workboat 70 while winding the rope 81. Therefore, the mooring cable 10 sinks into the sea 2*b* together with the rope 81 and is positioned to be inclined between the joining portion 231*a* and the lower portion of the float 80.

Figure 27:
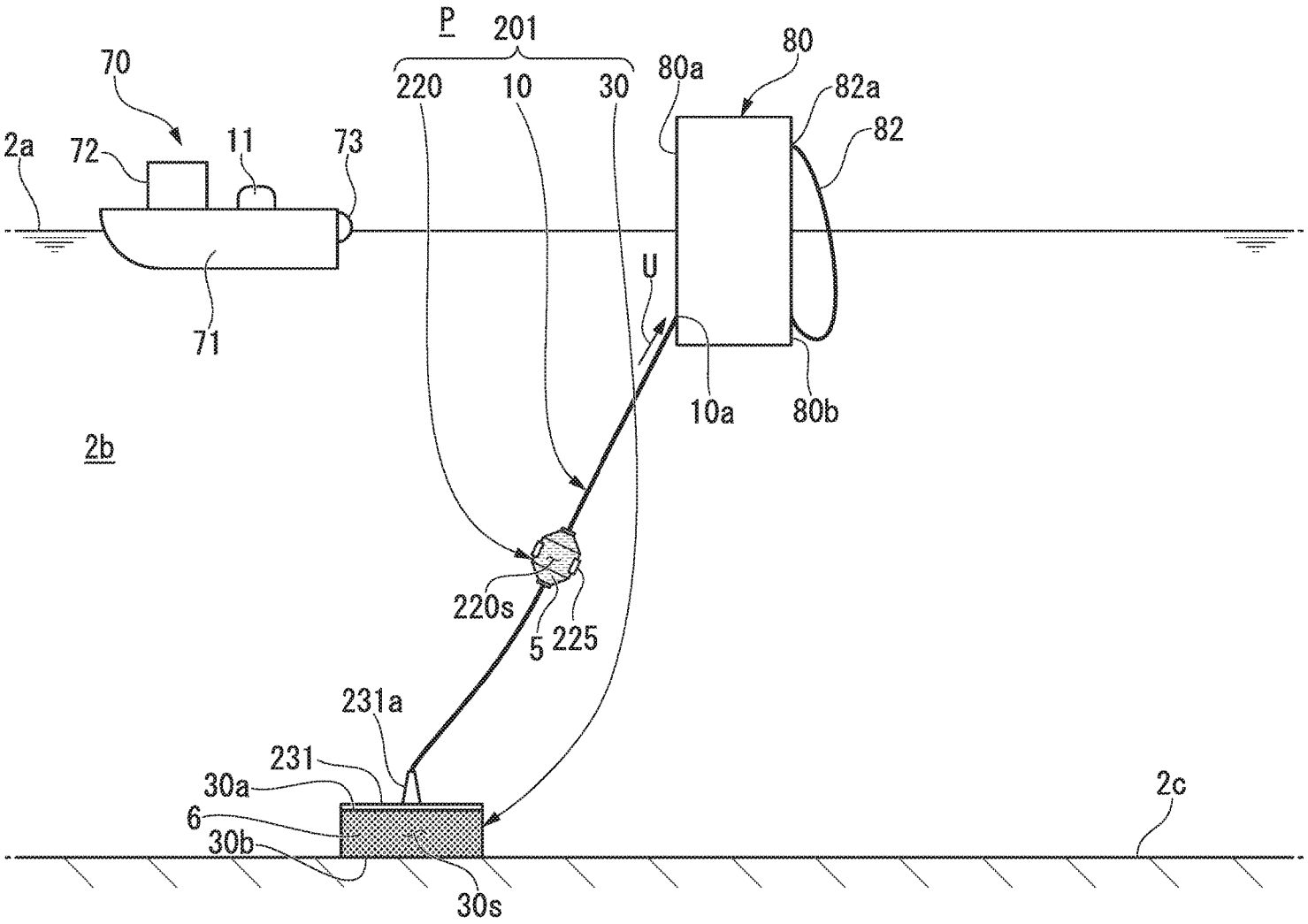
FIG. 27 is, subsequent to FIG. 26, an explanatory view of a mooring cable-lifting step.

FIG. 27 is, subsequent to FIG. 26, an explanatory view of a mooring cable-lifting step.

As illustrated in FIG. 27, in the mooring cable-lifting step, the rope 81 connected to the one end 10*a* of the mooring cable 10 is wound up using the unillustrated winch provided in the float 80.

Figure 28:
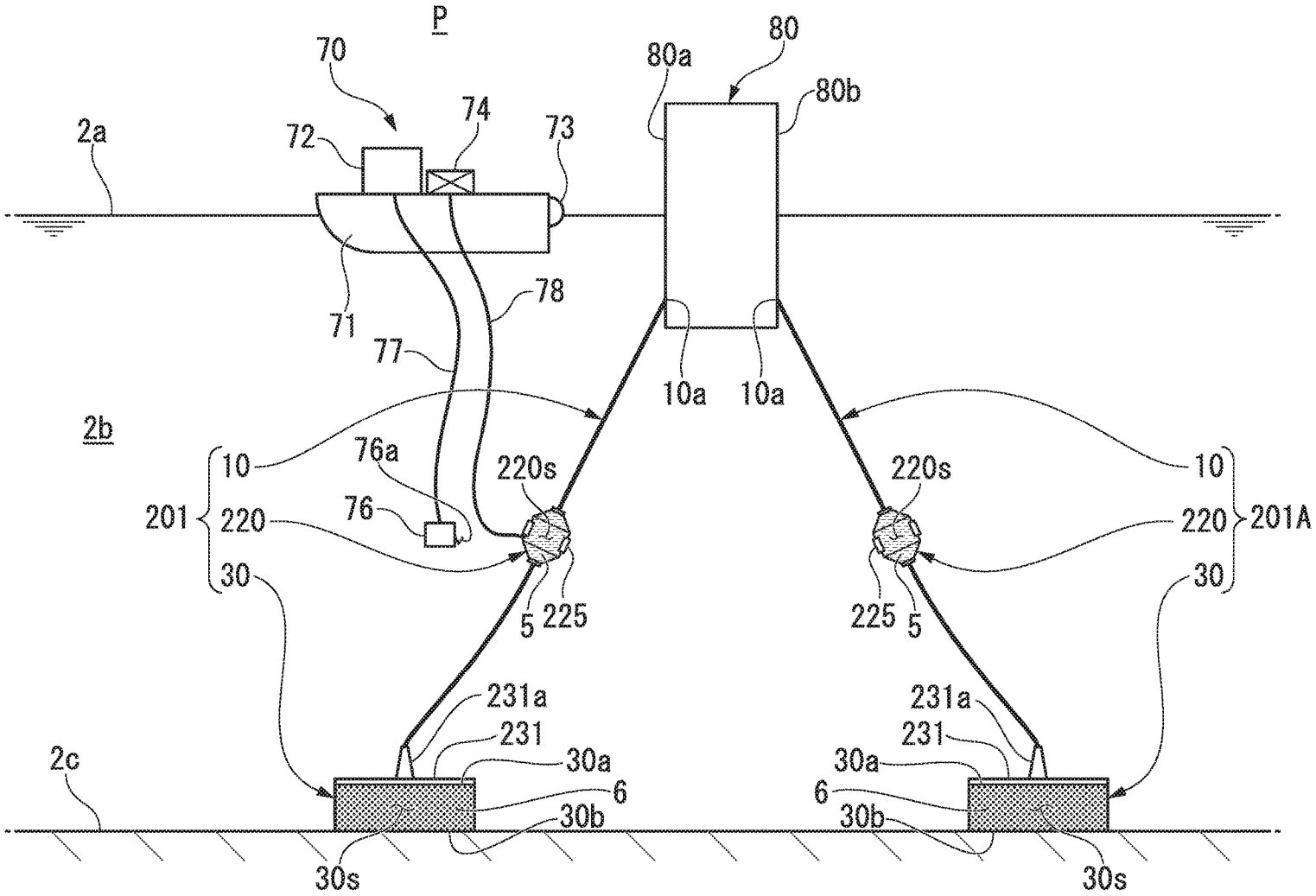
FIG. 28 is, subsequent to FIG. 27, an explanatory view of a high-specific gravity liquid introduction step (second accommodation step) of introducing the high-specific gravity liquid to the variant member.

FIG. 28 is, subsequent to FIG. 27, an explanatory view of a high-specific gravity liquid introduction step (second accommodation step) of introducing the high-specific gravity liquid to the variant member 220.

As illustrated in FIG. 28, in the high-specific gravity liquid introduction step, the high-specific gravity liquid 6 (refer to FIG. 29) is introduced as the second heavy weight to the accommodation space 220*s* of the variant member 220 which is filled with the seawater 5 together with the seawater 5. Specifically, in the high-specific gravity liquid introduction step, the hose 78 is coupled to the unillustrated hole of the variant member 220, and the high-specific gravity liquid 6 (refer to FIG. 29) is introduced to the accommodation space 220*s* of the variant member 220 via the hose 78 using the pump 74. When the high-specific gravity liquid 6 is introduced to the accommodation space 220*s*, the seawater 5 in the accommodation space 220*s* is discharged through the hole. That is, in the high-specific gravity liquid introduction step, the high-specific gravity liquid 6 (the second heavy weight) is accommodated in the accommodation space 220*s* of the variant member 220 by being added to the seawater 5 or being exchanged with at least part of the seawater 5.

In the high-specific gravity liquid introduction step, when the high-specific gravity liquid 6 is introduced to the accommodation space 220*s* of the variant member 220, the total weight of the variant member 220 and the substance accommodated in the variant member becomes heavier than that before the high-specific gravity liquid introduction step. Therefore, the mooring cable 10 is imparted with a predetermined tensile force as illustrated in FIG. 29.

A mooring member 201A (second mooring member) is connected to the second side surface 80*b* of the float 80.

The mooring member 201A is connected to the second side surface in the same manner as in the mooring cable connection step of the mooring member 201 (first mooring member). Furthermore, the mooring cable deployment step, the mooring cable-lifting step, and the high-specific gravity liquid introduction step are performed on the mooring member 201A in the same manner as on the mooring member 201.

Figure 29:
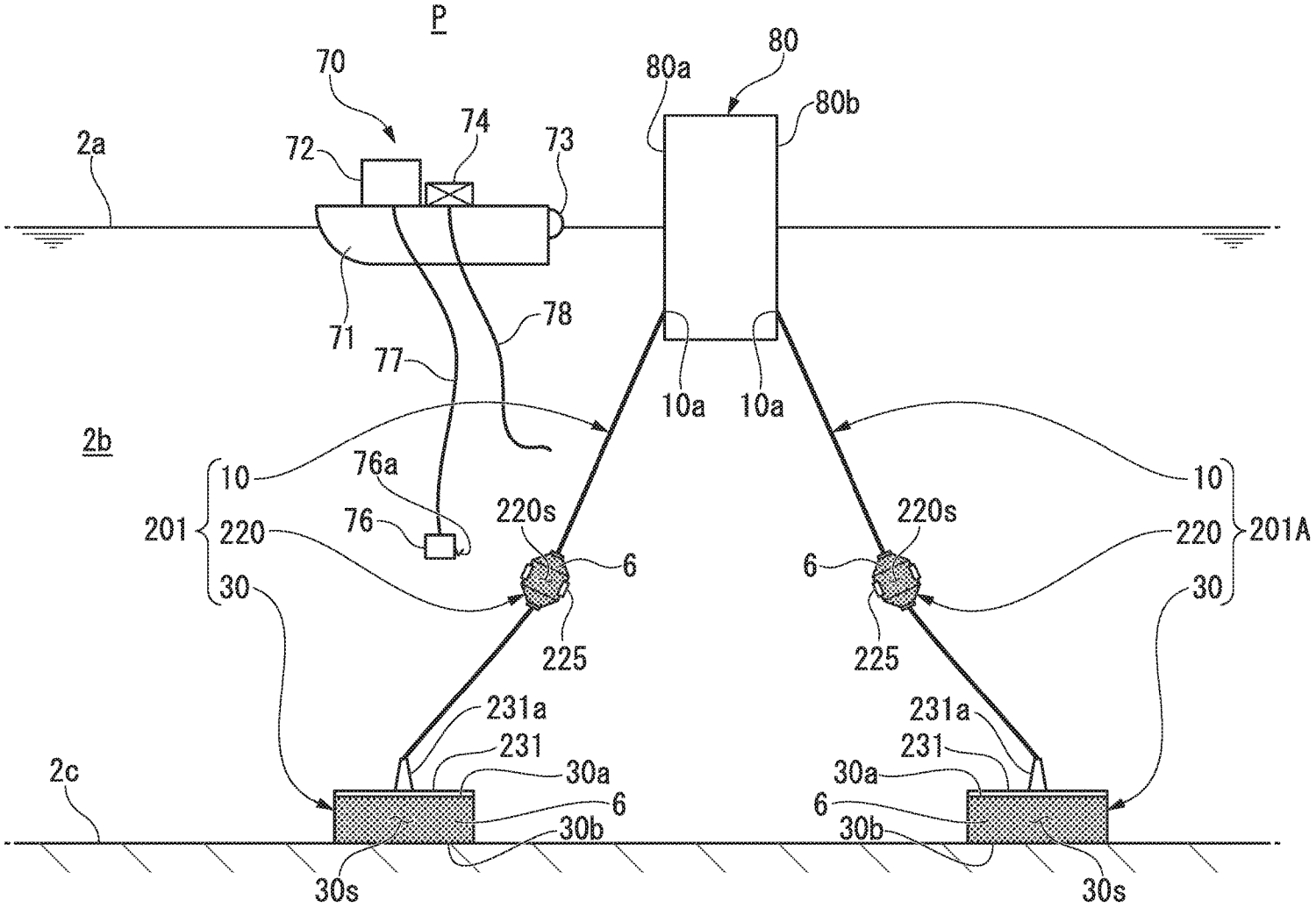
FIG. 29 is, subsequent to FIG. 28, an explanatory view of a hose-winding step.

FIG. 29 is, subsequent to FIG. 28, an explanatory view of a hose-winding step.

As illustrated in FIG. 29, in the hose-winding step, the ROV 76 is placed in the vicinity of the variant member 220, and the hose 78 is removed from the variant member 220 using the manipulator 76*a* and is wound up using the unillustrated winch.

Figure 30:
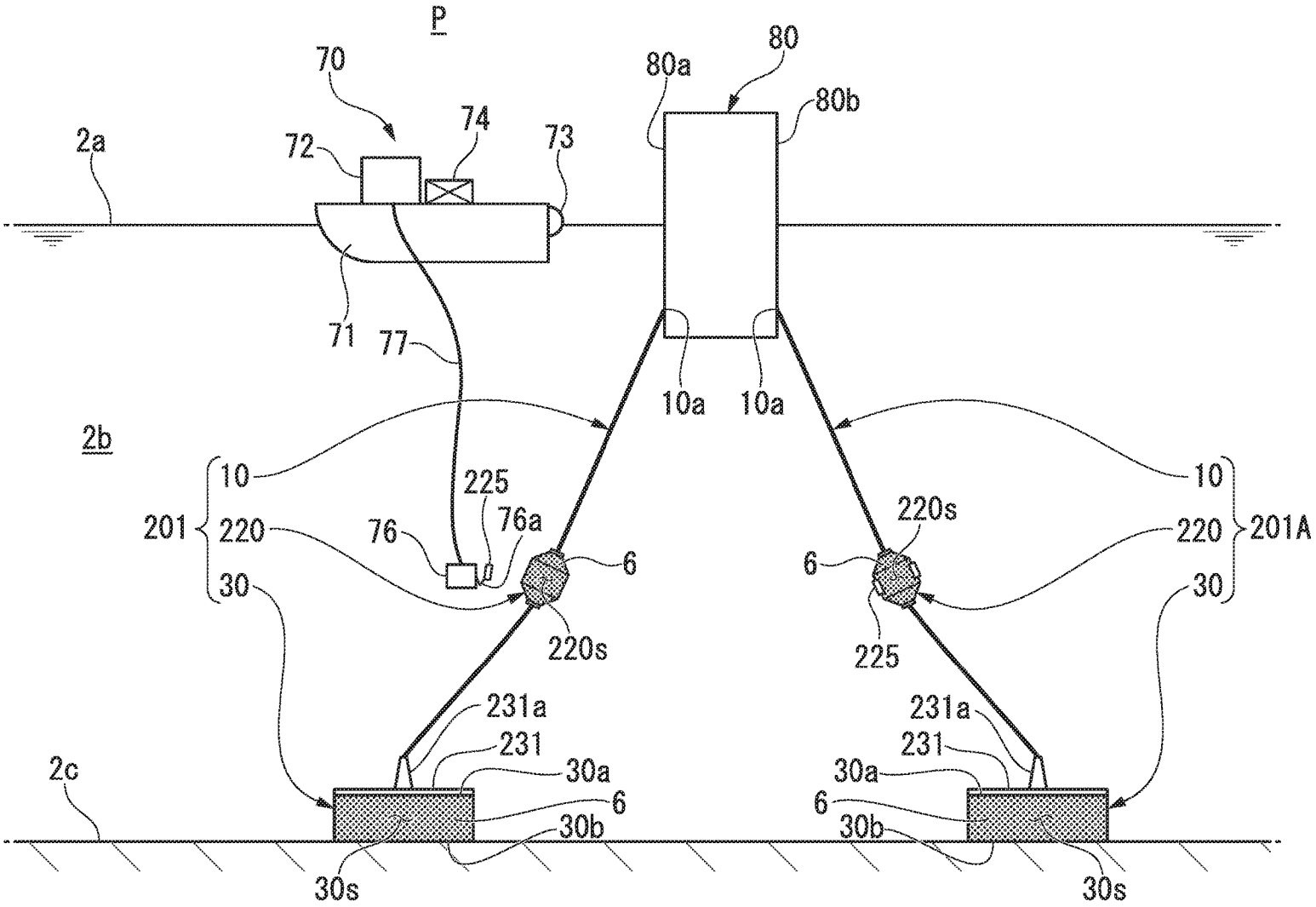
FIG. 30 is, subsequent to FIG. 29, an explanatory view of an ROV-recovering step.

FIG. 30 is, subsequent to FIG. 29, an explanatory view of an ROV-recovering step.

As illustrated in FIG. 30, in the ROV-recovering step, the cable 77 is wound up using the unillustrated winch, and the ROV 76 is recovered. When the ROV-recovering step is completed, the workboat 70 leaves the mooring position P. Also, although not illustrated, the main tugboat 50 and the subsidiary tugboat 60 also leave the mooring position P.

Figure 31:
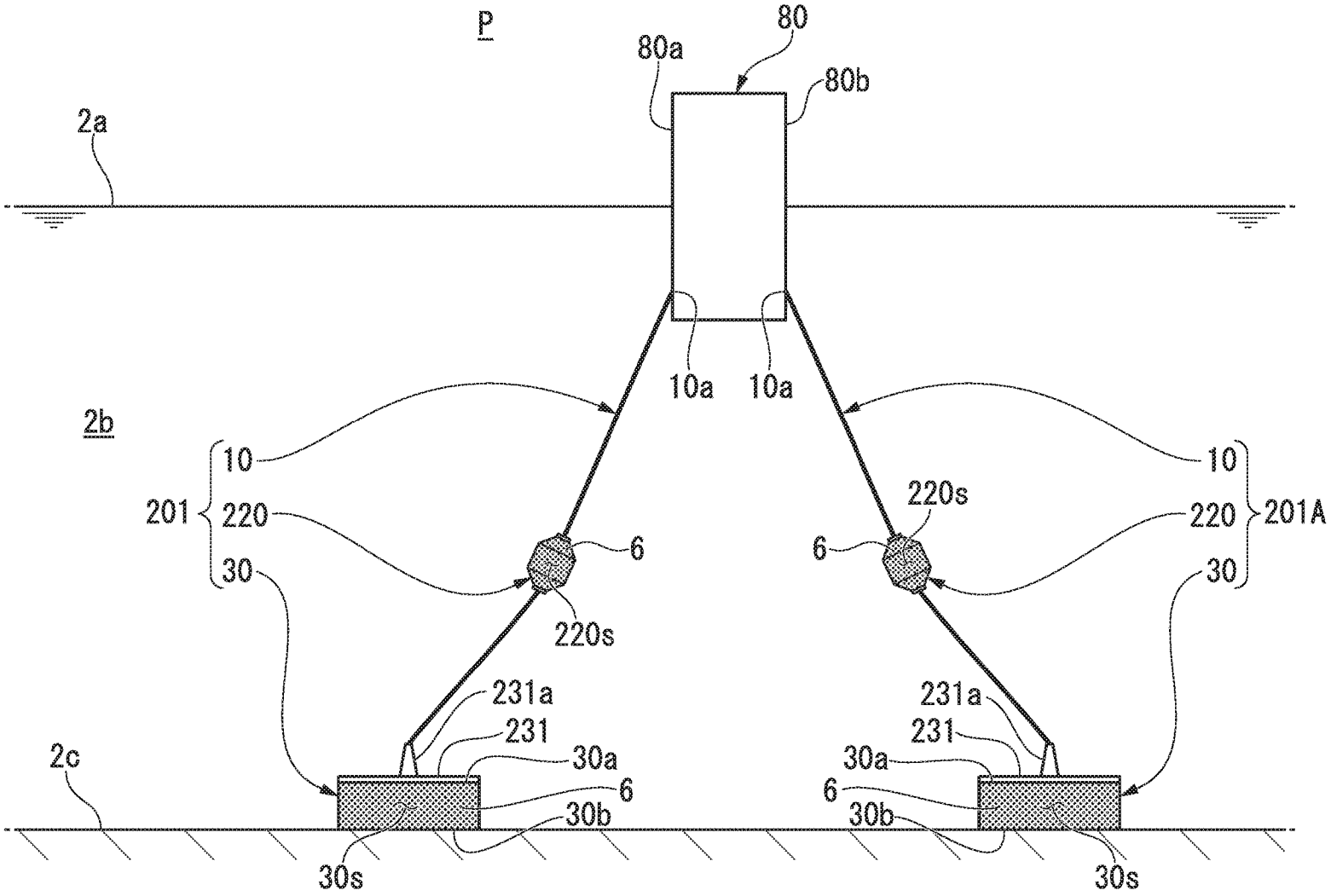
FIG. 31 is, subsequent to FIG. 30, an explanatory view of a mooring state of the float.

FIG. 31 is, subsequent to FIG. 30, an explanatory view of a mooring state of the float 80.

When the above-described steps are performed, a mooring state in which the float 80 is moored using the mooring members 201 and 201A as illustrated in FIG. 31 is formed. In the mooring state, since a certain tensile force acts on the mooring cables 10 in the respective mooring members 201 and 201A, the float 80 is stably placed at the mooring position P.

As described above, the embodiment is a mooring method for mooring the float 80 offshore through the mooring member 201, including a transportation step of transporting the mooring member 201 having the mooring cable 10 which can be connected to the float 80 at the one end 10*a* and the variant member 220 which is attached between the one end 10*a* and the other end 10*b* of the mooring cable 10 and has the accommodation space 220*s* therein to the mooring position P of the float 80, a water-introduction step to the variant member (first accommodation step) of introducing the seawater 5 (first heavy weight) to the accommodation space 220*s* of the variant member 220 at the mooring position P, a connection step of connecting the one end 10*a* of the mooring cable 10 to the float 80 at the mooring position P after the water-introduction step to the variant member, and a high-specific gravity liquid introduction step (second accommodation step) of accommodating the high-specific gravity liquid 6 (second heavy weight) in the accommodation space 220*s* of the variant member 220 by adding the high-specific gravity liquid to the seawater 5 or exchanging at least part of the seawater 5 with the high-specific gravity liquid at the mooring position P after the connection step.

According to this method, since the high-specific gravity liquid 6 is accommodated in the accommodation space 220*s* of the variant member 220 by adding the high-specific gravity liquid to the seawater 5 or exchanging at least part of the seawater 5 with the high-specific gravity liquid at the mooring position P in the high-specific gravity liquid introduction step after the connection step, before the high-specific gravity liquid introduction step, the mooring cable 10 can be easily connected to the float 80, and, during the high-specific gravity liquid introduction step, the specific weight of the variant member 220 can be increased in the same manner as that of the weight member 30. Therefore, it is possible to easily moor the float 80.

Also, in the embodiment, since the variant member 220 which is attached between the one end 10*a* and the other end 10*b* of the mooring cable 10 is used as the accommodation member, it is possible to easily moor the float 80 using a simple constitution.

Third Embodiment

Next, a mooring method according to a third embodiment of the present invention will be described with reference to FIGS. 32 to 43. Furthermore, in the third embodiment, the same portions as the constitutional elements in the second embodiment will be given the same reference sign and will not be described.

Figure 32:
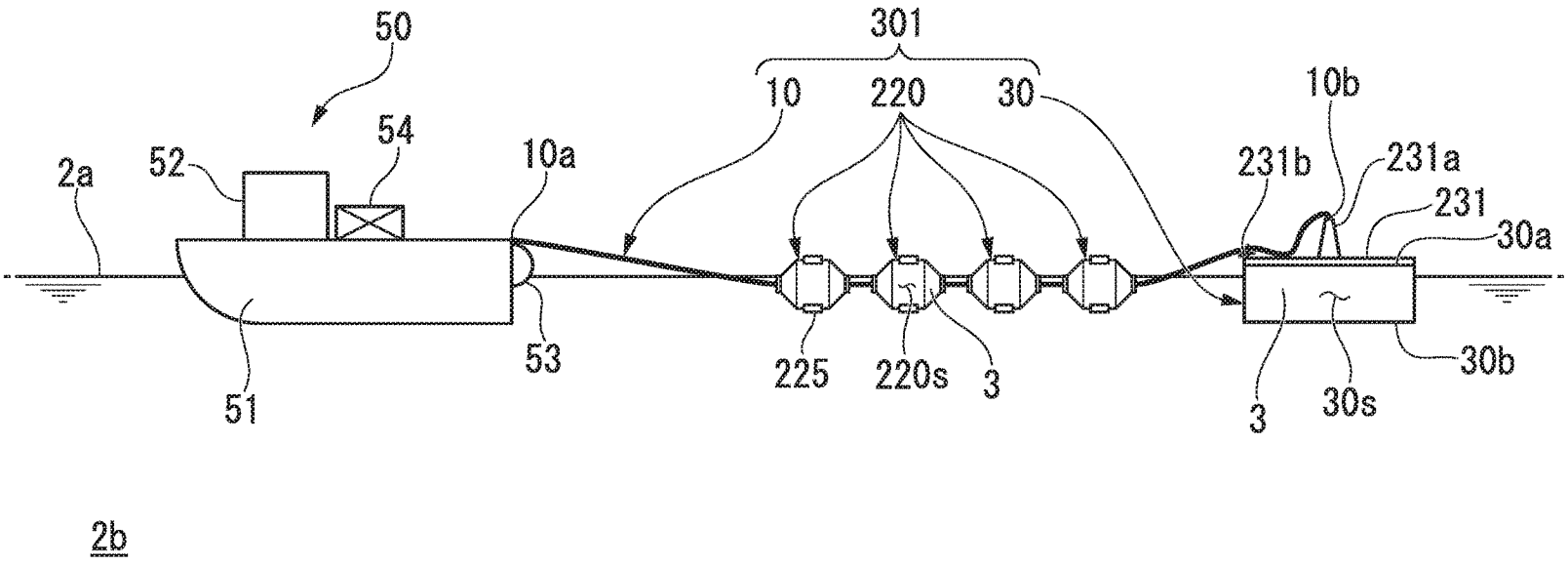
FIG. 32 is an explanatory view of a transportation step of a mooring member according to the third embodiment of the present invention.

FIG. 32 is an explanatory view of a transportation step of a mooring member 301 according to the third embodiment of the present invention.

As illustrated in FIG. 32, in the mooring member 301 according to the present embodiment, multiple (for example, four in the present embodiment) variant members 220 are placed at predetermined intervals between the one end 10*a* and the other end 10*b* of the mooring cable 10. The third embodiment is different from the second embodiment in terms of what has been described above.

The mooring method according to the present embodiment includes a transportation step of transporting the mooring member 301 to a mooring position P (refer to FIG. 33) of the float 80, a first accommodation step of accommodating the seawater 5 (refer to FIG. 34) as a first heavy weight in the accommodation spaces 220*s* of the respective variant members 220 at the mooring position P, a connection step of connecting the one end 10*a* of the mooring cable 10 to the float 80, and a second accommodation step of accommodating the high-specific gravity liquid 6 (refer to FIG. 41) as a second heavy weight together with the seawater 5 in the accommodation spaces 220*s* of the respective variant members 220 filled with the seawater 5.

As illustrated in FIG. 32, in the transportation step of the mooring member 301, the mooring member 301 is transported in a state in which the accommodation spaces 220*s* of the respective variant members 220 and the filling space 30*s* of the weight member 30 are filled with the air 3. In the transportation step, the mooring member 301 is transported by, for example, one tugboat (only the main tugboat 50).

The main tugboat 50 tugs the mooring cable 10 in which the four variant members 220 are placed at predetermined intervals and tows the mooring member 301 with the weight member 30 on the tail. Since the accommodation spaces 220*s* of the respective variant members 220 and the filling space 30*s* of the weight member 30 in the mooring member 301 are filled with air, the mooring member 301 is towed by means of floating and towing in which a buoyant force is used. The mooring member 301 is transported by the main tugboat 50 and is placed at the mooring position P (refer to FIG. 33).

Furthermore, a hook 231*b* with which the mooring cable 10 is joined is provided at one end of the lid portion 231. A portion of the mooring cable 10 which is close to the other end 10*b* thereof is joined with the hook 231*b*. The joining portion 231*a* is joined with the other end 10*b* of the mooring cable 10.

Also, to each of the variant members 220, multiple (for example, two in the present embodiment) buoyant bodies 225 are detachably attached. Furthermore, the buoyant forces of the respective variant members 220 may be adjusted by adjusting the water amount and the like of at least one accommodation space 220*s* out of the multiple variant members 220. Also, the buoyant forces may be adjusted by removing the buoyant bodies 225.

Furthermore, the mooring cable 10 is wound around the drum of the unillustrated winch of the main tugboat 50 so as to be capable of being wound up and paid out.

Figure 33:
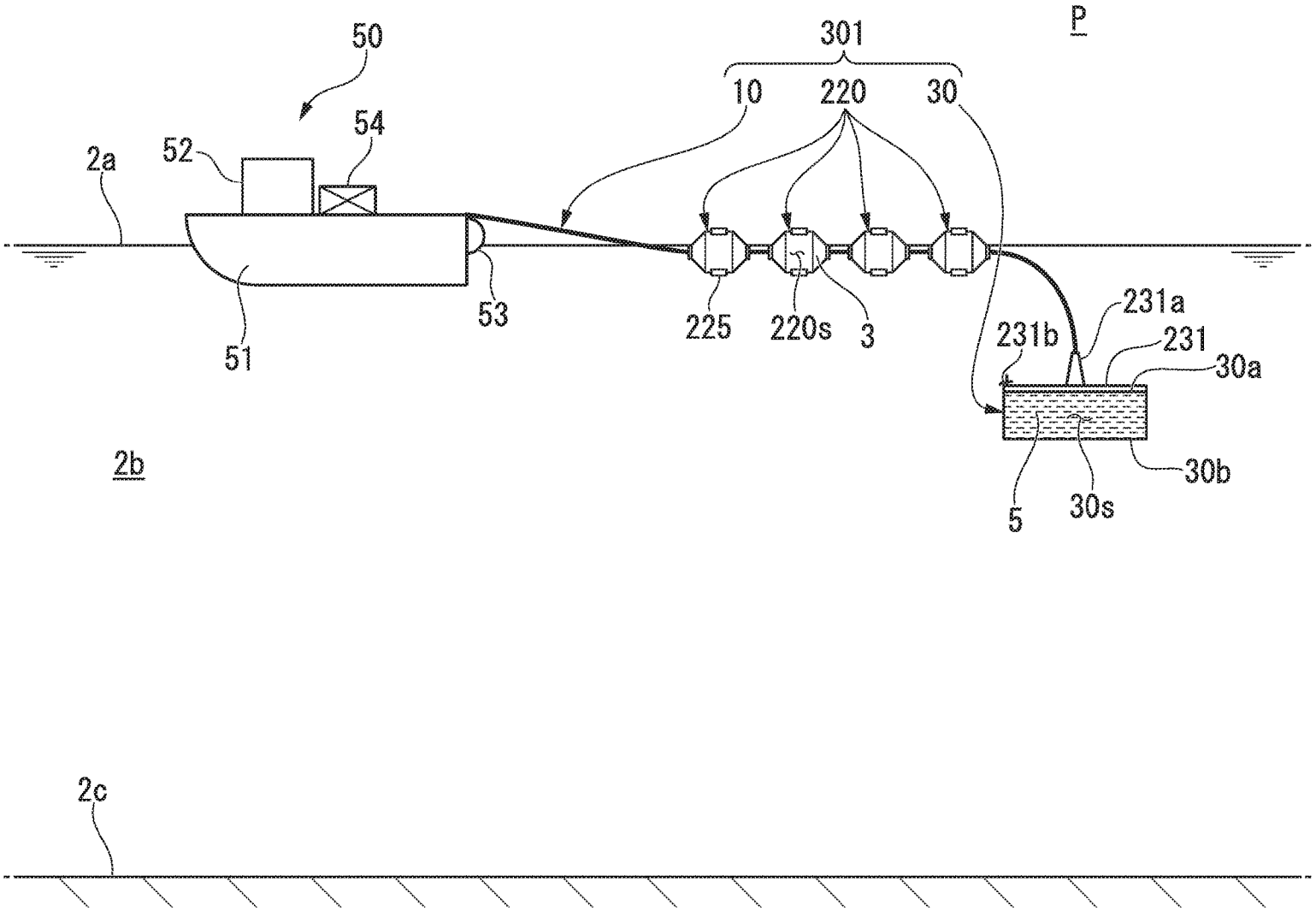
FIG. 33 is, subsequent to FIG. 32, an explanatory view of a water-introduction step to the sinker.

FIG. 33 is, subsequent to FIG. 32, an explanatory view of a water-introduction step to the sinker.

As illustrated in FIG. 33, in the water-introduction step to the sinker, the seawater 5 is introduced to the filling space 30*s* of the weight member 30 at the mooring position P.

Specifically, in the water-introduction step to the sinker, at the mooring position P, an operator (not illustrated) releases the portion of the mooring cable 10 which is close to the other end 10*b* thereof from the hook 231*b* and opens an unillustrated valve of the weight member 30, thereby introducing the seawater 5 to the filling space 30*s* through the unillustrated hole. When the filling space 30*s* is filled with the seawater 5, and the mooring cable 10 is paid out from the unillustrated winch, the weight member 30 gradually sinks into the sea 2*b*.

Figure 34:
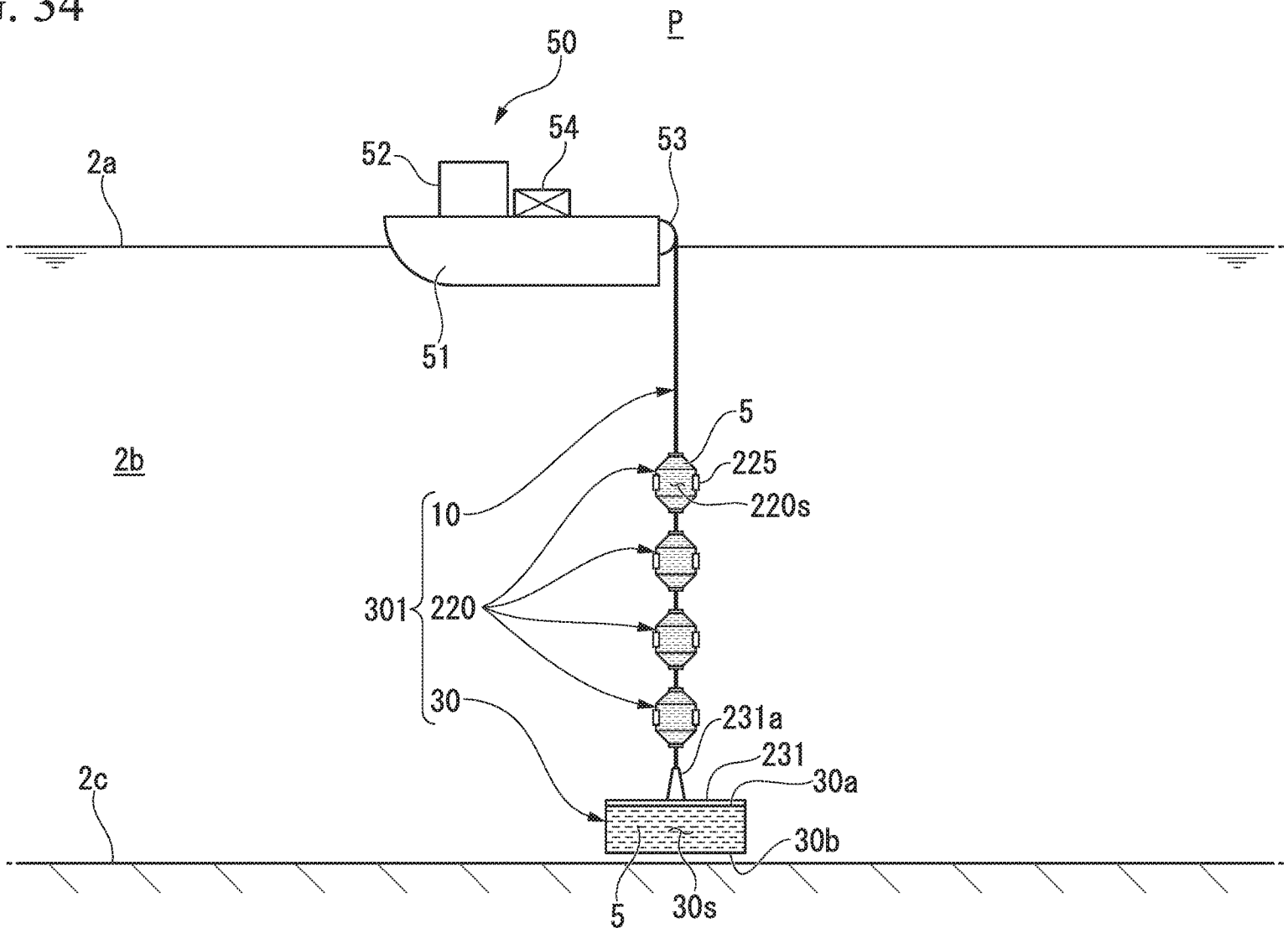
FIG. 34 is, subsequent to FIG. 33, an explanatory view of a water-introduction step to the variant member (first accommodation step) and a lowering step of the weight member.

FIG. 34 is, subsequent to FIG. 33, an explanatory view of a water-introduction step to the variant member (first accommodation step) and a lowering step of the weight member 30.

As illustrated in FIG. 34, in the water-introduction step to the variant member, the seawater 5 is introduced as the first heavy weight to the accommodation spaces 220*s* of the respective variant members 220 at the mooring position P. Specifically, in the water-introduction step to the variant member, at the mooring position P, the unillustrated valves of the respective variant members 220 are left open in advance, and the seawater 5 is introduced to the accommodation space 220*s* through the unillustrated hole.

In the lowering step, the mooring cable 10 is extended (paid out) in accordance with the sinking of the weight member 30 and the variant members 220 at the mooring position P. Specifically, in the lowering step, the mooring cable 10 is guided using the guide roller 53 and is paid out from the unillustrated winch of the main tugboat 50 at the mooring position P.

When the filling space 30*s* and the accommodation space 220*s* are filled with the seawater 5, and the mooring cable 10 is paid out from the unillustrated winch, the respective variant members 220 gradually sink into the sea 2*b* together with the weight member 30. Furthermore, the respective variant members 220 are arranged at predetermined vertical intervals in the sea 2*b*. For example, in FIG. 34, a series of the variant members 220 are arranged substantially vertically by adjusting the water amount and the like of the uppermost variant member 220 (by introducing air to the variant member so as to decrease the weight of the variant member).

Figure 35:
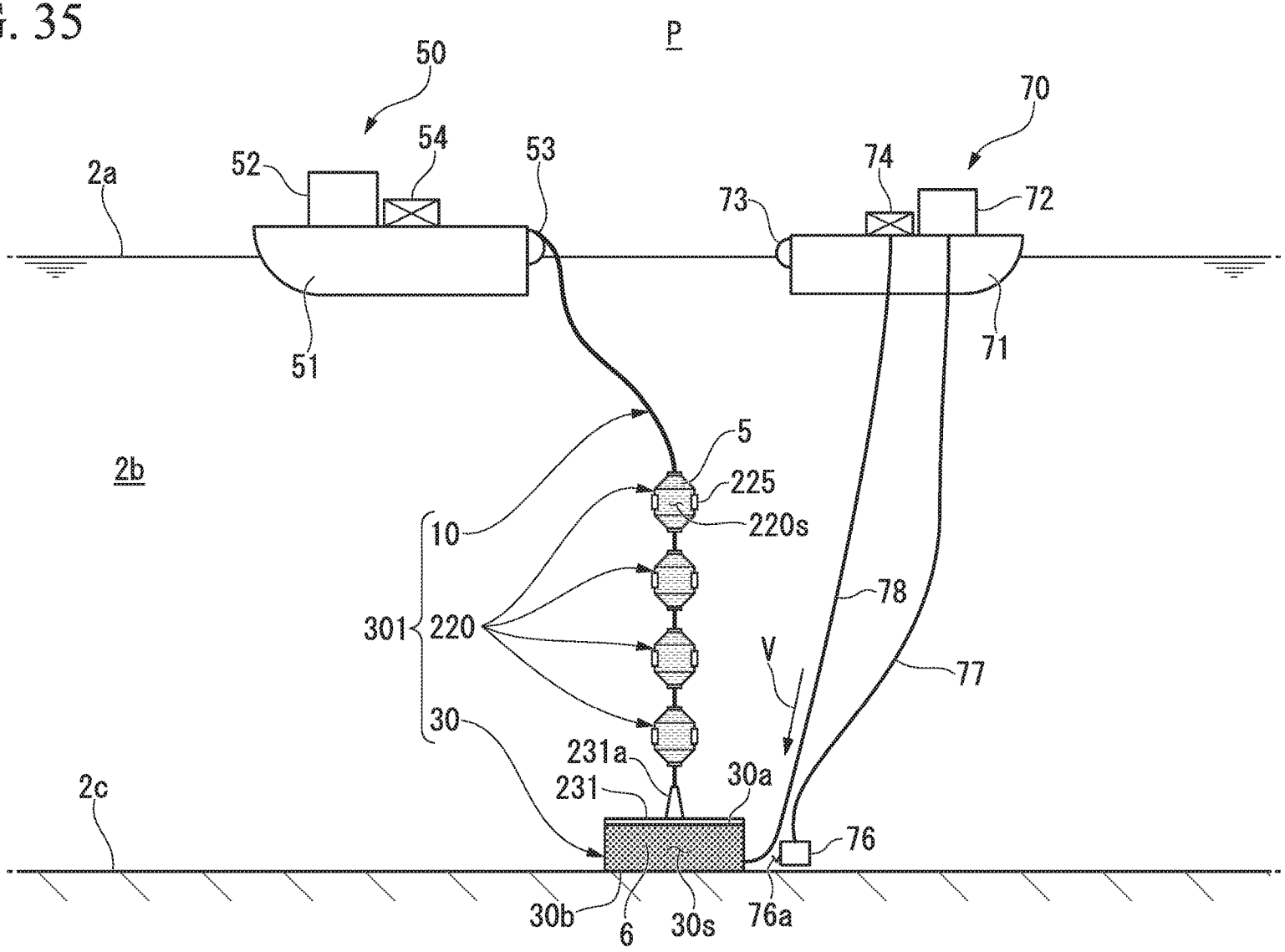
FIG. 35 is, subsequent to FIG. 34, an explanatory view of a sinker-on-the-seabed state and a high-specific gravity liquid introduction step of introducing high-specific gravity liquid to the weight member.

FIG. 35 is, subsequent to FIG. 34, an explanatory view of a sinker-on-the-seabed state and a high-specific gravity liquid introduction step of introducing high-specific gravity liquid to the weight member. In FIG. 35, the reference sign V indicates the introduction direction of the high-specific gravity liquid 6.

When the weight member 30 continues to sink at the mooring position P due to the lowering step, as illustrated in FIG. 35, the weight member 30 arrives at the seabed 2*c*, and the sinker-on-the-seabed state is formed.

In the high-specific gravity liquid introduction step, the high-specific gravity liquid 6 is introduced to the filling space 30*s* of the weight member 30 at the mooring position P. Specifically, in the high-specific gravity liquid introduction step, the hose 78 is coupled to the unillustrated hole of the weight member 30, and the high-specific gravity liquid 6 is introduced to the filling space 30*s* of the weight member 30 via the hose 78 using the pump 74. When the high-specific gravity liquid 6 is introduced to the filling space 30*s*, the seawater 5 in the filling space 30*s* is discharged through the hole.

Figure 36:
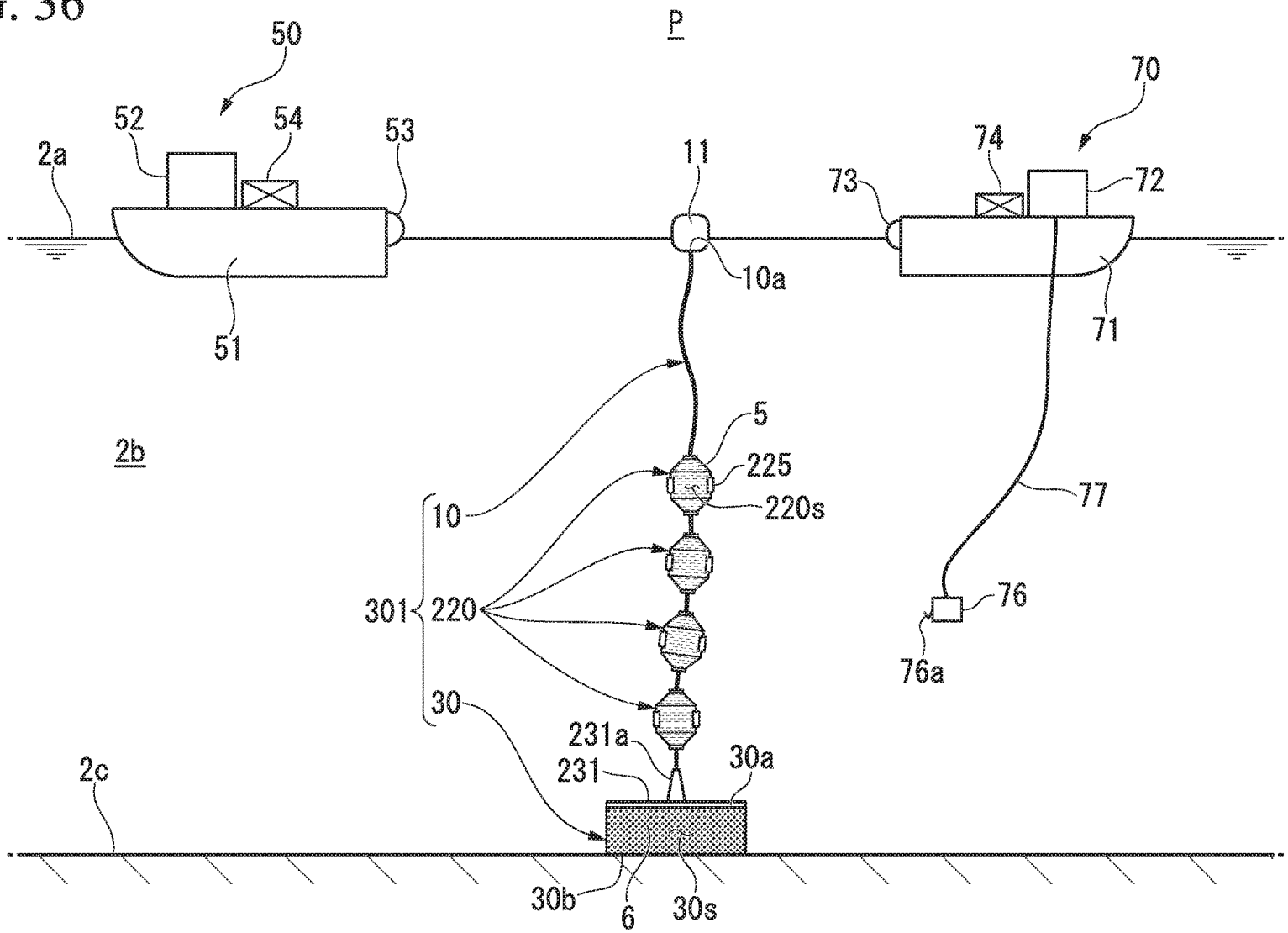
FIG. 36 is, subsequent to FIG. 35, an explanatory view of a buoy-joining step of joining a buoy with the one end of the mooring cable in the mooring member and a temporary placement state of the mooring member.

FIG. 36 is, subsequent to FIG. 35, an explanatory view of a buoy-joining step of joining a buoy with the one end 10*a* of the mooring cable 10 in the mooring member 301 and a temporary placement state of the mooring member 301.

As illustrated in FIG. 36, in the buoy-joining step, the buoy 11 is detachably joined with the one end 10*a* of the mooring cable 10, and the buoy 11 is floated on the sea surface 2*a*.

When the ROV 76 is recovered into the workboat 70 by means of the ROV-recovering step after the high-specific gravity liquid introduction step and the hose-winding step, as illustrated in FIG. 36, a state in which the mooring member 301 is temporarily placed before the float 80 is moored using the mooring member 301 is formed.

Figure 37:
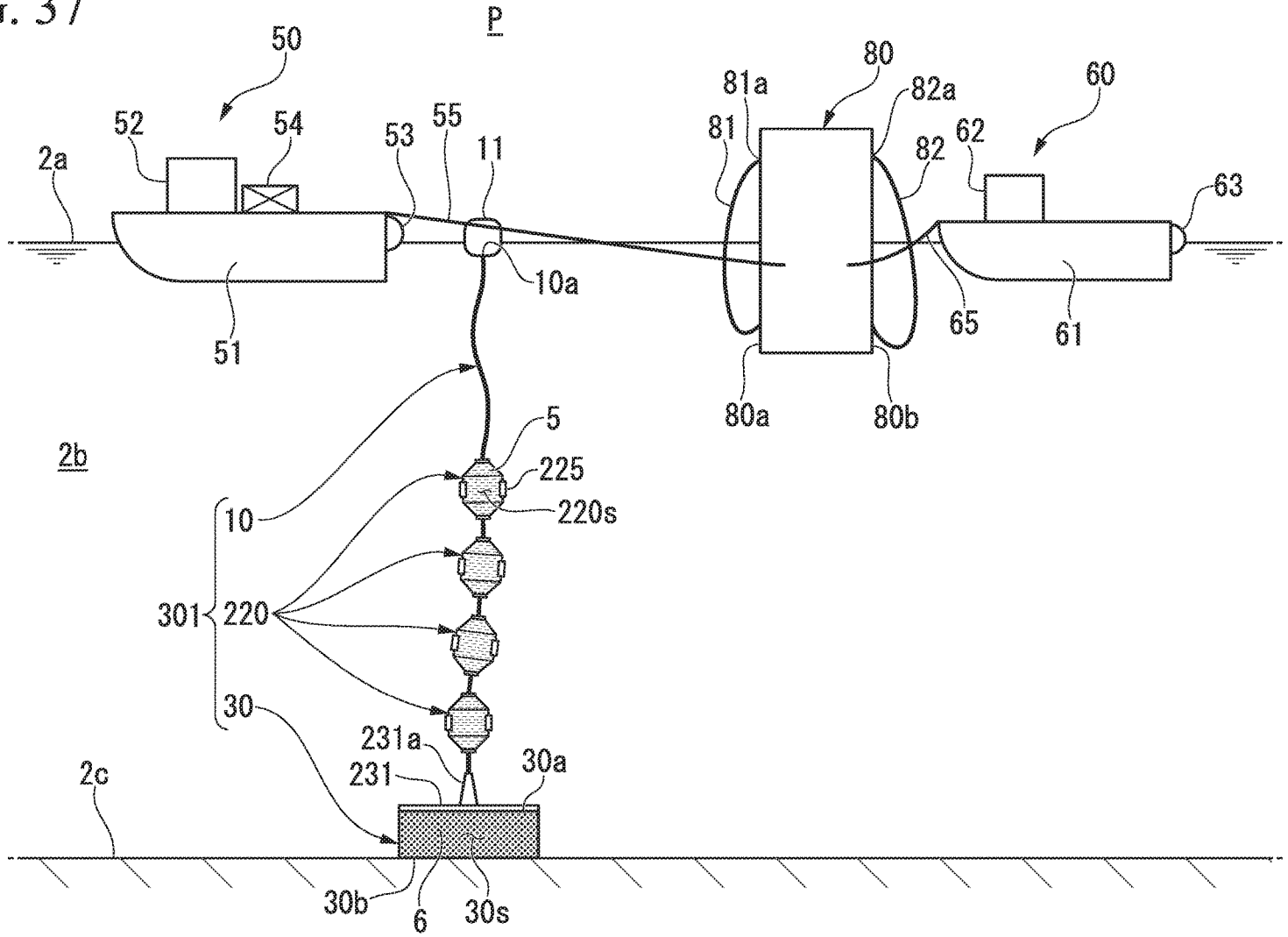
FIG. 37 is, subsequent to FIG. 36, an explanatory view of an arrival state of the float.

FIG. 37 is, subsequent to FIG. 36, an explanatory view of an arrival state of the float 80.

In the temporary placement state of the mooring member 301, when the float 80 is transported to the mooring position P by, for example, two tugboats (the main tugboat 50 and the subsidiary tugboat 60), the arrival state in which the float 80 which is a mooring subject of the mooring member 301 has arrived at the mooring position P as illustrated in FIG. 37 is formed. In the arrival state, the main tugboat 50 and the subsidiary tugboat 60 stay at the mooring position P.

Figure 38:
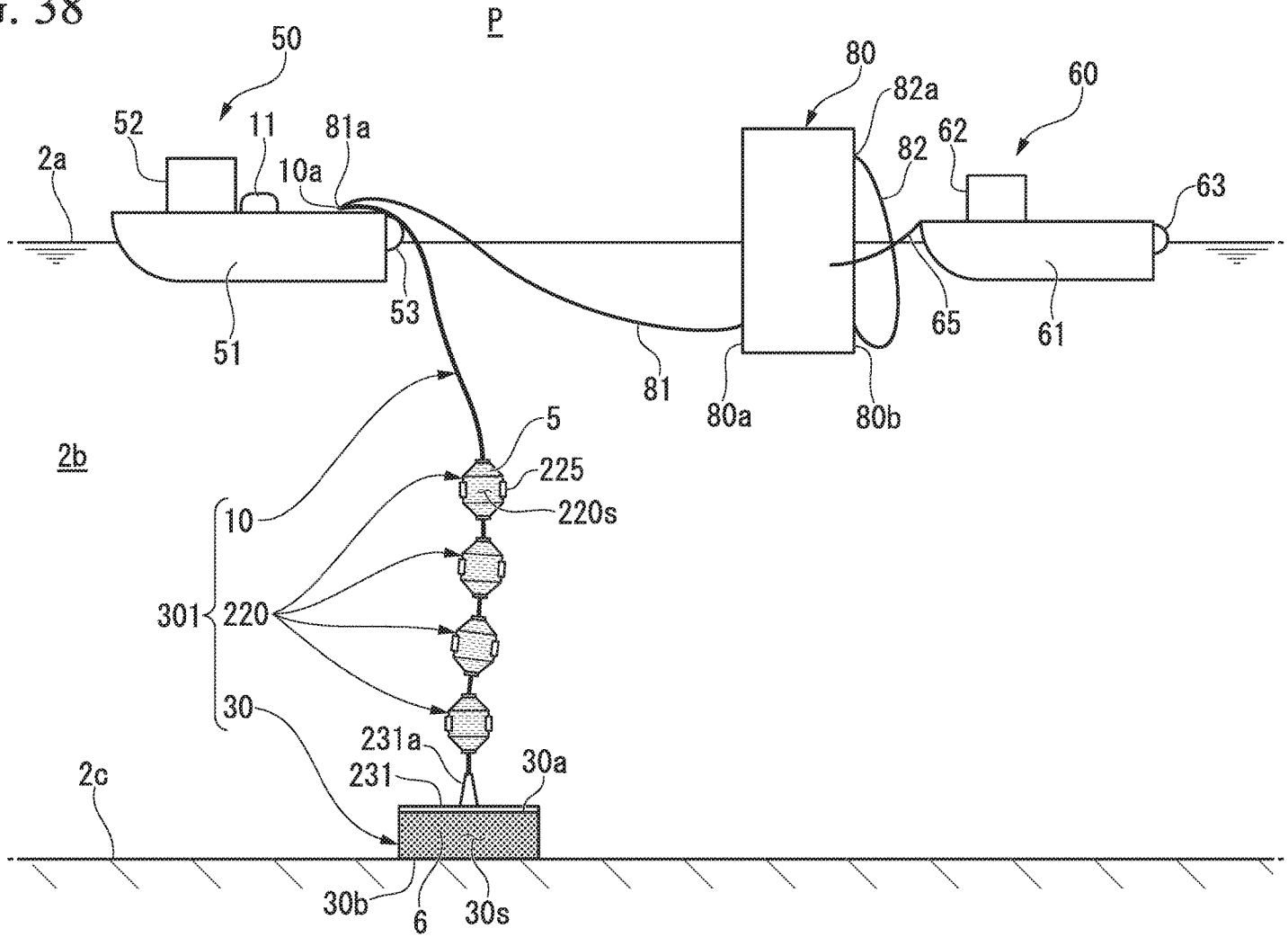
FIG. 38 is, subsequent to FIG. 37, an explanatory view of a mooring cable connection step.

FIG. 38 is, subsequent to FIG. 37, an explanatory view of a mooring cable connection step.

As illustrated in FIG. 38, in the mooring cable connection step, the one end 10*a* of the mooring cable 10 is connected to the other end 81*a* of the rope 81 which is placed in the float 80 by the main tugboat 50.

Figure 39:
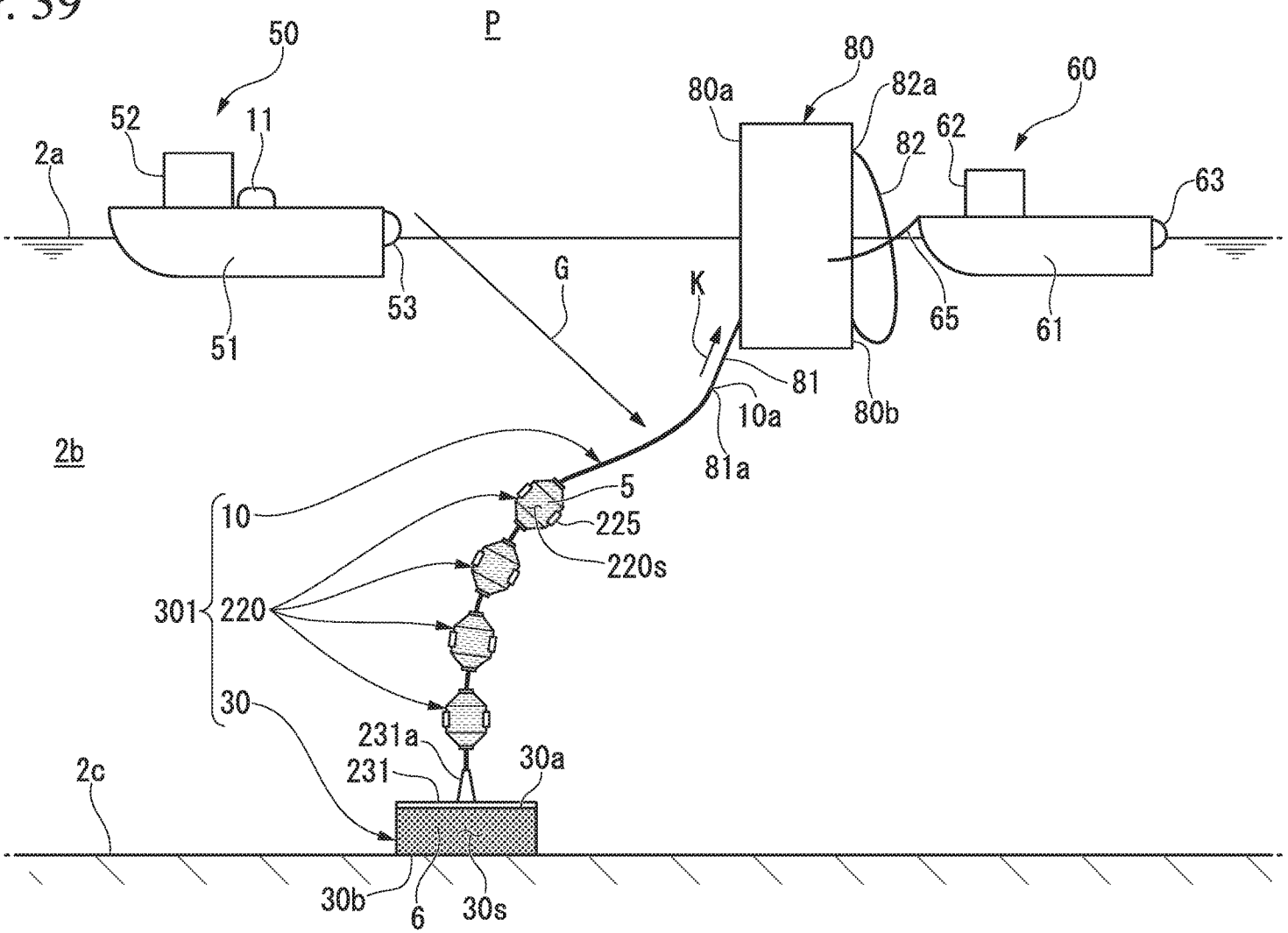
FIG. 39 is, subsequent to FIG. 38, an explanatory view of a mooring cable deployment step.

FIG. 39 is, subsequent to FIG. 38, an explanatory view of a mooring cable deployment step.

As illustrated in FIG. 39, in the mooring cable deployment step, the mooring cable 10 connected to the other end 81*a* of the rope 81 is lowered into the sea 2*b* from the main tugboat 50 while winding the rope 81. Therefore, the mooring cable 10 sinks into the sea 2*b* together with the rope 81 and is positioned to be curved in a spline shape between the joining portion 231*a* and the lower portion of the float 80.

Figure 40:
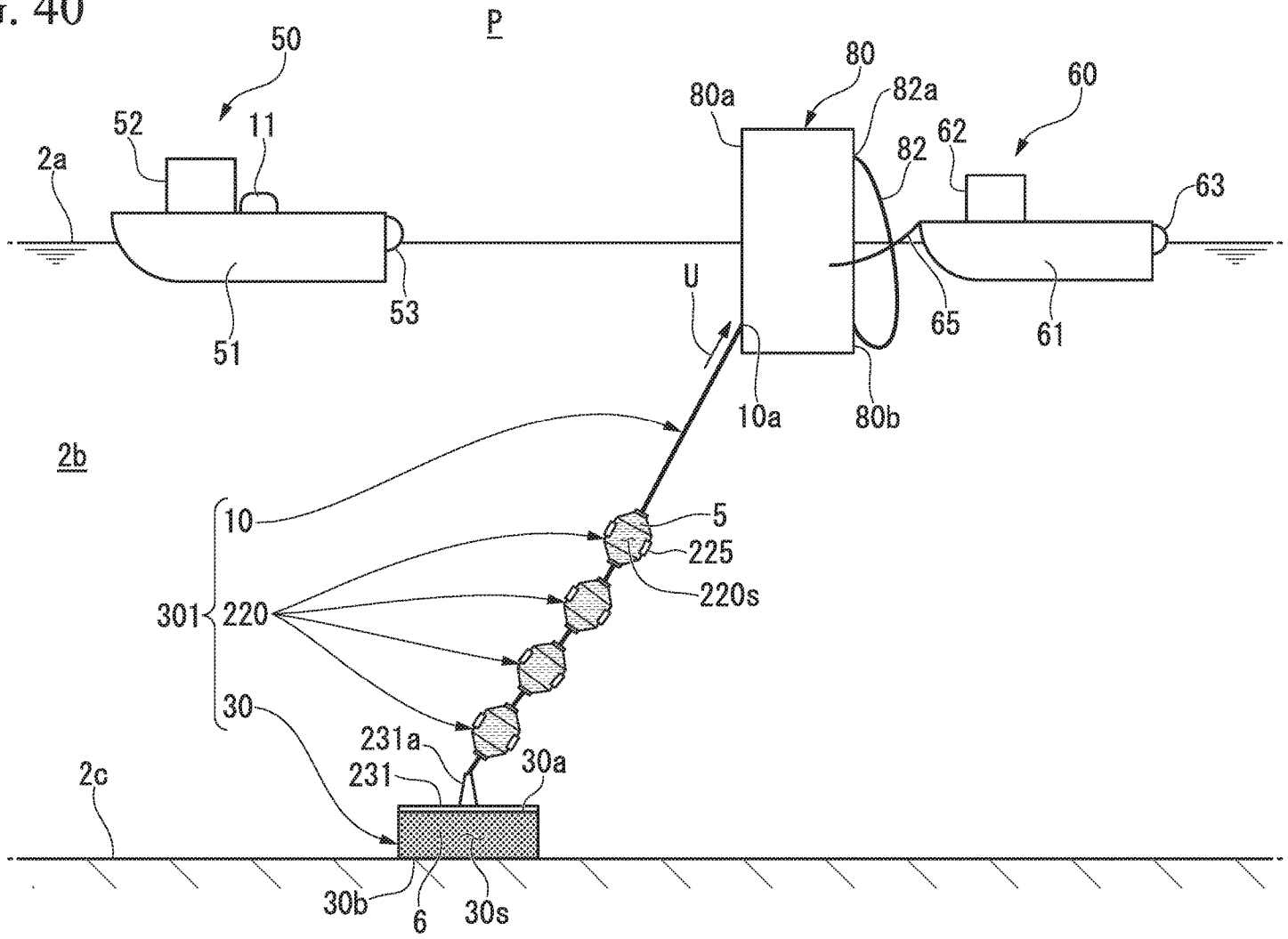
FIG. 40 is, subsequent to FIG. 39, an explanatory view of a mooring cable-lifting step.

FIG. 40 is, subsequent to FIG. 39, an explanatory view of a mooring cable-lifting step.

As illustrated in FIG. 40, in the mooring cable-lifting step, the rope 81 connected to the one end 10*a* of the mooring cable 10 is wound up using the unillustrated winch provided in the float 80.

Figure 41:
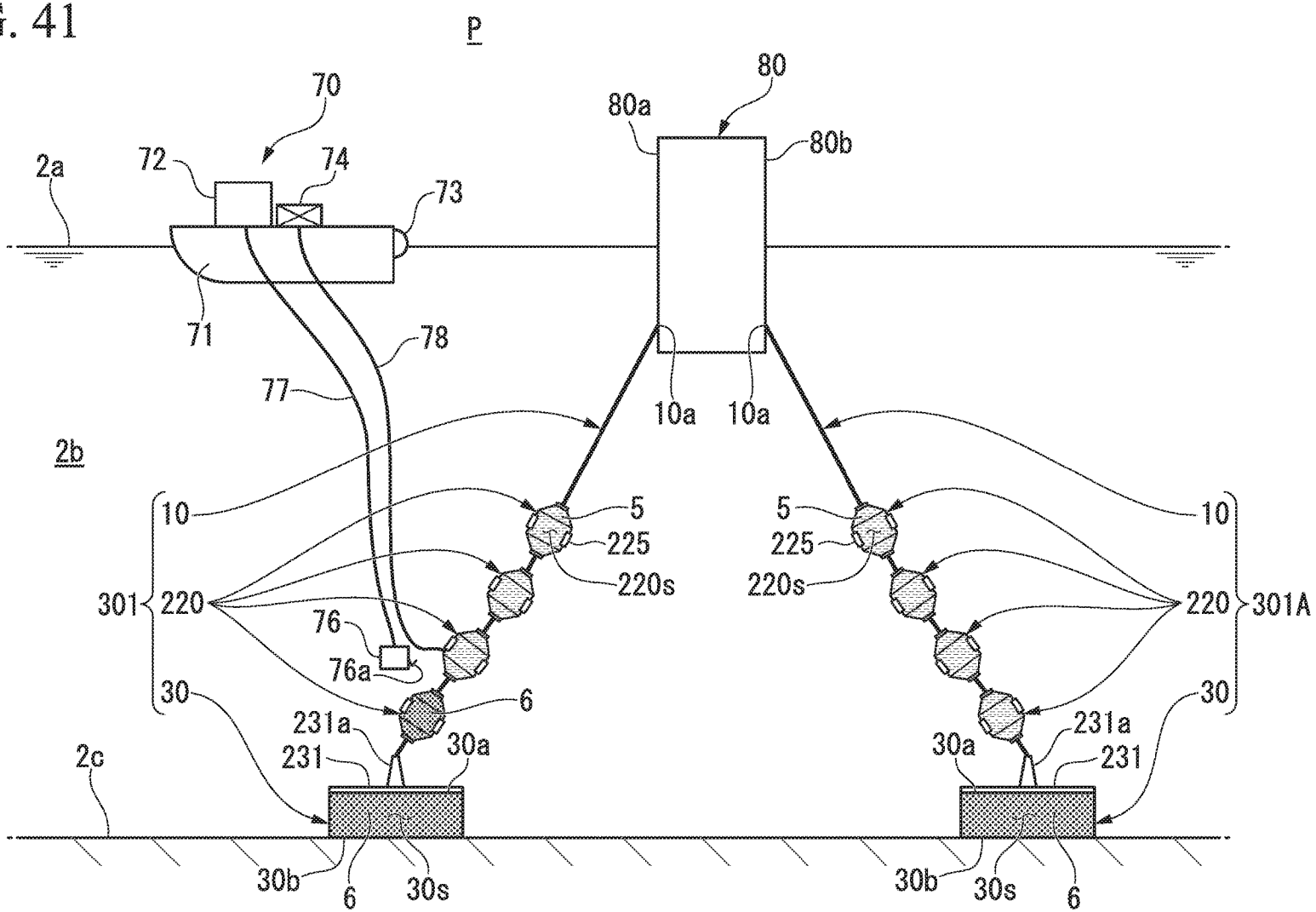
FIG. 41 is, subsequent to FIG. 40, an explanatory view of a high-specific gravity liquid introduction step (second accommodation step) of introducing the high-specific gravity liquid to the respective variant members.

FIG. 41 is, subsequent to FIG. 40, an explanatory view of a high-specific gravity liquid introduction step (second accommodation step) of introducing the high-specific gravity liquid to the respective variant members 220.

As illustrated in FIG. 41, in the high-specific gravity liquid introduction step, the high-specific gravity liquid 6 is introduced as the second heavy weight to the accommodation spaces 220*s* of the respective variant members 220 which is filled with the seawater 5 together with the seawater 5.

Specifically, in the high-specific gravity liquid introduction step, the hose 78 is coupled to the unillustrated holes of the variant members 220, and the high-specific gravity liquid 6 is introduced to the accommodation spaces 220*s* of the respective variant members 220 via the hose 78 using the pump 74. When the high-specific gravity liquid 6 is introduced to the accommodation space 220*s*, the seawater 5 in the accommodation spaces 220*s* is discharged through the holes. That is, in the high-specific gravity liquid introduction step, the high-specific gravity liquid 6 (the second heavy weight) is accommodated in the accommodation spaces 220*s* of the respective variant members 220 by being added to the seawater 5 or being exchanged with at least part of the seawater 5.

In the high-specific gravity liquid introduction step, when the high-specific gravity liquid 6 is introduced to the accommodation spaces 220*s* of the respective variant members 220, the total weight of the respective variant members 220 and the substance accommodated in the variant member becomes heavier than that before the high-specific gravity liquid introduction step. Therefore, the mooring cable 10 is imparted with a predetermined tensile force as illustrated in FIG. 42.

A mooring member 301A (second mooring member) is connected to the second side surface 80*b* of the float 80.

The mooring member 301A is connected to the second side surface in the same manner as in the mooring cable connection step of the mooring member 301 (first mooring member). Furthermore, the mooring cable deployment step, the mooring cable-lifting step, and the high-specific gravity liquid introduction step are performed on the mooring member 301A in the same manner as on the mooring member 301.

Figure 42:
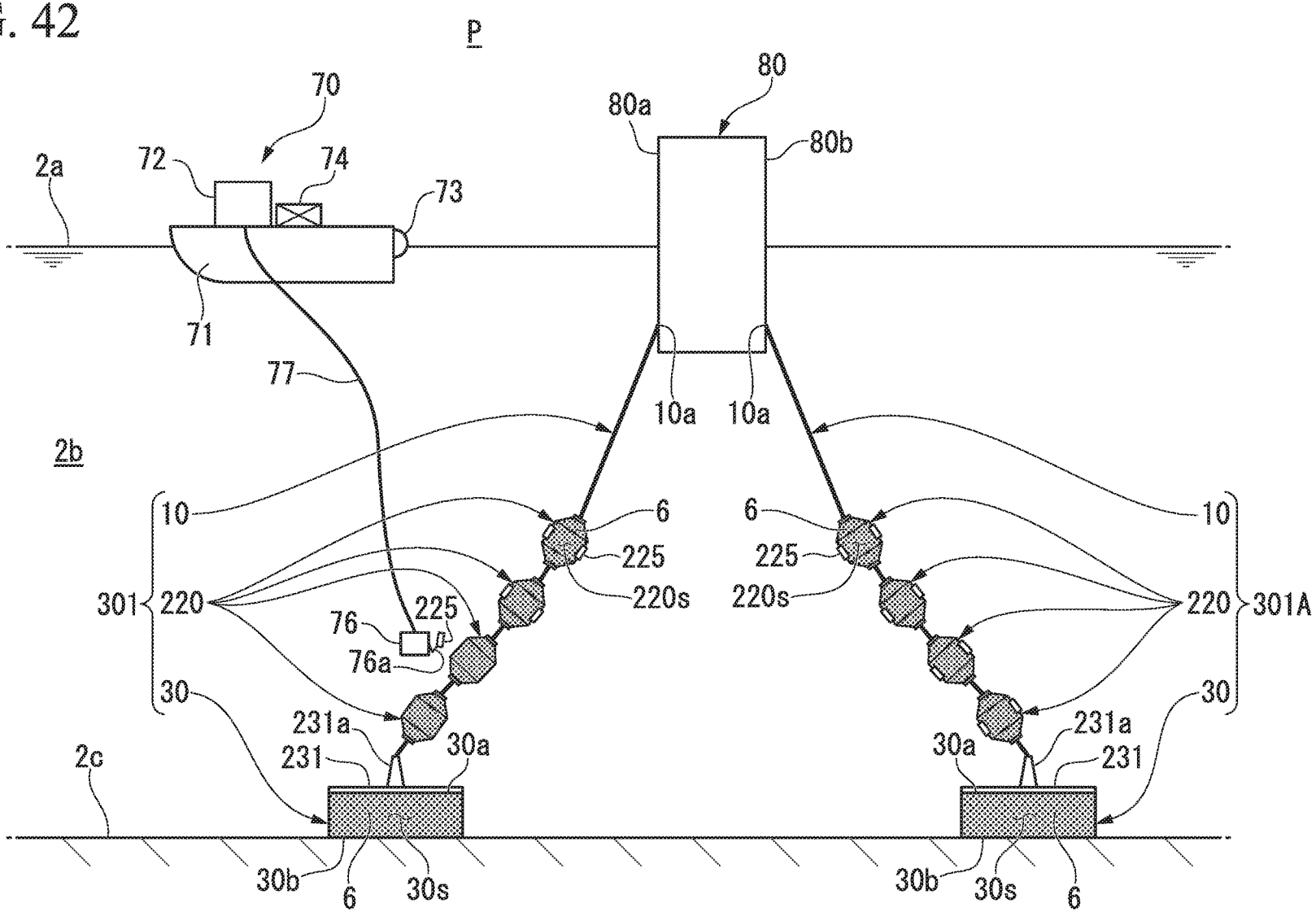
FIG. 42 is, subsequent to FIG. 41, an explanatory view of an ROV-recovering step.

FIG. 42 is, subsequent to FIG. 41, an explanatory view of an ROV-recovering step.

As illustrated in FIG. 42, in the ROV-recovering step, the cable 77 is wound up using the unillustrated winch, and the ROV 76 is recovered. When the ROV-recovering step is completed, the workboat 70 leaves the mooring position P.

Figure 43:
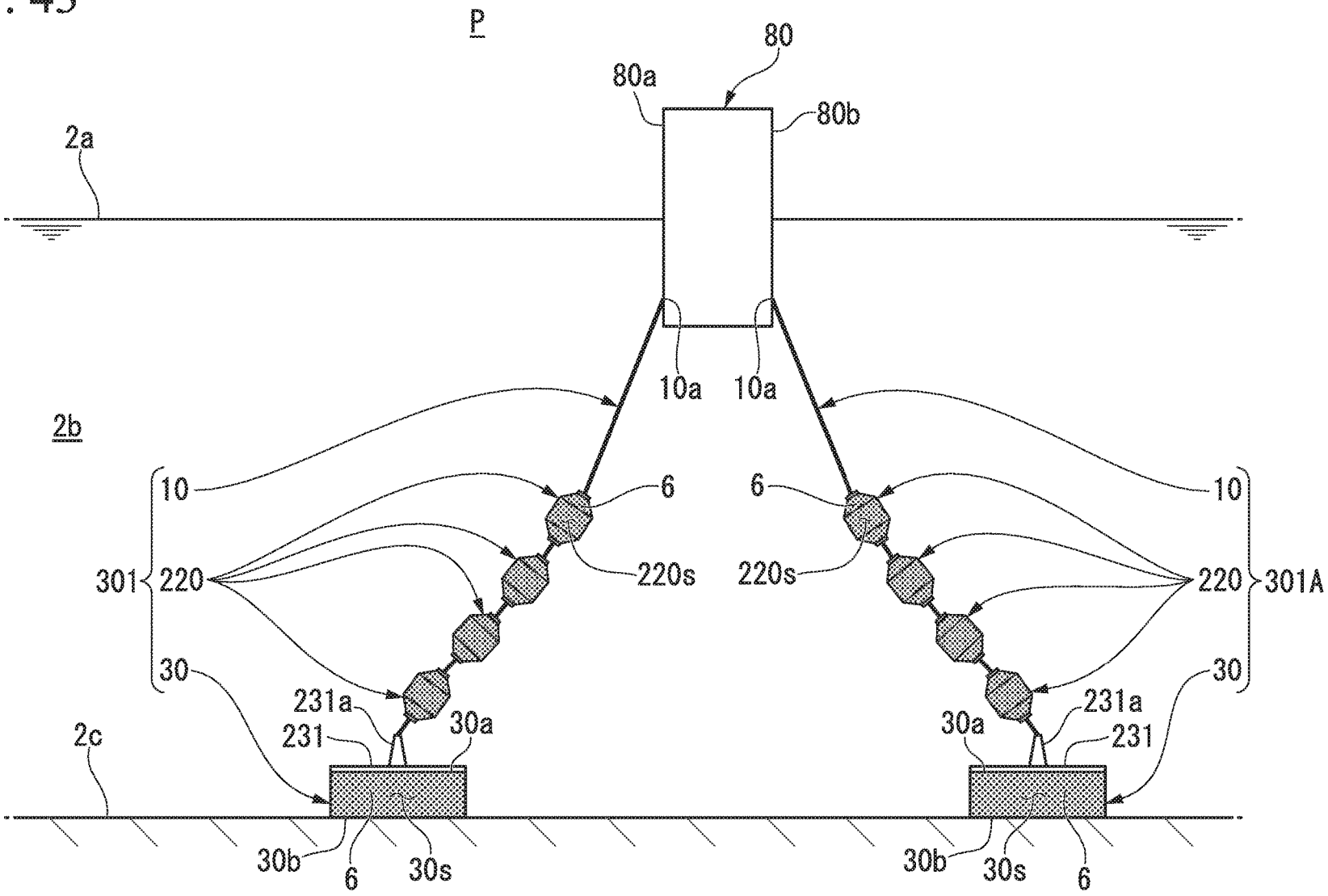
FIG. 43 is, subsequent to FIG. 42, an explanatory view of a mooring state of the float.

FIG. 43 is, subsequent to FIG. 42, an explanatory view of a mooring state of the float 80.

When the above-described steps are performed, a mooring state in which the float 80 is moored using the mooring members 301 and 301A as illustrated in FIG. 43 is formed. In the mooring state, since a certain tensile force acts on the mooring cables 10 in the respective mooring members 301 and 301A, the float 80 is stably placed at the mooring position P.

As described above, in the embodiment, the multiple variant members 220 are placed at predetermined intervals between the one end 10*a* and the other end 10*b* of the mooring cable 10.

According to this method, the seawater 5 and the high-specific gravity liquid 6 can be accommodated in each of the multiple variant members, and it is possible to easily adjust the weights of the variant members 220 and the tensile force of the mooring cable 10.

Furthermore, the technical scope of the present invention is not limited to the embodiments, and the embodiments can be modified in various manners within the scope of the gist of the present invention.

For example, in a case in which structures are installed in water areas, the present invention can be applied even when the drafts or positions of the structures are changed.

Additionally, it is possible to appropriately replace the constitutional elements in the embodiments with well-known constitutional elements within the scope of the gist of the present invention, or the embodiments may be appropriately combined together.

INDUSTRIAL APPLICABILITY

The present invention relates to a float mooring method, a mooring member, and a recovering method. According to the present invention, mooring cables can be easily connected to floats before the second accommodation step, and the specific weights of accommodation members can be increased in the same manner as those of weight members during the second accommodation step, and thus it is possible to easily moor floats.

REFERENCE SIGNS LIST

1, 201, 301 MOORING MEMBER
2*a* SEA SURFACE (WATER SURFACE)
2*c* SEABED (BOTTOM OF WATER AREA)
3 AIR
5 SEAWATER (FIRST HEAVY WEIGHT)
6 HIGH-SPECIFIC GRAVITY LIQUID (SECOND HEAVY WEIGHT)
10 MOORING CABLE
10*a* ONE END OF MOORING CABLE
10*b* THE OTHER END OF MOORING CABLE
20 TUBE MEMBER (ACCOMMODATION MEMBER)
20*s* ACCOMMODATION SPACE
30 WEIGHT MEMBER
30*s* FILLING SPACE
80 FLOAT
81*a* THE OTHER END OF ROPE (FIRST CONNECTION PORTION)
82*a* THE OTHER END OF ROPE (SECOND CONNECTION PORTION)
220 VARIANT MEMBER
P MOORING POSITION

The invention claimed is:

1. A float mooring method comprising:

a transportation step of transporting a mooring member having a mooring cable which can be connected to a float at one end thereof and an accommodation member which is installed at the other end of the mooring cable or between the one end and the other end of the mooring cable and has an accommodation space therein to a mooring position of the float in a working water area;

a first accommodation step of accommodating a first heavy weight in at least a part of the accommodation space of the accommodation member at the mooring position;

a connection step of connecting the one end of the mooring cable to the float at the mooring position after the first accommodation step; and a second accommodation step of accommodating a second heavy weight in the accommodation space of the accommodation member by adding the second heavy weight to the first heavy weight or exchanging at least part of the first heavy weight with the second heavy weight at the mooring position after the connection step.

2. The float mooring method according to claim 1, wherein, in the transportation step, the mooring member is transported in a state in which the accommodation space is filled with air.

3. The float mooring method according to claim 1, wherein at least one of the first heavy weight and the second heavy weight has flowability.

4. The float mooring method according to claim 3, wherein, in the second accommodation step, the same substance as the first heavy weight in the first accommodation step is used as the second heavy weight.

5. The float mooring method according to claim 4, wherein water in the water area is used as the first heavy weight and the second heavy weight.

6. The float mooring method according to claim 1, wherein, as the mooring member, a weight member which is attached to the other end of the mooring cable or in the accommodation member, is placed at the bottom of the water area, and has a filling space therein is further used.

7. The float mooring method according to claim 1, comprising:

before the connection step, a buoy-joining step of joining a buoy with the one end of the mooring cable and floating the buoy on a water surface in the water area.

8. The float mooring method according to claim 1, wherein, as the accommodation member, a tube member which is attached to the other end of the mooring cable is used.

9. The float mooring method according to claim 1, wherein, as the accommodation member, a variant member which is attached between the one end and the other end of the mooring cable is used.

10. The float mooring method according to claim 9, wherein multiple variant members are placed at predetermined intervals between the one end and the other end of the mooring cable.

11. The float mooring method according to claim 1, wherein, as the mooring member, a first mooring member which is connected to a first connection portion of the float and a second mooring member which is connected to a second connection portion that is placed at a position different from that of the first connection portion in the float are used.

* * * * *